US007815303B2

(12) United States Patent
Kasai

(10) Patent No.: US 7,815,303 B2
(45) Date of Patent: Oct. 19, 2010

(54) INKJET RECORDING METHOD

(75) Inventor: Seishi Kasai, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 8 days.

(21) Appl. No.: 12/236,758

(22) Filed: Sep. 24, 2008

(65) Prior Publication Data

US 2009/0085996 A1 Apr. 2, 2009

(30) Foreign Application Priority Data

Sep. 28, 2007 (JP) ..... 2007-255513

(51) Int. Cl.
*G03G 15/08* (2006.01)

(52) U.S. Cl. ..... 347/102; 347/100; 347/101; 347/103

(58) Field of Classification Search ..... 347/100, 347/101, 102
See application file for complete search history.

(56) References Cited

U.S. PATENT DOCUMENTS

| | | | | |
|---|---|---|---|---|
| 4,878,977 | A | 11/1989 | Kueppers | |
| 2003/0021961 | A1 | 1/2003 | Ylitalo et al. | |
| 2004/0045931 | A1 | 3/2004 | Hill et al. | |
| 2004/0189772 | A1* | 9/2004 | Arai | 347/102 |
| 2005/0128269 | A1* | 6/2005 | Koike et al. | 347/100 |
| 2005/0190248 | A1* | 9/2005 | Konno et al. | 347/102 |
| 2006/0075917 | A1 | 4/2006 | Edwards | |
| 2006/0189712 | A1* | 8/2006 | Kondo | 523/160 |
| 2007/0058021 | A1* | 3/2007 | Kusunoki | 347/102 |
| 2007/0097193 | A1 | 5/2007 | Ma et al. | |
| 2007/0206045 | A1 | 9/2007 | Umebayashi et al. | |
| 2007/0225404 | A1 | 9/2007 | Umebayashi et al. | |
| 2008/0074482 | A1* | 3/2008 | Makuta et al. | 347/102 |

FOREIGN PATENT DOCUMENTS

| | | | |
|---|---|---|---|
| EP | 1 728 644 | A1 | 12/2006 |
| EP | 1728644 | A1 * | 12/2006 |
| EP | 1 829 937 | A1 | 9/2007 |
| EP | 1 958 782 | A1 | 8/2008 |
| JP | 63-060783 | A | 3/1988 |
| JP | 08-174997 | A | 7/1996 |
| JP | 2000-141616 | A | 5/2000 |
| JP | 2003-145745 | A | 5/2003 |
| JP | 2003-531223 | A | 10/2003 |
| JP | 2004-042548 | A | 2/2004 |
| JP | 2005-096254 | A | 4/2005 |

OTHER PUBLICATIONS

European Search Report dated Oct. 23, 2009.

* cited by examiner

*Primary Examiner*—Matthew Luu
*Assistant Examiner*—Rut Patel
(74) *Attorney, Agent, or Firm*—Sughrue Mion, PLLC

(57) ABSTRACT

An inkjet recording method is provided that includes (a) a step of applying an undercoat liquid onto a recording medium, (b) a step of carrying out image formation by discharging a colored liquid onto the undercoat liquid, and (c) a step of curing the colored liquid, the colored liquid being a multiple color ink set comprising a plurality of ink compositions, and the colored liquid comprising an ink composition of at least one color selected from the group consisting of violet, blue, green, orange, and red.

16 Claims, 12 Drawing Sheets

INKJET RECORDING METHOD

BACKGROUND OF THE INVENTION

1. Field of the Invention

The present invention relates to an inkjet recording method and, more particularly, to an inkjet recording method employing an undercoat liquid and a colored liquid.

2. Description of the Related Art

Inkjet systems, in which ink is discharged as droplets from an ink discharge orifice, are employed in many printers for reasons such as small size, low cost, and an ability to form an image without contacting a recording medium. Among these inkjet systems, a piezo inkjet system, in which ink is discharged by utilizing deformation of a piezoelectric element, and a thermal inkjet system, in which droplets of ink are discharged by utilizing the phenomenon of boiling of the ink by means of thermal energy, are characterized by their high resolution and high speed printing properties.

In recent years, inkjet printers have not been limited only to photographic printing and document printing for home use or office use, and the development of commercial printing equipment and industrial printing equipment employing inkjet printers has been carried out.

In contrast to conventional inkjet inks and inkjet recording methods for home use or office use, there is a strong requirement for inkjet inks and recording methods intended for use in commercial printing equipment or industrial printing equipment to have (1) wide color reproduction in a formed image, (2) an ability to carry out printing on all types of recording media including nonpermeable recording media such as plastic media, and (3) an ability to carry out high speed printing employing a single pass system.

Inkjet inks and inkjet recording methods for home use or office use have often been developed for the purpose of printing photographs or documents, and there is the serious problem of their narrow color reproduction as commercial or industrial printed materials.

Furthermore, when recording is carried out on a non-absorbing recording medium by use of conventional inkjet inks and inkjet recording methods, it takes a long time for drying of the fired droplets or penetration thereof into the recording medium, there are the practical problems that the image easily spreads, and there is mixing of adjacent ink droplets on the recording medium, thereby preventing a sharp image from being formed. Moreover, as another problem of an image recorded on a non-absorbing recording medium, fixation of the image is not good, with the result that it is easily peeled off from the recording medium and the abrasion properties are poor.

Furthermore, as a problem when applied to high speed printing employing the single pass system, uneven color, etc. occurs due to fired droplet interference. 'Fired droplet interference' means a phenomenon in which, since liquid droplets fired next to each other coalesce and move, they are displaced from the positions at which they landed, thus causing nonuniformity in line width when drawing fine lines and causing uneven color, etc. when drawing a colored surface.

As a method for solving the above-mentioned problems, various techniques have so far been proposed. As an example thereof, there is a method in which a radiation-curable undercoat is provided, and during curing a colored image is formed thereon (ref. e.g. JP-A-2000-141616 (JP-A denotes a Japanese unexamined patent application publication)).

Furthermore, in order to achieve a desired color gamut, a radiation-curable inkjet ink employing a special pigment such as Pigment Orange or Pigment Green has been disclosed (ref. e.g. JP-PCT-2003-531223 (JP-PCT denotes a published Japanese translation of a PCT application)).

As an attempt to impart high definition drawing performance when printing at high speed, two reactive liquid inks are used, and they are reacted on a recording medium; for example, there have been disclosed a method in which, after a liquid containing a basic polymer is applied, recording is carried out using an ink containing an anionic dye (ref. e.g. JP-A-63-60783), and a method in which, after a liquid composition containing a cationic substance is applied, an ink containing an anionic compound and a colorant is applied (ref. e.g. JP-A-8-174997).

Furthermore, as an ink for which fixation to a nonpermeable medium is taken into consideration there has been proposed an inkjet recording method in which a UV-curing ink is used, dots of the UV-curing color ink discharged onto a recording medium are irradiated with ultraviolet rays that match the discharge timing, thus pre-curing them to such a degree that the viscosity increases and adjacent dots do not mix together, and they are then further irradiated with ultraviolet rays and fully cured (ref. e.g. JP-A-2004-42548).

Moreover, there has been proposed a technique in which, after a radiation-curable white ink is applied uniformly on a transparent or semi-transparent non-absorbing recording medium as an undercoat layer and solidified or made to have an increased viscosity by exposure to radiation, inkjet recording is carried out using a radiation-curable color ink set, thus improving the color ink visibility, spreading, and the problem that images vary between various recording media (ref. e.g. JP-A-2003-145745). Furthermore, there has also been proposed a technique in which, instead of the radiation-curable white ink above, a substantially transparent actinic radiation-curable ink is applied by an inkjet head (ref. e.g. JP-A-2005-96254).

BRIEF SUMMARY OF THE INVENTION

However, with regard to the method described in JP-A-2000-141616, when inks having different colors are layered, it is difficult to prevent spreading between colors, and with regard to the method described in JP-PCT-2003-531223, although this method is useful for widening the color gamut, since it mainly employs a cationic polymerization system, it is easily influenced by moisture, etc. and there is a problem with ink storage stability.

In accordance with the method described in JP-A-63-60783, although problems such as fired droplet interference and spreading can be avoided for a specific substrate, the method is inadequate from the viewpoint of image fixation. On the other hand, in accordance with the method described in JP-A-2003-145745, although spreading is suppressed and image fixation is improved, there is still the problem that images vary between various recording media, and the method is inadequate for solving nonuniformity in line width, color unevenness, etc. due to mixing of droplets. Furthermore, the methods described in JP-A-8-174997 and JP-A-2004-42548 are inadequate for solving nonuniformity in line width, color unevenness, etc. due to mixing of droplets. Moreover, the method described in JP-A-2005-96254 still has problems such as nonuniformity in line width and color unevenness due to mixing of droplets.

The present invention has been accomplished in the light of the above-mentioned circumstances, and it is a particular object of the present invention to provide an inkjet recording method that satisfies at the same time three points, that is, (1) ensuring a color gamut equal to the PANTONE color gamut, (2) having excellent image fixation (rapid drying), and (3) being suitable as a single pass system recording method.

The above-mentioned object of the present invention has been attained by means described in (1). This is described below together with (2) to (15), which are preferred embodiments.

(1) An inkjet recording method comprising (a) a step of applying an undercoat liquid onto a recording medium, (b) a step of carrying out image formation by discharging a colored liquid onto the undercoat liquid, and (c) a step of curing the colored liquid, the colored liquid being a multiple color ink set comprising a plurality of ink compositions, and the colored liquid comprising an ink composition of at least one color selected from the group consisting of violet, blue, green, orange, and red, (2) the inkjet recording method according to (1) above, wherein the method comprises a step of semi-curing the undercoat liquid after the step of applying the undercoat liquid and before the step of carrying out image formation, (3) the inkjet recording method according to (1) or (2) above, wherein the method further comprises, after discharging an ink composition of at least one color, a step of semi-curing the ink composition, (4) the inkjet recording method according to any one of (1) to (3) above wherein, when the surface tension of the colored liquid is $\gamma k$ and the surface tension of the undercoat liquid is $\gamma s$, $\gamma k > \gamma s$, (5) the inkjet recording method according to any one of (1) to (4) above, wherein the colored liquid comprises an ink composition of at least one color selected from the group consisting of violet, blue, green, orange, and red, together with cyan color, magenta color, yellow color, black color, and white color ink compositions, (6) the inkjet recording method according to any one of (1) to (5) above, wherein the step of carrying out image formation by discharging the colored liquid comprises, in sequence, a step of discharging a white color ink composition, a step of discharging a cyan color ink composition, a step of discharging a magenta color ink composition, a step of discharging an ink composition of at least one color selected from the group consisting of violet, blue, green, orange, and red, a step of discharging a yellow color ink composition, and a step of discharging a black color ink composition, (7) the inkjet recording method according to any one of (1) to (6) above, wherein the colored liquid comprises an ink composition of at least one color selected from the group consisting of violet, green, and orange, (8) the inkjet recording method according to any one of (1) to (7) above, wherein the colored liquid comprises a violet color ink composition, a green color ink composition, and an orange color ink composition, (9) the inkjet recording method according to any one of (1) to (8) above, wherein the violet color ink composition comprises Pigment Violet 23,

(10) the inkjet recording method according to any one of (1) to (9) above, wherein the orange color ink composition comprises Pigment Orange 36,

(11) the inkjet recording method according to any one of (1) to (10) above, wherein the green color ink composition comprises Pigment Green 7,

(12) the inkjet recording method according to any one of (5) to (11) above, wherein the cyan color ink composition comprises Pigment Blue 15:3 and/or Pigment Blue 15:4,

(13) the inkjet recording method according to any one of (5) to (12) above, wherein the magenta color ink composition comprises Pigment Red 122 and/or Pigment Violet 19,

(14) the inkjet recording method according to any one of (5) to (13) above, wherein the yellow color ink composition comprises Pigment Yellow 155 and/or Pigment Yellow 180, and

(15) the inkjet recording method according to any one of (5) to (14) above, wherein the white color ink composition comprises titanium oxide.

DETAILED DESCRIPTION OF THE INVENTION

Figure 1:
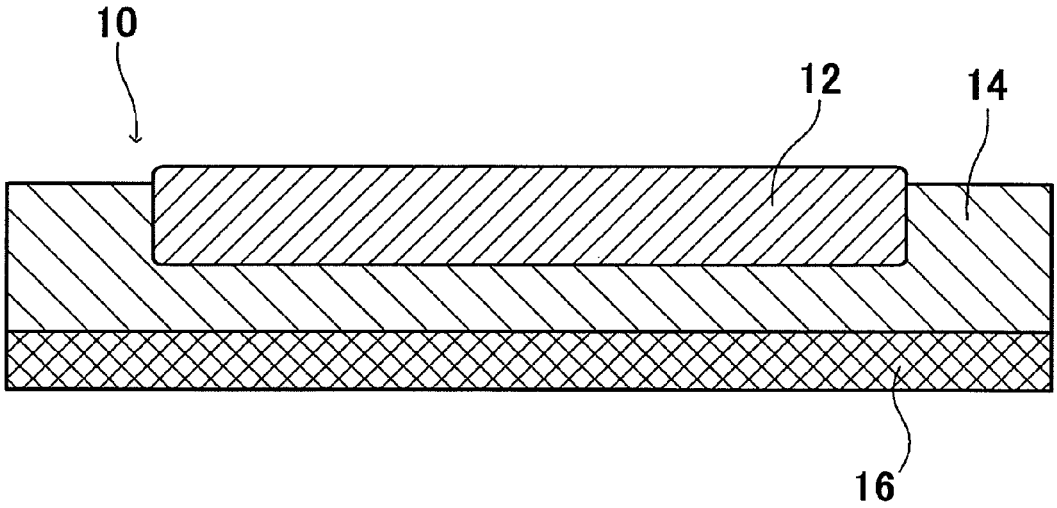
FIG. 1 is a cross-sectional schematic diagram showing one embodiment of a printed material obtained by firing droplets of a colored liquid onto a semi-cured undercoat liquid layer.

The inkjet recording method of the present invention comprises (a) a step of applying an undercoat liquid onto a recording medium, (b) a step of carrying out image formation by discharging a colored liquid onto the undercoat liquid, and (c) a step of curing the colored liquid, the colored liquid being a multiple color ink set comprising a plurality of ink compositions, and the colored liquid comprising an ink composition of at least one color selected from the group consisting of violet, blue, green, orange, and red.

It preferably comprises a step of semi-curing the undercoat liquid after the step of applying the undercoat liquid and before the step of carrying out image formation, and it more preferably further comprises, after discharging an ink composition of at least one color, a step of semi-curing the ink composition.

The present invention is explained in detail below.

In the present invention, since the colored liquid comprises an ink composition of at least one color selected from the group consisting of violet, blue, green, orange, and red, the color reproduction is excellent compared with an inkjet recording method employing a conventional ink composition.

The present invention is an inkjet recording method in which an undercoat layer is applied onto a recording medium, this is preferably semi-cured, an ink composition that cures upon exposure to actinic radiation is subsequently discharged onto the undercoat liquid, and the discharged ink composition is cured by actinic radiation.

In the present invention, the colored liquid is a multiple color ink set comprising a plurality of ink compositions (in the present invention, an ink composition is also simply called an ink or an ink liquid). According to a desired image, only one color ink composition might be discharged, but in order to form a full color image, image formation is carried out by discharging multiple color ink compositions in sequence or at the same time.

Although a detailed explanation is given later, 'semi-curing' means curing in part (partially cured; partial curing), and refers to a state in which an undercoat liquid and/or a colored liquid are partially cured but are not completely cured.

An image in the present invention is optical information including characters, figures, tables, and photographs, and may be any one of black-and-white, monocolor, and full color.

In general, in the inkjet recording method, since adjacent ink droplets that are applied so as to have parts overlapping with each other in order to obtain a high image density are in contact with each other on a recording medium before drying, adjacent ink droplets coalesce with each other, thus causing image spreading or nonuniform line width for fine lines and thereby easily impairing the ability to form a sharp image. However, in the inkjet recording method of the present invention, due to the constitution being such that an undercoat layer is applied onto a recording medium, even when ink droplets are applied so as to have parts overlapping with each other on the undercoat liquid, interaction between the undercoat liquid and the ink droplets enables coalescence of these adjacent ink droplets to be suppressed. In particular, it is preferable to semi-cure the undercoat layer after the undercoat layer is applied onto the recording medium and before an ink is applied thereto. This can prevent effectively the occurrence of image spreading, nonuniform line width of fine lines in an image, and uneven color of a colored surface. Therefore, in accordance with the inkjet recording method of the present invention, it is possible to form a sharp line with a uniform width, and carry out recording of an inkjet image having high fired droplet density such as reverse characters with good reproduction of a detailed image such as fine lines.

The inkjet recording method of the present invention is particularly effective when an image is recorded on, for example, a nonpermeable or slowly permeable recording medium having low liquid absorbability as the recording medium.

The adjacent ink droplets referred to here mean liquid droplets fired from an ink discharge orifice using a single color ink so as to have overlapping parts, or liquid droplets fired from ink discharge orifices using inks with different colors so as to have overlapping parts. The adjacent ink droplets may be liquid droplets fired at the same time or may be a preceding liquid droplet and a succeeding liquid droplet, which have a preceding fired droplet and succeeding fired droplet relationship.

In the present invention, as a liquid for forming an image, at least one type of ink and at least one type of undercoat liquid are used. It is preferable that the undercoat liquid has a different composition from that of the ink. It is also preferable that the undercoat liquid is applied to the same region as for an image formed above a recording medium by discharging ink droplets or to a wider region than the image.

Furthermore, with regard to the ink in the present invention, inks of a plurality of colors are used as a multiple color ink set. Moreover, when an image is formed using the multiple color ink set, the constitution is preferably such that, after each color ink is discharged, ink droplets thereof are semi-cured.

In one specific constitution of the inkjet recording method of the present invention, droplets of inks of a plurality of colors fired at a recording medium comprise a polymerizing or crosslinking material for forming the image and have a composition different from that of the undercoat liquid, and there are provided a step of applying in advance the undercoat liquid comprising a polymerizing or crosslinking material onto the recording medium in the same region as the image formed from the ink droplets or a wider region than the image, a step of applying actinic radiation or heat to the undercoat liquid applied onto the recording medium, and a step of firing droplets of the inks of a plurality of colors at a side of the recording medium onto which the undercoat liquid has been applied, after the actinic radiation or heat has been applied and semi-curing has been carried out.

Furthermore, from the viewpoint of obtaining excellent fixation it is preferable that the undercoat liquid is applied in advance as described above and subsequently, at least after all the multiple color ink droplets have been fired, there is provided a step of fixing a recorded image by applying energy. Application of energy enables a curing reaction of the contained polymerizing or crosslinking material by polymerization or crosslinking to be promoted, and a stronger image to be formed more efficiently. For example, in a system comprising a polymerization initiator, the application of activating energy such as actinic radiation or heat allows the generation of an active species due to decomposition of the polymerization initiator to be promoted, and a curing reaction involving polymerization or crosslinking of a polymerizing or crosslinking material due to the active species is promoted by an increase in the active species or an increase in temperature.

The application of energy can be carried out suitably by irradiation with actinic radiation or heating. As the actinic radiation, the same activating light as that used for image fixation, which will be described later, may be used; examples thereof include ultraviolet rays, visible light, $\alpha$ rays, $\gamma$ rays, X rays, and an electron beam, ultraviolet rays and visible light are preferable from the viewpoint of cost and safety, and ultraviolet rays are particularly preferable. Irradiation means will be described later.

Heating may be carried out using non-contact type heating means, and heating means involving passing through a heating furnace such as an oven, heating means involving overall exposure such as UV light, visible light, IR light, etc. are suitable. As a light source suitable for light exposure as the heating means, a metal halide lamp, a xenon lamp, a tungsten lamp, a carbon arc lamp, a mercury lamp, etc. can be cited.

It is preferable to carry out semi-curing of the colored liquid and subsequent complete curing thereof by actinic radiation. That is, the colored liquid is preferably curable by irradiation with actinic radiation.

When energy is applied by irradiation with activating light, although the amount of energy necessary for a curing reaction depends on the type and content of a polymerization initiator, it is generally on the order of at least 100 mJ/cm$^2$ but no greater than 10,000 mJ/cm$^2$ (in the present invention, 'at least 100 mJ/cm$^2$ but no greater than 10,000 mJ/cm$^2$' may be expressed as '100 mJ/cm$^2$ to 10,000 mJ/cm$^2$'or '100 to 10,000 mJ/cm$^2$', the same applies below). Furthermore, when energy is provided by heating, heating is preferably carried out for 0.1 to 1 sec. under conditions that give a surface temperature of the recording medium in the range of 40° C. to 80° C.

Colored Liquid and Undercoat Liquid

The colored liquid and the undercoat liquid used in the inkjet recording method of the present invention are explained in detail below.

The ink composition forming the colored liquid is constituted such that it becomes a composition forming at least an image. The ink composition comprises at least one type of polymerizing or crosslinking material, and further comprises a polymerization initiator, a colorant, and another component. The colored liquid is a multiple color ink set comprising a plurality of ink compositions, and comprises an ink composition of at least one color selected from the group consisting of violet, blue, green, orange, and red. The colored liquid preferably further comprises ink compositions of each color of cyan, magenta, yellow, black, and white. Using an ink composition of at least one color selected from the group consisting of violet, blue, green, orange, and red as the colored liquid enables an image having excellent color reproduction to be formed.

The undercoat liquid is preferably constituted so as to have at least a different composition from that of the ink composition. The undercoat liquid comprises at least one type of polymerizing or crosslinking material and comprises, as necessary, a polymerization initiator, a colorant, and another component.

In the present invention, the ink composition comprises a colorant. Furthermore, it is preferable either that the undercoat liquid used in combination with the ink composition does not comprise a colorant or has a colorant content of less than 1 wt %, or that the undercoat liquid comprises as a colorant a white pigment.

In the present invention, the polymerization initiator is preferably one that initiates a polymerization reaction or a crosslinking reaction by virtue of heat or actinic radiation, and is more preferably one that initiates a polymerization reaction or a crosslinking reaction by virtue of actinic radiation. Due to the ink composition and the undercoat liquid comprising a polymerization initiator, the ink composition and the undercoat liquid applied to the recording medium can preferably be cured by heating or irradiating with actinic radiation.

In the present invention, the ink composition and the undercoat liquid preferably comprise a radically polymerizable composition. The radically polymerizable composition in the present invention means a composition comprising at least one type of radically polymerizable material and at least one type of radical polymerization initiator. The radically polymerizable composition enables a curing reaction to be carried out in a short time.

Each component forming the ink composition and the undercoat liquid is explained in detail below.

Polymerizing or Crosslinking Material

In the present invention a polymerization or crosslinking reaction is caused in the polymerizing or crosslinking material by an initiating species such as a radical generated from a polymerization initiator, which will be described later, etc., and a composition containing these has the function of curing.

As the polymerizing or crosslinking material, a polymerizing or crosslinking material that undergoes a known polymerization or crosslinking reaction such as a radical polymerization reaction or a dimerization reaction may be used. Examples thereof include an addition-polymerizable compound having at least one ethylenically unsaturated double bond, a polymer compound having a maleimide group in a side chain, and a polymer compound having in a side chain a cinnamyl group, a cinnamylidene group, a chalcone group, etc., which have a photodimerizable unsaturated double bond adjacent to an aromatic ring. Among them, an addition-polymerizable compound having at least one ethylenically unsaturated double bond is preferable, and it is particularly preferably selected from compounds having at least one and more preferably two or more terminal ethylenically unsaturated bonds (monofunctional or polyfunctional compound). Specifically, it may appropriately be selected from those widely known in the industrial field related to the present invention, and examples thereof include those having a chemical form such as a monomer, a prepolymer (i.e. a dimer, a trimer, and an oligomer), a mixture thereof, and a copolymer thereof.

With regard to the polymerizing or crosslinking material, one type thereof may be used on its own, or two or more types thereof may be used in combination.

Radically Polymerizable Compound

As the polymerizing or crosslinking material in the present invention, it is particularly preferable to use various types of known radically polymerizable monomers in which a polymerization reaction is caused by an initiating species generated from a radical initiator.

As the radically polymerizable monomer (radically polymerizable compound), an ethylenically unsaturated compound is preferable, and examples thereof include a (meth) acrylate, a (meth)acrylamide, an aromatic vinyl compound, a vinyl ether, and a compound having an internal double bond (maleic acid, etc.). Here, '(meth)acrylate' means both or either of 'acrylate' and 'methacrylate', and '(meth)acrylic' means both or either of 'acrylic' and 'methacrylic'.

As the (meth)acrylate, those below can be cited as examples.

Specific examples of monofunctional (meth)acrylates include hexyl (meth)acrylate, 2-ethylhexyl (meth)acrylate, tert-octyl (meth)acrylate, isoamyl (meth)acrylate, decyl (meth)acrylate, isodecyl (meth)acrylate, stearyl (meth)acrylate, isostearyl (meth)acrylate, cyclohexyl (meth)acrylate, 4-n-butylcyclohexyl (meth)acrylate, bornyl (meth)acrylate, isobornyl (meth)acrylate, benzyl (meth)acrylate, 2-ethylhexyldiglycol (meth)acrylate, butoxyethyl (meth)acrylate, 2-chloroethyl (meth)acrylate, 4-bromobutyl (meth)acrylate, cyanoethyl (meth)acrylate, benzyl (meth)acrylate, butoxymethyl (meth)acrylate, 3-methoxybutyl (meth)acrylate, an alkoxymethyl (meth)acrylate, an alkoxyethyl (meth)acrylate, 2-(2-methoxyethoxy)ethyl (meth)acrylate, 2-(2-butoxyethoxy)ethyl (meth)acrylate, 2,2,2-trifluoroethyl (meth)acrylate, 1H, 1H,2H,2H-perfluorodecyl (meth)acrylate, 4-butylphenyl (meth)acrylate, phenyl (meth)acrylate, 2,4,5-trimethylphenyl (meth)acrylate, 4-chlorophenyl (meth) acrylate, phenoxymethyl (meth)acrylate, phenoxyethyl (meth)acrylate, glycidyl (meth)acrylate, glycidyloxybutyl (meth)acrylate, glycidyloxyethyl (meth)acrylate, glycidyloxypropyl (meth)acrylate, tetrahydrofurfuryl (meth)acrylate, a hydroxyalkyl (meth)acrylate, 2-hydroxyethyl (meth)acrylate, 3-hydroxypropyl (meth)acrylate, 2-hydroxypropyl (meth)acrylate, 2-hydroxybutyl (meth)acrylate, 4-hydroxybutyl (meth)acrylate, dimethylaminoethyl (meth)acrylate, diethylaminoethyl (meth)acrylate, dimethylaminopropyl (meth)acrylate, diethylaminopropyl (meth)acrylate, trimethoxysilylpropyl (meth)acrylate, trimethylsilylpropyl (meth)acrylate, polyethylene oxide monomethyl ether (meth) acrylate, oligoethylene oxide monomethyl ether (meth)acrylate, polyethylene oxide (meth)acrylate, oligoethylene oxide (meth)acrylate, an oligoethylene oxide monoalkyl ether (meth)acrylate, a polyethylene oxide monoalkyl ether (meth) acrylate, dipropylene glycol (meth)acrylate, a polypropylene oxide monoalkyl ether (meth)acrylate, an oligopropylene oxide monoalkyl ether (meth)acrylate, 2-(meth)acryloyloxyethylsuccinic acid, 2-(meth)acryloyloxyhexahydrophthalic acid, 2-(meth)acryloyloxyethyl-2-hydroxypropyl phthalate, butoxydiethylene glycol (meth)acrylate, trifluoroethyl (meth)acrylate, perfluorooctylethyl (meth)acrylate, 2-hydroxy-3-phenoxypropyl (meth)acrylate, EO-modified phenol (meth)acrylate, EO-modified cresol (meth)acrylate, EO-modified nonylphenol (meth)acrylate, PO-modified nonylphenol (meth)acrylate, and EO-modified 2-ethylhexyl (meth)acrylate.

Specific examples of difunctional (meth)acrylates include 1,6-hexanediol di(meth)acrylate, 1,10-decanediol di(meth) acrylate, neopentyl glycol di(meth)acrylate, 2,4-dimethyl-1, 5-pentanediol di(meth)acrylate, ethoxylated cyclohexanemethanol di(meth)acrylate, polyethylene glycol di(meth) acrylate, oligoethylene glycol di(meth)acrylate, ethylene glycol di(meth)acrylate, 2-ethyl-2-butylbutanediol di(meth) acrylate, neopentyl glycol hydroxypivalate di(meth)acrylate, EO-modified bisphenol A di(meth)acrylate, bisphenol F polyethoxydi(meth)acrylate, polypropylene glycol di(meth) acrylate, oligopropylene glycol di(meth)acrylate, 1,4-butanediol di(meth)acrylate, 2-ethyl-2-butylpropanediol di(meth) acrylate, 1,9-nonane di(meth)acrylate, propoxylated ethoxylated bisphenol A di(meth)acrylate, and tricyclodecane di(meth)acrylate.

Specific examples of trifunctional (meth)acrylates include trimethylolpropane tri(meth)acrylate, trimethylolethane tri (meth)acrylate, an alkylene oxide-modified tri(meth)acrylate of trimethylolpropane, pentaerythritol tri(meth)acrylate, dipentaerythritol tri(meth)acrylate, trimethylolpropane tris ((meth)acryloyloxypropyl) ether, an isocyanuric acid alkylene oxide-modified tri(meth)acrylate, propionic acid dipentaerythritol tri(meth)acrylate, tris((meth)acryloyloxyethyl) isocyanurate, hydroxypivalaldehyde-modified dimethylolpropane tri(meth)acrylate, sorbitol tri(meth)acrylate, propoxylated trimethylolpropane tri(meth)acrylate, and ethoxylated glycerol triacrylate.

Specific examples of tetrafunctional (meth)acrylates include pentaerythritol tetra(meth)acrylate, sorbitol tetra (meth)acrylate, ditrimethylolpropane tetra(meth)acrylate, dipentaerythritol propionate tetra(meth)acrylate, and ethoxylated pentaerythritol tetra(meth)acrylate.

Specific examples of pentafunctional (meth)acrylates include sorbitol penta(meth)acrylate and dipentaerythritol penta(meth)acrylate.

Specific examples of hexafunctional (meth)acrylates include dipentaerythritol hexa(meth)acrylate, sorbitol hexa (meth)acrylate, an alkylene oxide-modified hexa(meth)acrylate of phosphazene, and caprolactone-modified dipentaerythritol hexa(meth)acrylate.

Examples of the (meth)acrylamide include (meth)acrylamide, N-methyl (meth)acrylamide, N-ethyl (meth)acrylamide, N-propyl (meth)acrylamide, N-n-butyl (meth)acrylamide, N-t-butyl (meth)acrylamide, N-butoxymethyl (meth) acrylamide, N-isopropyl (meth)acrylamide, N-methylol (meth)acrylamide, N,N-dimethyl (meth)acrylamide, N,N-diethyl (meth)acrylamide, and (meth)acryloylmorpholine.

Specific examples of the aromatic vinyl compound include styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, methyl vinylbenzoate, 3-methylstyrene, 4-methylstyrene, 3-ethylstyrene, 4-ethylstyrene, 3-propylstyrene, 4-propylstyrene, 3-butylstyrene, 4-butylstyrene, 3-hexylstyrene, 4-hexylstyrene, 3-octylstyrene, 4-octylstyrene, 3-(2-ethylhexyl)styrene, 4-(2-ethylhexyl)styrene, allylstyrene, isopropenylstyrene, butenylstyrene, octenylstyrene, 4-t-butoxycarbonylstyrene, 4-methoxystyrene, and 4-t-butoxy styrene.

Specific examples of the vinyl ether include, as monofunctional vinyl ethers, methyl vinyl ether, ethyl vinyl ether, propyl vinyl ether, n-butyl vinyl ether, t-butyl vinyl ether, 2-ethylhexyl vinyl ether, n-nonyl vinyl ether, lauryl vinyl ether, cyclohexyl vinyl ether, cyclohexylmethyl vinyl ether, 4-methylcyclohexylmethyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxy polyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether, and phenoxy polyethylene glycol vinyl ether.

Examples of polyfunctional vinyl ethers include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, a bisphenol A alkylene oxide divinyl ether, and a bisphenol F alkylene oxide divinyl ether; and polyfunctional vinyl ethers such as trimethylolethane trivinyl ether, trimethylolpropane trivinyl ether, ditrimethylolpropane tetravinyl ether, glycerol trivinyl ether, pentaerythritol tetravinyl ether, dipentaerythritol pentavinyl ether, dipentaerythritol hexavinyl ether, an ethylene oxide adduct of trimethylolpropane trivinyl ether, a propylene oxide adduct of trimethylolpropane trivinyl ether, an ethylene oxide adduct of ditrimethylolpropane tetravinyl ether, a propylene oxide adduct of ditrimethylolpropane tetravinyl ether, an ethylene oxide adduct of pentaerythritol tetravinyl ether, a propylene oxide adduct of pentaerythritol tetravinyl ether, an ethylene oxide adduct of dipentaerythritol hexavinyl ether, and a propylene oxide adduct of dipentaerythritol hexavinyl ether.

As the vinyl ether compound, di- or tri-vinyl ether compounds are preferable from the viewpoint of curability, adhesion to a recording medium, surface hardness of an image formed, etc., and divinyl ether compounds are particularly preferable.

In addition to the above-mentioned examples, examples of the radically polymerizable monomer in the present invention include vinyl esters (vinyl acetate, vinyl propionate, vinyl versatate, etc.), allyl esters (allyl acetate, etc.), halogen-containing monomers (vinylidene chloride, vinyl chloride, etc.), vinyl cyanides ((meth)acrylonitrile, etc.), and olefins (ethylene, propylene, etc.).

Among the above-mentioned examples, as the radically polymerizable monomer, (meth)acrylates and (meth)acrylamides are preferable from the viewpoint of curing speed, and tetra- or higher-functional (meth)acrylates are particularly preferable from the viewpoint of curing speed. Furthermore, from the viewpoint of viscosity of the ink composition, it is preferable to use a polyfunctional (meth)acrylate and a monofunctional or difunctional (meth)acrylate or (meth)acrylamide in combination.

Furthermore, the mixing ratio (A):(B) of the monofunctional polymerizable compound (A) and the polyfunctional polymerizable compound (B) is preferably 1:1 to 1:4 as a ratio by weight, more preferably 1:1.5 to 1:3, and yet more preferably 1:2 to 1:2.5.

When it is in the above-mentioned range, an ink composition having appropriate curing speed and viscosity is obtained.

Cationically Polymerizable Compound

In the present invention, as the polymerizing or crosslinking material a cationically polymerizable compound may be used. As the polymerizing or crosslinking material, a radically polymerizable compound or a cationically polymerizable compound may be used, and the two may be used in combination. Furthermore, it is also possible to use a radically polymerizable compound as the polymerizing or crosslinking material for one of the undercoat liquid and the colored liquid, and use a cationically polymerizable compound for the other.

The cationically polymerizable compound in the present invention is not particularly limited as long as it is a compound that undergoes a cationic polymerization reaction by the application of some type of energy and cures; any type of monomer, oligomer, or polymer may be used and, in particular, various types of known cationically polymerizable monomers, known as cationically photopolymerizable monomers, that undergo a polymerization reaction by an initiating species generated from a cationic polymerization initiator, which will be described later, may be used. Moreover, the cationically polymerizable compound may be a monofunctional compound or a polyfunctional compound.

As the cationically polymerizable compound in the present invention, from the viewpoint of curability and abrasion resistance, an oxetane-ring containing compound and an oxirane ring-containing compound are preferable, and a configuration in which both of an oxetane-ring containing compound and an oxirane ring-containing compound are contained is more preferable.

In the present invention, the oxirane ring-containing compound (hereinafter, also called an 'oxirane compound' as appropriate) is a compound containing at least one oxirane ring (oxiranyl group, epoxy group) per molecule; it may be appropriately selected from those normally used as epoxy resins, and specific examples thereof include conventionally known aromatic epoxy resins, alicyclic epoxy resins, and aliphatic epoxy resins. It may be any one of a monomer, an oligomer, and a polymer. Furthermore, the oxetane-ring containing compound (hereinafter, also called an 'oxetane compound' as appropriate) is a compound containing at least one oxetane ring (oxetanyl group) per molecule.

The cationically polymerizable compound used in the present invention is now explained in detail.

Examples of the cationically polymerizable monomer include epoxy compounds, vinyl ether compounds, oxetane compounds described in JP-A-6-9714, JP-A-2001-31892, JP-A-2001-40068, JP-A-2001-55507, JP-A-2001-310938, JP-A-2001-310937, JP-A-2001-220526, etc.

Examples of monofunctional epoxy compounds used in the present invention include phenyl glycidyl ether, p-tert-butylphenyl glycidyl ether, butyl glycidyl ether, 2-ethylhexyl glycidyl ether, allyl glycidyl ether, 1,2-butylene oxide, 1,3-butadiene monooxide, 1,2-epoxydodecane, epichlorohydrin, 1,2-epoxydecane, styrene oxide, cyclohexene oxide, 3-methacryloyloxymethylcyclohexene oxide, 3-acryloyloxymethylcyclohexene oxide, and 3-vinylcyclohexene oxide.

Furthermore, examples of polyfunctional epoxy compounds include bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolac resins, hydrogenated bisphenol A diglycidyl ether, hydrogenated bisphenol F diglycidyl ether, hydrogenated bisphenol S diglycidyl ether, 3,4-epoxycyclohexenylmethyl-3',4'-epoxycyclohexenecarboxylate, 2-(3,4-epoxycyclohexyl)-7,8-epoxy-1,3-dioxaspiro[5.5]undecane, bis(3,4-epoxycyclohexylmethyl) adipate, vinylcyclohexene dioxide, 4-vinylepoxycyclohexane, bis(3,4-epoxy-6-methylcyclohexylmethyl) adipate, 3,4-epoxy-6-methylcyclohexenyl 3',4'-epoxy-6'-methylcyclohexenecarboxylate, methylenebis (3,4-epoxycyclohexane), dicyclopentadiene diepoxide, the di(3,4-epoxycyclohexylmethyl)ether of ethylene glycol, ethylene bis(3,4-epoxycyclohexanecarboxylate), dioctyl epoxyhexahydrophthalate, di-2-ethylhexyl epoxyhexahydrophthalate, 1,4-butanediol diglycidyl ether, 1,6-hexanediol diglycidyl ether, glycerol triglycidyl ether, trimethylolpropane triglycidyl ether, polyethylene glycol diglycidyl ether, polypropylene glycol diglycidyl ether, 1,13-tetradecadiene dioxide, limonene dioxide, 1,2,7,8-diepoxyoctane, and 1,2,5,6-diepoxycyclooctane.

Among these epoxy compounds, the aromatic epoxides and the alicyclic epoxides are preferable from the viewpoint of excellent curing speed, and the alicyclic epoxides are particularly preferable.

Specific examples of monofunctional vinyl ethers used in the present invention include methyl vinyl ether, ethyl vinyl ether, propyl vinyl ether, n-butyl vinyl ether, t-butyl vinyl ether, 2-ethylhexyl vinyl ether, n-nonyl vinyl ether, lauryl vinyl ether, cyclohexyl vinyl ether, cyclohexylmethyl vinyl ether, 4-methylcyclohexylmethyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether, and phenoxypolyethylene glycol vinyl ether.

Furthermore, examples of polyfunctional vinyl ethers include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether, and bisphenol F alkylene oxide divinyl ether; and polyfunctional vinyl ethers such as trimethylolethane trivinyl ether, trimethylolpropane trivinyl ether, ditrimethylolpropane tetravinyl ether, glycerol trivinyl ether, pentaerythritol tetravinyl ether, dipentaerythritol pentavinyl ether, dipentaerythritol hexavinyl ether, an ethylene oxide adduct of trimethylolpropane trivinyl ether, a propylene oxide adduct of trimethylolpropane trivinyl ether, an ethylene oxide adduct of ditrimethylolpropane tetravinyl ether, a propylene oxide adduct of ditrimethylolpropane tetravinyl ether, an ethylene oxide adduct of pentaerythritol tetravinyl ether, a propylene oxide adduct of pentaerythritol tetravinyl ether, an ethylene oxide adduct of dipentaerythritol hexavinyl ether, and a propylene oxide adduct of dipentaerythritol hexavinyl ether.

As the vinyl ether compound, the di- or tri-vinyl ether compounds are preferable from the viewpoint of curability, adhesion to a recording medium, surface hardness of the image formed, etc., and the divinyl ether compounds are particularly preferable.

The oxetane compound in the present invention may be selected freely from known oxetane compounds such as those described in JP-A-2001-220526, JP-A-2001-310937, and JP-A-2003-341217.

The oxetane compound that can be used in the present invention is preferably a compound having 1 to 4 oxetane rings in its structure. Use of such a compound enables the viscosity of the colored liquid and the undercoat liquid to be maintained in a range that gives ease of handling and enables high adhesion of the colored liquid and/or undercoat liquid to a recording medium after curing to be obtained.

Examples of monofunctional oxetane compounds used in the present invention include 3-ethyl-3-hydroxymethyloxetane, 3-allyloxymethyl-3-ethyloxetane, (3-ethyl-3-oxetanylmethoxy)methylbenzene, 4-fluoro-[1-(3-ethyl-3-oxetanylmethoxy)methyl]benzene, 4-methoxy-[1-(3-ethyl-3-oxetanylmethoxy)methyl]benzene, [1-(3-ethyl-3-oxetanylmethoxy)ethyl]phenyl ether, isobutoxymethyl (3-ethyl-3-oxetanylmethyl)ether, isobornyloxyethyl (3-ethyl-3-oxetanylmethyl)ether, isobornyl (3-ethyl-3-oxetanylmethyl)ether, 2-ethylhexyl (3-ethyl-3-oxetanylmethyl) ether, ethyl diethylene glycol (3-ethyl-3-oxetanylmethyl) ether, dicyclopentadiene (3-ethyl-3-oxetanylmethyl)ether, dicyclopentenyloxyethyl (3-ethyl-3-oxetanylmethyl)ether, dicyclopentenyl (3-ethyl-3-oxetanylmethyl)ether, tetrahydrofurfuryl (3-ethyl-3-oxetanylmethyl)ether, tetrabromophenyl (3-ethyl-3-oxetanylmethyl)ether, 2-tetrabromophenoxyethyl (3-ethyl-3-oxetanylmethyl)ether, tribromophenyl (3-ethyl-3-oxetanylmethyl)ether, 2-tribromophenoxyethyl (3-ethyl-3-oxetanylmethyl)ether, 2-hydroxyethyl (3-ethyl-3-oxetanylmethyl)ether, 2-hydroxypropyl (3-ethyl-3-oxetanylmethyl)ether, butoxyethyl (3-ethyl-3-oxetanylmethyl)ether, pentachlorophenyl (3-ethyl-3-oxetanylmethyl)ether, pentabromophenyl (3-ethyl-3-oxetanylmethyl)ether, and bornyl (3-ethyl-3-oxetanylmethyl)ether.

Examples of polyfunctional oxetane compounds include 3,7-bis(3-oxetanyl)-5-oxanonane, 3,3'-(1,3-(2-methylenyl) propanediylbis(oxymethylene))bis-(3-ethyloxetane), 1,4-bis[(3-ethyl-3-oxetanylmethoxy)methyl]benzene, 1,2-bis[(3-ethyl-3-oxetanylmethoxy)methyl]ethane, 1,3-bis[(3-ethyl-3-oxetanylmethoxy)methyl]propane, ethylene glycol bis(3-ethyl-3-oxetanylmethyl)ether, dicyclopentenylbis(3-ethyl-3-oxetanylmethyl)ether, triethylene glycol bis(3-ethyl-3-oxetanylmethyl)ether, tetraethylene glycol bis(3-ethyl-3-oxetanylmethyl)ether, tricyclodecanediyldimethylene (3-ethyl-3-oxetanylmethyl)ether, trimethylolpropane tris(3-ethyl-3-oxetanylmethyl)ether, 1,4-bis(3-ethyl-3-oxetanylmethoxy)butane, 1,6-bis(3-ethyl-3-oxetanylmethoxy)hexane, pentaerythritol tris(3-ethyl-3-oxetanylmethyl) ether, pentaerythritol tetrakis(3-ethyl-3-oxetanylmethyl)ether, polyethylene glycol bis(3-ethyl-3-oxetanylmethyl)ether, dipentaerythritol hexakis(3-ethyl-3-oxetanylmethyl)ether, dipentaerythritol pentakis(3-ethyl-3-oxetanylmethyl)ether, dipentaerythritol tetrakis(3-ethyl-3-oxetanylmethyl)ether, caprolactone-modified dipentaerythritol hexakis(3-ethyl-3-oxetanylmethyl)ether, caprolactone-modified dipentaerythritol pentakis(3-ethyl-3-oxetanylmethyl)ether, ditrimethylolpropane tetrakis(3-ethyl-3-oxetanylmethyl)ether, ethylene oxide (EO)-modified bisphenol A bis(3-ethyl-3-oxetanylmethyl)ether, propylene oxide (PO)-modified bisphenol A bis (3-ethyl-3-oxetanylmethyl)ether, EO-modified hydrogenated bisphenol A bis(3-ethyl-3-oxetanylmethyl)ether, PO-modified hydrogenated bisphenol A bis(3-ethyl-3-oxetanylmethyl)ether, and EO-modified bisphenol F (3-ethyl-3-oxetanylmethyl)ether.

Such oxetane compounds are described in detail in Paragraph Nos. 0021 to 0084 of JP-A-2003-341217, and compounds described therein can be used suitably in the present invention.

Among the oxetane compounds used in the present invention, from the viewpoint of viscosity and tackiness of the colored liquid and the undercoat liquid, it is preferable to use a compound having 1 to 2 oxetane rings.

In the present invention, with regard to these cationically polymerizable compounds, one type may be used on its own, or two or more types may be used in combination.

The content of the cationically polymerizable compound, relative to the total solids content of the colored liquid and/or undercoat liquid containing the cationically polymerizable compound, is preferably 50 to 95 wt %, more preferably 60 to 92 wt %, and yet more preferably 70 to 90 wt %.

In the ink composition and the undercoat liquid used in the present invention, the content of the polymerizable compound, relative to the total solids content (weight) of each liquid droplet, is preferably in the range of 50 to 99.6 wt %, more preferably in the range of 60 to 99.0 wt %, and yet more preferably in the range of 70 to 99.0 wt %.

Polymerization Initiator

The ink and the undercoat liquid may be constituted suitably using at least one type of polymerization initiator, and it is preferable for at least the undercoat liquid to be constituted using a polymerization initiator. This polymerization initiator is a compound that generates an initiating species such as a radical by the application of either activating light or heat as energy, or both thereof, initiates and promotes a polymerization or crosslinking reaction of the polymerizing or crosslinking material described above, and cures it.

With regard to the mode of polymerizability, when a radically polymerizable compound is used, it is preferable for a polymerization initiator that causes radical polymerization (radical polymerization initiator) to be contained, and when a cationically polymerizable compound is used, it is preferable to use a polymerization initiator that causes cationic polymerization (cationic polymerization initiator), and it is particularly preferable for them to be photopolymerization initiators.

The photopolymerization initiator is a compound that undergoes chemical change due to the action of light or interaction with an electronically excited state of a sensitizing dye and generates at least one of a radical, an acid, and a base, and it is particularly preferably a photo-radical generator from the viewpoint of polymerization being initiated by the simple means of exposure.

The cationic polymerization initiator or the radical polymerization initiator in the present invention is a compound that undergoes chemical change due to the action of light or interaction with an electronically excited state of a sensitizing dye and generates a radical, an acid, or a base, and it is particularly preferably the photo-radical generator or a photo-acid generator from the viewpoint of polymerization being initiated by the simple means of exposure.

In the present invention, a cationic polymerization initiator or a radical polymerization initiator may be used by appropriate selection from polymerization initiators described in detail below while taking into consideration the relationship with a cationically polymerizable compound or radically polymerizable compound that is used in combination.

As the photopolymerization initiator, one having sensitivity to actinic radiation applied such as, for example, ultraviolet rays at 400 to 200 nm, far ultraviolet rays, g-line, h-line, i-line, KrF excimer laser light, ArF excimer laser light, an electron beam, X rays, a molecular beam, or an ion beam, may be used by appropriate selection.

A photopolymerization initiator known to a person skilled in the art may be used without limitation, and many specific examples thereof are described in Bruce M. Monroe et al., Chemical Reviews, 93, 435 (1993), R. S. Davidson, Journal of Photochemistry and Biology A: Chemistry, 73, 81 (1993), J. P. Faussier "Photoinitiated Polymerization-Theory and Applications": Rapra Review, Vol. 9, Report, Rapra Technology (1998), and M. Tsunooka et al., Prog. Polym. Sci., 21, 1 (1996). Furthermore, many compounds utilized in chemically amplified photoresists and cationic photopolymerization, etc. are described in 'Imejingu yo Yukizairyou' (Organic Materials for Imaging) Ed. Japanese Research Association for Organic Electronics Materials, Bunshin Publishing Co. (1993), pp. 187-192. Moreover, a group of compounds are known, as described in F. D. Saeva, Topics in Current Chemistry, 156, 59 (1990), G. G. Maslak, Topics in Current Chemistry, 168, 1 (1993), H. B. Shuster et al., JACS, 112, 6329 (1990), I. D. F. Eaton et al., JACS, 102, 3298 (1980), etc., that cause oxidative or reductive bond cleavage via interaction with an electronic excited state of a sensitizing dye.

Examples of the preferable photopolymerization initiator include (a) an aromatic ketone, (b) an aromatic onium salt compound, (c) an organic peroxide, (d) a hexaarylbiimidazole compound, (e) a ketoxime ester compound, (f) a borate compound, (g) an azinium compound, (h) a metallocene compound, (i) an active ester compound, and (j) a compound having a carbon-halogen bond.

Preferred examples of the aromatic ketone (a) include a compound having a benzophenone skeleton (benzophenone compound) or a compound having a thioxanthone skeleton (thioxanthone compound) described in 'RADIATION CURING IN POLYMER SCIENCE AND TECHNOLOGY' J. P. FOUASSIER and J. F. RABEK (1993), pp. 77 to 117. Preferred examples of the aromatic ketone (a), include an α-thiobenzophenone compound described in JP-B-47-6416 (JP-B denotes a Japanese examined patent application publication), a benzoin ether compound described in JP-B-47-3981, an α-substituted benzoin compound described in JP-B-47-22326, a benzoin derivative described in JP-B-47-23664, an aroylphosphonic acid ester described in JP-A-57-30704, a dialkoxybenzophenone described in JP-B-60-26483, benzoin ethers described in JP-B-60-26403 and JP-A-62-81345, α-aminobenzophenones described in JP-B-1-34242, U.S. Pat. No. 4,318,791, and EP No. 0284561A1, p-di(dimethylaminobenzoyl)benzene described in JP-A-2-211452, a thio-substituted aromatic ketone described in JP-A-61-194062, an acylphosphine sulfide described in JP-B-2-9597, an acylphosphine described in JP-B-2-9596, a thioxanthone described in JP-B-63-61950, and a coumarin described in JP-B-59-42864.

As the aromatic onium salt compound (b), there can be cited aromatic onium salts of elements of Groups 15, 16, and 17 (Groups V B, VI B and VII B) of the periodic table, specifically, N, P, As, Sb, Bi, O, S, Se, Te, and 1. Examples thereof include iodonium salts described in EP No. 104143, U.S. Pat. No. 4,837,124, JP-A-2-150848, and JP-A-2-96514, diazonium salts (optionally substituted benzenediazoniums, etc.) described in EP Nos. 370693, 233567, 297443, 297442, 279210, and 422570, U.S. Pat. Nos. 3,902,144, 4,933,377, 4,760,013, 4,734,444, and 2,833,827, diazonium salt resins (diazodiphenylamine formaldehyde resins, etc.), N-alkoxypyridinium salts, etc. (e.g. those described in U.S. Pat. No. 4,743,528, JP-A-63-138345, JP-A-63-142345, JP-A-63-142346, and JP-B-46-42363; specific examples thereof include 1-methoxy-4-phenylpyridinium tetrafluoroborate); furthermore, compounds described in JP-B-52-147277, 52-14278, and 52-14279 may suitably be used. A radical or an acid is formed as an active species.

As the organic peroxide (c), almost all organic compounds having at least one oxygen-oxygen bond per molecule can be cited, and preferred examples thereof include peroxide ester compounds such as 3,3',4,4'-tetra(t-butylperoxycarbonyl)benzophenone, 3,3',4,4'-tetra(t-amylperoxycarbonyl)benzophenone, 3,3',4,4'-tetra(t-hexylperoxycarbonyl)benzophenone, 3,3',4,4'-tetra(t-octylperoxycarbonyl)benzophenone, 3,3',4,4'-tetra(cumylperoxycarbonyl)benzophenone, 3,3',4,4'-tetra(p-isopropylcumylperoxycarbonyl)benzophenone, and di-t-butyldiperoxyisophthalate.

As the hexaarylbiimidazole compound (d), there can be cited lophine dimers described in JP-B-45-37377 and JP-B-44-86516, and examples thereof include 2,2'-bis(o-chlorophenyl)-4,4',5,5'-tetraphenylbiimidazole, 2,2'-bis(o-bromophenyl)-4,4',5,5'-tetraphenylbiimidazole, 2,2'-bis(o,p-dichlorophenyl)-4,4',5,5'-tetraphenylbiimidazole, 2,2'-bis(o-chlorophenyl)-4,4',5,5'-tetra(m-methoxyphenyl) biimidazole, 2,2'-bis(o,o'-dichlorophenyl)-4,4',5,5'-tetraphenylbiimidazole, 2,2'-bis(o-nitrophenyl)-4,4',5,5'-tetraphenylbiimidazole, 2,2'-bis(o-methylphenyl)-4,4',5,5'-tetraphenylbiimidazole, and 2,2'-bis(o-trifluorophenyl)-4,4',5,5'-tetraphenylbiimidazole.

As the ketoxime ester compound (e), there can be cited 3-benzoyloxyiminobutan-2-one, 3-acetoxyiminobutan-2-one, 3-propionyloxyiminobutan-2-one, 2-acetoxyiminopentan-3-one, 2-acetoxyimino-1-phenylpropan-1-one, 2-benzoyloxyimino-1-phenylpropan-1-one, 3-p-toluenesulfonyloxyiminobutan-2-one, and 2-ethoxycarbonyloxyimino-1-phenylpropan-1-one.

Examples of the borate compound (f) include compounds described in U.S. Pat. Nos. 3,567,453 and 4,343,891, and EP Nos. 109,772 and 109,773.

Examples of the azinium salt compound (g) include N—O bond-containing compounds described in JP-A-63-138345, JP-A-63-142345, JP-A-63-142346, JP-A-63-143537, and JP-B-46-42363.

Examples of the metallocene compound (h) include titanocene compounds described in JP-A-59-152396, JP-A-61-151197, JP-A-63-41484, JP-A-2-249, and JP-A-2-4705, and iron-arene complexes described in JP-A-1-304453 and JP-A-1-152109.

Specific examples of the titanocene compound include dichlorobis(cyclopentadienyl)titanium, bis(cyclopentadienyl)bis(phenyl)titanium, bis(cyclopentadienyl)bis(2,3,4,5,6-pentafluorophen-1-yl)titanium, bis(cyclopentadienyl)bis(2,3,5,6-tetrafluorophen-1-yl)titanium, bis(cyclopentadienyl)bis(2,4,6-trifluorophen-1-yl)titanium, bis(cyclopentadienyl)bis(2,6-difluorophen-1-yl)titanium, bis(cyclopentadienyl)bis(2,4-difluorophen-1-yl)titanium, bis(methylcyclopentadienyl)bis(2,3,4,5,6-pentafluorophen-1-yl)titanium, bis(methylcyclopentadienyl)bis(2,3,5,6-tetrafluorophen-1-yl)titanium, bis(methylcyclopentadienyl)bis(2,4-difluorophen-1-yl)titanium, bis(cyclopentadienyl)bis[2,6-difluoro-3-(pyrr-1-yl)phenyl]titanium, bis(cyclopentadienyl)bis[2,6-difluoro-3-(methylsulfonamido)phenyl]titanium, and bis(cyclopentadienyl)bis[2,6-difluoro-3-(N-butylbiaroylamino)phenyl]titanium.

Examples of the active ester compound (i) include nitrobenzyl ester compounds described in EP Nos. 0290750, 046083, 156153, 271851, and 0388343, U.S. Pat. Nos. 3,901,710 and 4,181,531, JP-A-60-198538, and JP-A-53-133022, iminosulfonate compounds described in EP Nos. 0199672, 84515, 199672, 044115, and 0101122, U.S. Pat. Nos. 4,618,564, 4,371,605, and 4,431,774, JP-A-64-18143, JP-A-2-245756, and JP-A-4-365048, and compounds described in JP-B-62-6223, JP-B-63-14340, and JP-A-59-174831.

Preferred examples of the compound (j) having a carbon-halogen bond include a compound described in Wakabayashi et. al, Bull. Chem. Soc. Japan, 42, 2924 (1969), a compound described in British Patent No. 1388492, a compound described in JP-A-53-133428, and a compound described in German Patent No. 3337024.

Examples further include a compound described in F. C. Schaefer et al., J. Org. Chem., 29, 1527 (1964), a compound described in JP-A-62-58241, a compound described in JP-A-5-281728, a compound described in German Pat. No. 2641100, a compound described in German Pat. No. 3333450, compounds described in German Pat. No. 3021590, and compounds described in German Pat. No. 3021599.

Specific examples of the compounds represented by (a) to (j) above are listed below. In the specific examples below, Ph denotes a phenyl group, and Ar denotes any aryl group.

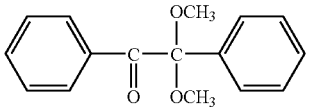

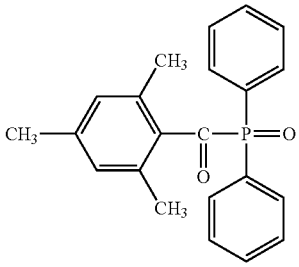

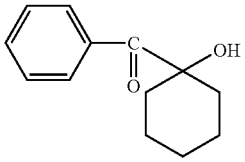

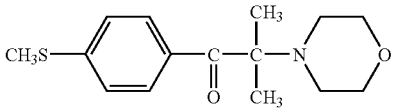

-continued

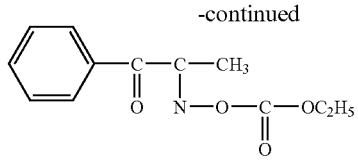

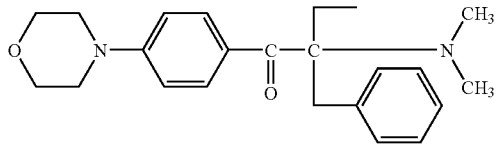

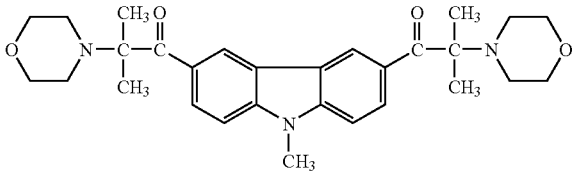

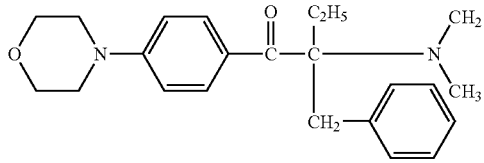

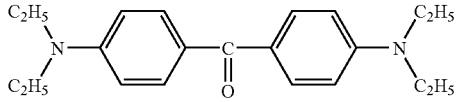

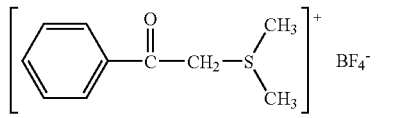

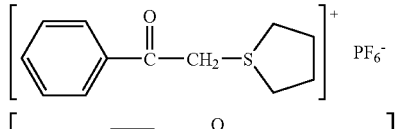

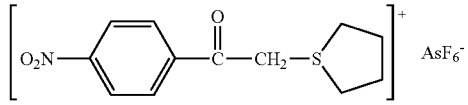

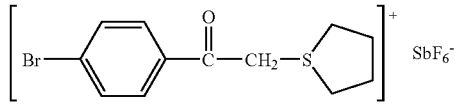

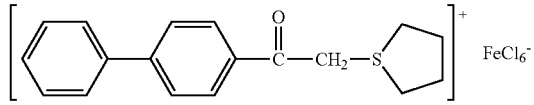

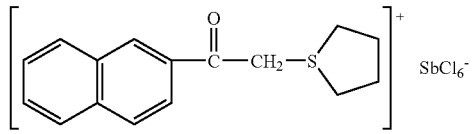

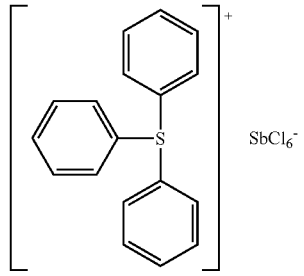

-continued
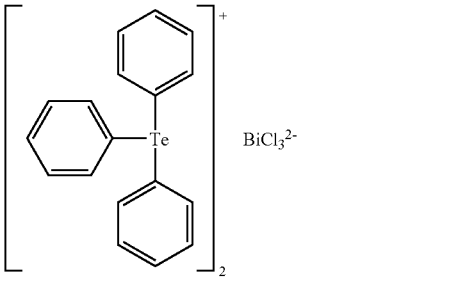
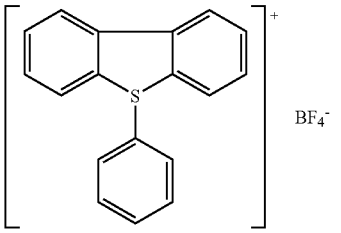
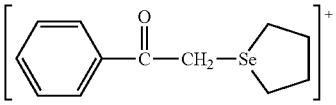
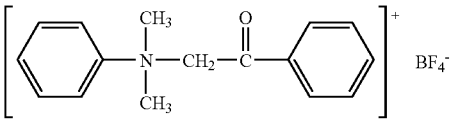
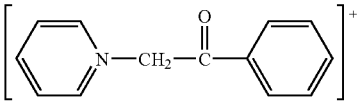
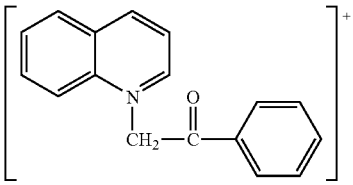
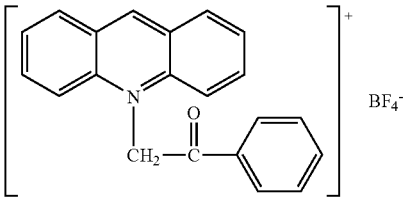
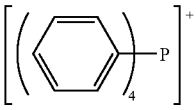
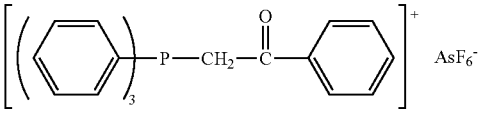
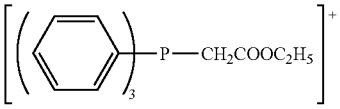
-continued
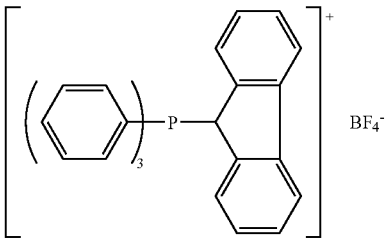
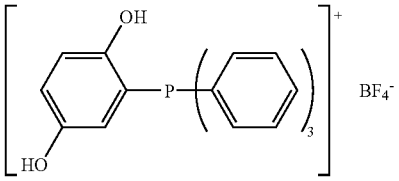
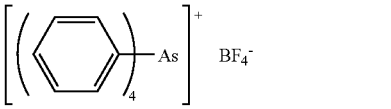
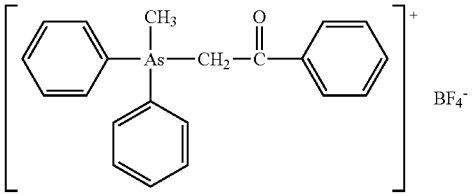
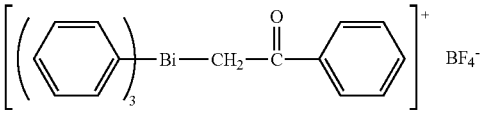
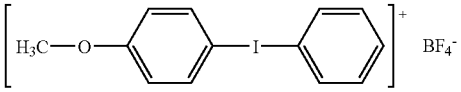
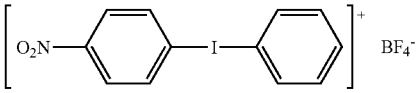
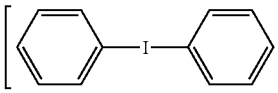
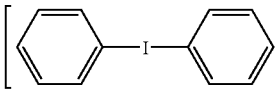
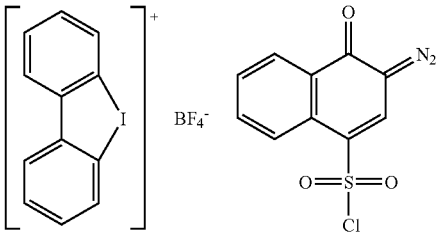

-continued
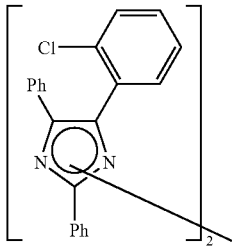
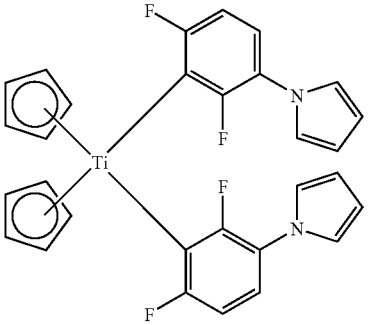
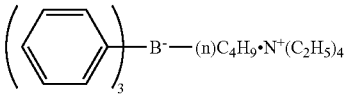
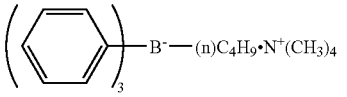
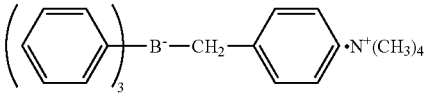
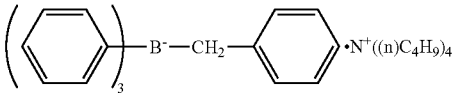
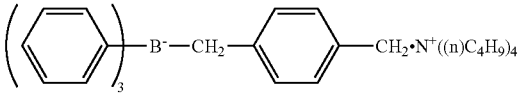
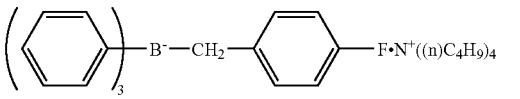
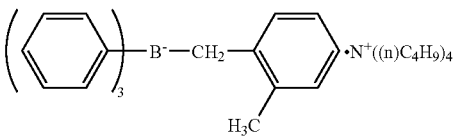
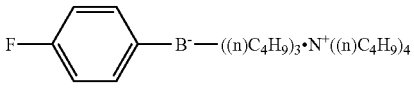
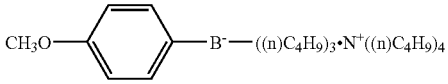
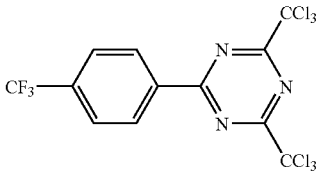
-continued
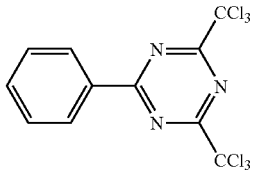
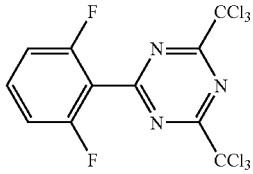
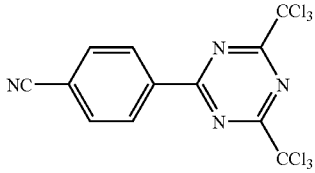
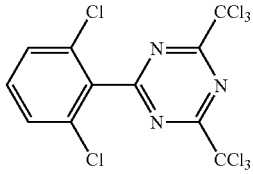
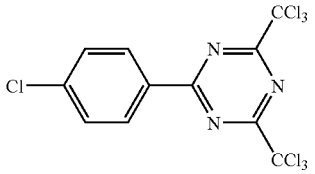
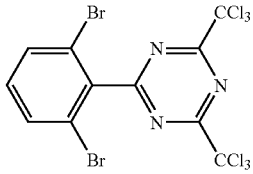
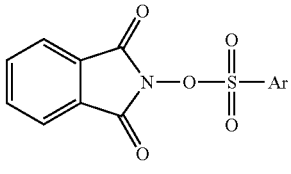
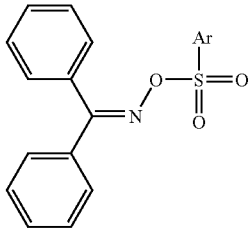
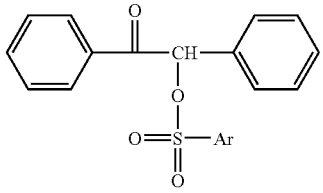
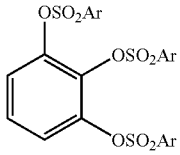

-continued

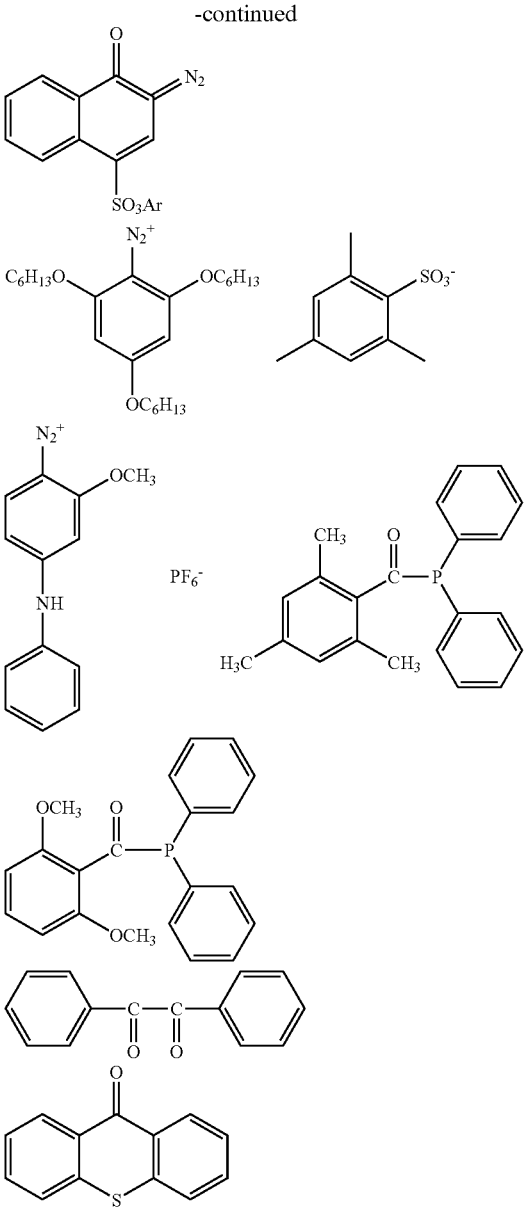

As the radical polymerization initiator in the present invention, from the viewpoint of curability, an aromatic ketone is preferable among those described above, a compound having a benzophenone skeleton or a thioxanthone skeleton is more preferable, and an α-aminobenzophenone compound and an acylphosphine sulfide compound are particularly preferable.

As the cationic polymerization initiator in the present invention, from the viewpoint of curability, an aromatic onium salt is preferable among those described above, an iodonium salt and a sulfonium salt are more preferable, and an iodonium $PF_6$ salt and a sulfonium $PF_6$ salt are particularly preferable.

With regard to the cationic polymerization initiator and the radical polymerization initiator, one type thereof may be used on its own or two or more types may be used in combination. They may be used in a combination with a known sensitizer for the purpose of improving sensitivity as long as the effects of the present invention are not impaired.

The content of the cationic polymerization initiator and the radical polymerization initiator, relative to the total solids content of the colored liquid and/or undercoat liquid containing the polymerization initiator, is preferably 0.1 to 20 wt %, more preferably 0.5 to 10 wt %, and yet more preferably 1 to 7 wt %.

Furthermore, with regard to the content ratio (ratio by weight) of the cationic polymerization initiator or the radical polymerization initiator to the polymerizable compound used in combination therewith, it is preferable that cationic polymerization initiator:cationically polymerizable compound or radical polymerization initiator:radically polymerizable compound=0.5:100 to 30:100, more preferably 1:100 to 15:100, and yet more preferably 2:100 to 10:100.

The polymerization initiator may be contained in the undercoat liquid as well as in the ink, and in this case it is preferable that the polymerization initiator is appropriately selected to be in a range that enables ink storage stability to be maintained at a desired level.

Colorant

In the present invention, the colored liquid is a multiple color ink set comprising a plurality of ink compositions, and the colored liquid comprises an ink composition of at least one color selected from the group consisting of violet, blue, green, orange, and red. The colored liquid preferably comprises an ink composition of at least one color selected from the group consisting of violet, blue, green, orange, and red and at least one ink composition selected from the group consisting of a cyan color ink composition (cyan ink composition), a magenta color ink composition (magenta ink composition), a yellow color ink composition (yellow ink composition), a black color ink composition (black ink composition), and a white color ink composition (white ink composition).

Furthermore, the colorant preferably comprises at least one ink composition selected from the group consisting of violet, green, and orange, and preferably comprises violet, green, and orange ink compositions (violet ink composition, green ink composition, and orange ink composition respectively).

Moreover, the colored liquid preferably comprises a cyan ink composition, a magenta ink composition, a yellow ink composition, a black ink composition, and a white ink composition, and is particularly preferably a multiple color ink set comprising ink compositions of eight colors, that is, a violet ink composition, a green ink composition, an orange ink composition, a cyan ink composition, a magenta ink composition, a yellow ink composition, a black ink composition, and a white ink composition.

Therefore, in the present invention, the ink composition preferably comprises at least one type of colorant. Each color ink composition comprises at least one type of colorant exhibiting the corresponding color.

Furthermore, other than the ink composition, the undercoat liquid may comprise a colorant. For the undercoat liquid, a white colorant may suitably be used.

The colorant that can be used in the present invention is not particularly limited, and it may be appropriately selected from known water-soluble dyes, oil-soluble dyes, and pigments, and used. In particular, from the viewpoint of the effects of the present invention, the ink composition and the undercoat liquid used in the present invention are preferably water-insoluble organic solvent-based, and an oil-soluble dye and a pigment, which are easily dispersed and dissolved uniformly in a water-insoluble medium, are preferable.

The content of the colorant in the ink composition used in the present invention is preferably 1 to 30 wt % of the ink composition, more preferably 1.5 to 25 wt %, and particularly preferably 2 to 15 wt %.

Furthermore, when the undercoat liquid used in the present invention contains a colorant such as a white pigment, the content thereof in the undercoat liquid is 2 to 45 wt %, and preferably 4 to 35 wt %.

Pigments suitable for the ink composition and the undercoat liquid used in the present invention are explained in detail below.

Pigment

In the present invention, a mode in which a pigment is used as a colorant is preferable. As the pigment, either an organic pigment or an inorganic pigment may be used, and as a black pigment a carbon black pigment, etc. is preferable. Furthermore, in general, pigments with a black color and three primary colors, that is, cyan, magenta, and yellow, are used, but in the present invention it is preferable for a pigment of at least one color selected from the group consisting of violet, blue, green, orange, and red to be contained. As described above, it is preferable to use an ink composition comprising a pigment selected from the group consisting of violet, green, and orange, and it is preferable to use an ink composition comprising a violet pigment, an ink composition comprising a green pigment, and an ink composition comprising an orange pigment. This is preferable since the use of ink compositions comprising pigments exhibiting such colors enables an image having excellent color reproduction to be formed.

Furthermore, a pigment with another color hue such as a metallic luster pigment such as gold or silver, or a colorless or light-colored extender pigment, etc. may be used according to an intended application.

In the present invention, as a colorant contained in the ink composition, at least a colorant exhibiting any color selected from the group consisting of violet, blue, green, orange, and red is used. The colorant is preferably an organic pigment.

A colorant exhibiting a violet color is defined as a colorant for which the hue (a*, b*) of a film obtained by coating a dispersion of the colorant is in the range '$b^*>-2a^*-20$ and $b^*<0.5a^*+10$ ($a^*>0$, $b^*<0$)'. Similarly, a colorant exhibiting a blue color is defined as a colorant for which the hue (a*, b*) of a film obtained by coating a dispersion of the colorant is in the range '$b^*>-a^*-20$ and $b^*<30a^*-30$ ($a^*>0$, $b^*<0$)', a colorant exhibiting a green color is defined as a colorant for which the hue (a*, b*) of a film obtained by coating a dispersion of the colorant is in the range '$b^*<-a^*+20$ and $b^*>-0.25a^*$ ($a^*<0$)', a colorant exhibiting an orange color is defined as a colorant for which the hue (a*, b*) of a film obtained by coating a dispersion of the colorant is in the range '$b^*<2a^*+20$ and $b^*>a^*-20$ ($a^*>0$, $b^*>0$)', and a colorant exhibiting a red color is defined as a colorant for which the hue (a*, b*) of a film obtained by coating a dispersion of the colorant is in the range '$b^*<a^*$ and $b^*>0.1a^*$ ($a^*<0$)'.

Measurement of hue (a*, b*) may be carried out using an SPM100-II manufactured by Gretag.

The concentration of a pigment in a dispersion used here for evaluation of the hue is preferably at least 1 wt % but no greater than 30 wt %. The particle size (volume-average particle size) of the pigment in the dispersion is not particularly limited, but from the viewpoint of suppressing the influence of optical scattering it is preferably no greater than 1 μm, more preferably no greater than 500 nm, and particularly preferably no greater than 200 nm. A dispersion medium is not particularly limited as long as there is little coloration or no coloration, and water, a general-purpose solvent, a commercial monomer, etc. are preferable. A step of preparing a dispersion is not particularly limited, and a known technique may be used. Since it is relatively simple, ball mill dispersion, bead mill dispersion, ultrasonic dispersion, etc. are preferable. Furthermore, it is preferable to use as appropriate a commercial surfactant or a pigment-dispersing agent during dispersion.

As a substrate coated with a dispersion, a white substrate is preferable. It is not particularly limited as long as it is a white substrate and, for example, a commercial white coated paper, a white synthetic paper, etc. are preferable. Means for applying a dispersion is not particularly limited and, for example, a bar coater is simple and may preferably be used.

Specifically, in the present invention, the hue of a colorant may be measured as follows. 10 parts by weight of colorant (preferably an organic pigment) is dispersed in 100 parts by weight of MEK (methyl ethyl ketone) using a DYNO-MILL (Shinmaru Enterprises Corp.) for 120 minutes. A colorant dispersion thus obtained is applied onto white Yupo 80 paper (Lintec Corp.) at 6 mL/$m^2$ using a K4 bar.

After coating, it is dried by a hot plate to thus form a film of the colorant on the substrate, and the hue thereof is measured using an SPM100-III.

In the present invention, a pigment exhibiting a violet color, a pigment exhibiting a green color, and a pigment exhibiting an orange color are preferably used.

From the viewpoint of wide color reproduction being obtained, it is more preferable that the hue (a*, b*) of a film obtained by applying a dispersion of a pigment exhibiting an orange color is in the range of '$b^*<2a^*$ and $b^*>a^*$ ($a^*>0$, $b^*>0$)'. Similarly, from the viewpoint of wide color reproduction being obtained, it is more preferable that the hue (a*, b*) of a film obtained by applying a dispersion of a pigment exhibiting a violet color is in the range of '$b^*>-2a^*$ and $b^*<0.5a^*$ ($a^*>0$, $b^*<0$)', and it is further preferable that the hue (a*, b*) of a film obtained by applying a dispersion of a pigment exhibiting a green color is in the range of '$b^*<-a^*$ ($a^*<0$, $b^*>0$)'.

Organic pigments exhibiting any of the colors of violet, blue, green, orange, and red are not particularly limited as long as the above-mentioned hue is satisfied, and they may be selected appropriately from commercial products.

As pigments exhibiting a violet color, C.I. Pigment Violet 1 (Rhodamine B), C.I. Pigment Violet 2 (Rhodamine 3B), C.I. Pigment Violet 3 (Methyl Violet Lake), C.I. Pigment Violet 3:1 (Methyl Violet Lake), C.I. Pigment Violet 3:3 (Methyl Violet Lake), C.I. Pigment Violet 5:1 (Alizarin Maroon), C.I. Pigment Violet 13 (Ultramarine Pink), C.I. Pigment Violet 17 (Naphthol AS), C.I. Pigment Violet 23 (Dioxazine Violet), C.I. Pigment Violet 25 (Naphthol AS), C.I. Pigment Violet 29 (Perylene Violet), C.I. Pigment Violet 31 (Violanthrone Violet), C.I. Pigment Violet 32 (Benzimidazolone Bordeaux HF3R), C.I. Pigment Violet 36 (Thioindigo), C.I. Pigment Violet 37 (Dioxazine Violet), C.I. Pigment Violet 42 (Quinacridone Maroon B), C.I. Pigment Violet 50 (Naphthol AS), etc. are commercially available products.

As pigments exhibiting a blue color, C.I. Pigment Blue 1, C.I. Pigment Blue 2, C.I. Pigment Blue 16, C.I. Pigment Blue 22, C.I. Pigment Blue 60, C.I. Pigment Blue 66, etc. are commercially available products.

As pigments exhibiting a green color, C.I. Pigment Green 1 (Brilliant Green Lake), C.I. Pigment Green 4 (Malachite Green Lake), C.I. Pigment Green 7 (Phthalocyanine Green), C.I. Pigment Green 8 (Pigment Green B), C.I. Pigment Green 10 (Nickel Azo Yellow), C.I. Pigment Green 36 (Brominated Phthalocyanine Green), etc. are commercially available products.

As pigments exhibiting an orange color, C.I. Pigment Orange 1 (Hanza Yellow 3R), C.I. Pigment Orange 2 (Orthonitro Orange), C.I. Pigment Orange 3 (β-Naphthol), C.I. Pigment Orange 4 (Naphthol AS), C.I. Pigment Orange 5 (β-Naphthol), C.I. Pigment Orange 13 (Pyrazolone Orange G), C.I. Pigment Orange 15 (Dis-Azo Orange), C.I. Pigment Orange 16 (Anisidine Orange), C.I. Pigment Orange 17 (Persian Orange Lake), C.I. Pigment Orange 19 (Naphthalene Yellow Lake), C.I. Pigment Orange 24 (Naphthol Orange Y), C.I. Pigment Orange 31 (Condensed Azo Orange), C.I. Pigment Orange 34 (Pyrazolone Orange), C.I. Pigment Orange 36 (Benzimidazolone Orange HL), C.I. Pigment Orange 38 (Naphthol Orange), C.I. Pigment Orange 40 (Pyranthrone Orange), C.I. Pigment Orange 43 (Perinone Orange), C.I. Pigment Orange 46 (Ethyl Red Lake C), C.I. Pigment Orange 48 (Quinacridone Gold), C.I. Pigment Orange 49 (Quinacridone Gold), C.I. Pigment Orange 51 (Pyranthrone Orange), C.I. Pigment Orange 60 (Imidazolone Orange HGL), C.I. Pigment Orange 61 (Isoindolinone Orange), C.I. Pigment Orange 62 (Benzimidazolone Orange H5G), C.I. Pigment Orange 64 (Benzimidazolone), C.I. Pigment Orange 65 (Azomethine Orange), C.I. Pigment Orange 66 (Isoindolinone Orange), C.I. Pigment Orange 67 (Pyrazoloquinazolone Orange), C.I. Pigment Orange 68 (Azomethine Orange), C.I. Pigment Orange 69 (Isoindolinone Orange), C.I. Pigment Orange 71 (Diketopyrrolopyrrole Orange), C.I. Pigment Orange 72 (Imidazolone Orange H4GL), C.I. Pigment Orange 73 (Diketopyrrolopyrrole Orange), C.I. Pigment Orange 74 (Naphthol Orange 2RLD), C.I. Pigment Orange 81 (Diketopyrrolopyrrole Orange), etc. are commercially available products.

As pigments exhibiting a red color, C.I. Pigment Red 171, C.I. Pigment Red 175, C.I. Pigment Red 176, C.I. Pigment Red 177, C.I. Pigment Red 209, C.I. Pigment Red 220, C.I. Pigment Red 224, C.I. Pigment Red 242, C.I. Pigment Red 254, C.I. Pigment Red 255, C.I. Pigment Red 264, C.I. Pigment Red 270, etc. are commercially available products.

Among them, from the viewpoint of color reproduction, light fastness, and stability of a pigment dispersion, C.I. Pigment Violet 23 is preferable as the pigment exhibiting a violet color, C.I. Pigment Orange 36 is preferable as the pigment exhibiting an orange color, and C.I. Pigment Green 7 is preferable as the pigment exhibiting a green color.

In the present invention, it is preferable to use ink compositions comprising the above-mentioned pigments and color ink compositions comprising cyan, magenta, yellow, black, or white pigments and/or dyes.

Examples of pigments exhibiting a magenta color include monoazo pigments such as C.I. Pigment Red 3 (Toluidine Red, etc.), disazo pigments such as CI Pigment Red 38 (Pyrazolone Red B, etc.), azo lake pigments such as C.I. Pigment Red 53:1 (Lake Red C, etc.) and C.I. Pigment Red 57:1 (Brilliant Carmine 6B), condensed azo pigments such as C.I. Pigment Red 144 (Azo Condensation Red BR, etc.), perinone pigments such as C.I. Pigment Red 194 (Perinone Red, etc.), perylene pigments such as C.I. Pigment Red 149 (Perylene Scarlet, etc.), quinacridone pigments such as C.I. Pigment violet 19 (unsubstituted quinacridone, CINQUASIA Magenta RT-355T; manufactured by Ciba Specialty Chemicals) and C.I. Pigment Red 122 (Quinacridone Magenta, etc.), isoindolinone pigments such as C.I. Pigment Red 180 (Isoindolinone Red 2BLT, etc.), and alizarin lake pigments such as C.I. Pigment Red 83 (Madder Lake, etc.).

Examples of pigments exhibiting a cyan color include disazo pigments such as C.I. Pigment Blue 25 (Dianisidine Blue, etc.), phthalocyanine pigments such as C.I. Pigment Blue 15 and C.I. Pigment Blue 15:3 (IRGALITE BLUE GLO; manufactured by Ciba Specialty Chemicals) (Phthalocyanine Blue, etc.), acidic dye lake pigments such as C.I. Pigment Blue 24 (Peacock Blue Lake, etc.), and alkali blue pigments such as C.I. Pigment Blue 18 (Alkali Blue V-5:1).

Examples of pigments exhibiting a yellow color, monoazo pigments such as C.I. Pigment Yellow 1 (Fast Yellow G, etc.) and C.I. Pigment Yellow 74, disazo pigments such as CI Pigment Yellow 12 (Disazo Yellow AAA, etc.) and C.I. Pigment Yellow 17, benzidine-free azo pigments such as C.I. Pigment Yellow 180 and C.I. Pigment Yellow 200 (Novoperm Yellow 2HG), azo lake pigments such as CI Pigment Yellow 100 (Tartrazine Yellow Lake, etc.), condensed azo pigments such as C.I. Pigment Yellow 95 (Azo Condensation Yellow GR, etc.), acidic dye lake pigments such as C.I. Pigment Yellow 115 (Quinoline Yellow Lake, etc.), basic dye lake pigments such as C.I. Pigment Yellow 18 (Thioflavine Lake, etc.), anthraquinone pigments such as Flavanthrone Yellow (Y-24), isoindolinone pigments such as Isoindolinone Yellow 3RLT (Y-110), quinophthalone pigments such as Quinophthalone Yellow (Y-138), isoindoline pigments such as Isoindoline Yellow (Y-139), nitroso pigments such as C.I. Pigment Yellow 153 (Nickel Nitroso Yellow, etc.), and metal complex azomethine pigments such as C.I. Pigment Yellow 117 (Copper Azomethine Yellow, etc.).

Examples of pigments exhibiting a black color include carbon black, titanium black, and aniline black. Examples of the carbon black include SPECIAL BLACK 250 (manufactured by Degussa).

Examples of pigments exhibiting a white color include Pigment White 6, 18, 21. Specific examples of white pigments that can be used include basic lead carbonate ($2PbCO_3Pb(OH)_2$, also known as silver white), zinc oxide (ZnO, also known as zinc white), titanium oxide ($TiO_2$, also known as titanium white), and strontium titanate ($SrTiO_3$, also known as titan strontium white).

Titanium oxide has, compared with other white pigments, a low specific gravity, a high refractive index, and is chemically and physically stable, and therefore has high hiding power and coloring power as a pigment and, furthermore, has excellent durability toward acids, alkalis, and other environments. It is therefore preferable to use titanium oxide as the white pigment. It is of course possible to use another white pigment (which can be any white pigment, in addition to the white pigments cited above) as necessary.

Among them, it is preferable that the pigment exhibiting a cyan color is Pigment Blue 15:3 or Pigment Blue 15:4, the pigment exhibiting a magenta color is Pigment Red 122 or Pigment Violet 19, and the pigment exhibiting a yellow color is Pigment Yellow 180 or Pigment Yellow 155. Furthermore, it is preferable that the pigment exhibiting a white color is titanium oxide.

Furthermore, it is also possible to use, as a pigment, particles formed by adhering a dye or a pigment to the surface of particles of silica, alumina, resin, etc. as a core material, an insoluble lake of a dye, a colored emulsion, a colored latex, etc. Moreover, it is also possible to use a resin-covered pigment. This is called a microcapsule pigment, and commercial products thereof are available from Dainippon Ink and Chemicals, Incorporated, Toyo Ink Mfg. Co., Ltd., etc.

For dispersion of the colorant, for example, a dispersing machine such as a bead mill, a ball mill, a sand mill, an attritor, a roll mill, a jet mill, a homogenizer, a paint shaker, a kneader, an agitator, a Henschel mixer, a colloidal mill, an ultrasonic homogenizer, a pearl mill, or a wet type jet mill may be used.

When carrying out dispersion of the colorant, a dispersant such as a surfactant may be added.

Furthermore, when the colorant is added, as a dispersion adjuvant, it is also possible to use a synergist as necessary according to the various types of colorant. The dispersion adjuvant are preferably used at least 1 part by weight but no greater than 50 parts by weight relative to 100 parts by weight of the colorant.

In the colored liquid and the undercoat liquid, a solvent may be added as a dispersion medium for various components such as the colorant, or the polymerizing or crosslinking material, which is a low molecular weight component, may be used as a dispersion medium without using a solvent, and since the colored liquid and the undercoat liquid are preferably an actinic radiation curing type liquid and are cured after being applied on top of a recording medium, it is preferable for it to be solvent-free. This is because, if solvent remains in the image formed from the cured colored liquid and the cured undercoat liquid, the solvent resistance is degraded and the VOC (Volatile Organic Compound) problem of residual solvent occurs. From this viewpoint, it is preferable to use the polymerizable compound as a dispersion medium and it is particularly preferable to select a polymerizable compound having the lowest viscosity in terms of improvement of dispersion suitability and handling properties of an ink composition.

Since excellent coloration is achieved by finer particles, it is preferable for the average particle size of the colorant used here to be at least 0.01 μm but no greater than 0.4 μm, and more preferably at least 0.02 μm but no greater than 0.2 μm. In order to make the maximum particle size be no greater than 3 μm, and preferably no greater than 1 μm, it is preferable for the colorant, the dispersant, and the dispersion medium to be selected, and dispersion conditions and filtration conditions to be set. By such control of particle size, clogging of a head nozzle can be suppressed, and the storage stability of the colored liquid and the undercoat liquid, and the transparency and curing sensitivity of the colored liquid and the undercoat liquid can be maintained. In the present invention, by using a dispersant having excellent dispersibility and stability, even when a microparticulate colorant is used, a uniform and stable dispersion is obtained.

The particle size of the colorant in the colored liquid and the undercoat liquid may be measured by a known measurement method. Specifically, it may be measured by a centrifugal sedimentation light transmission method, an X-ray transmission method, a laser diffraction/scattering method, or a dynamic light scattering method. In the present invention, a value obtained by measurement using the laser diffraction/scattering method is employed.

The content of the colorant in the colored liquid is appropriately selected according to color and intended application, and from the viewpoint of image density and storage stability it is preferably, relative to the weight of the total ink composition, 0.5 to 30 wt %, more preferably 1.0 to 20 wt %, and particularly preferably 2.0 to 10 wt %.

With regard to the colorant, one type thereof may be used on its own or two or more types thereof may be used in combination. In the present invention, two or more types of organic pigments, or a solid solution of organic pigments, may be used in combination.

Different colorants may be used for each of fired liquid droplets or liquids, or the same colorant may be used.

Dispersant

It is preferable to add a dispersant when dispersing the colorant. The type of dispersant is not particularly limited, but it is preferable to use a polymeric dispersant. Examples of the polymeric dispersant include polymeric dispersants such as DisperBYK-101, DisperBYK-102, DisperBYK-103, DisperBYK-106, DisperBYK-111, DisperBYK-161, DisperBYK-162, DisperBYK-163, DisperBYK-164, DisperBYK-166, DisperBYK-167, DisperBYK-168, DisperBYK-170, DisperBYK-171, DisperBYK-174, and DisperBYK-182 (all manufactured by BYK Chemie), EFKA4010, EFKA4046, EFKA4080, EFKA5010, EFKA5207, EFKA5244, EFKA6745, EFKA6750, EFKA7414, EFKA7462, EFKA7500, EFKA7570, EFKA7575, and EFKA7580 (all manufactured by EFKA Additives), Disperse Aid 6, Disperse Aid 8, Disperse Aid 15, and Disperse Aid 9100 (manufactured by San Nopco Limited); various types of Solsperse dispersants such as Solsperse 3000, 5000, 9000, 12000, 13240, 13940, 17000, 24000, 26000, 28000, 32000, 36000, 39000, 41000, and 71000 (manufactured by Avecia); Adeka Pluronic L31, F38, L42, L44, L61, L64, F68, L72, P95, F77, P84, F87, P94, L101, P103, F108, L121, and P-123 (manufactured by Adeka Corporation), Isonet S-20 (manufactured by Sanyo Chemical Industries, Ltd.), and Disparlon KS-860, 873SN, and 874 (polymeric dispersant), #2150 (aliphatic poly carboxylic acid), and #7004 (polyether ester type) (manufactured by Kusumoto Chemicals, Ltd.).

It is also possible to use in combination a pigment derivative such as a phthalocyanine derivative (product name: EFKA-745 (manufactured by EFKA)), or Solsperse 5000, 12000, or 22000 (manufactured by Avecia).

In the present invention, the content of the dispersant in the ink composition is appropriately selected according to an intended application, and it is preferably 0.01 to 5 wt % relative to the weight of the total ink composition.

Furthermore, in the present invention, when the undercoat liquid comprises a white pigment, etc., it is preferable for the undercoat liquid to also contain a dispersant, the content of the dispersant is appropriately selected according to intended application, and relative to the weight of the total undercoat liquid, it is preferably 0.01 to 5 wt %.

Surfactant

In the present invention, it is preferable to add a surfactant to the ink composition for the purpose of giving discharge properties that are stable for a long period of time. Furthermore, it is preferable to add a surfactant to the undercoat liquid for the purpose of improving wettability toward a recording medium and preventing repellence.

The surfactant in the present invention is a material that exhibits strong surface activity toward at least one type of solvent from among hexane, cyclohexane, p-xylene, toluene, ethyl acetate, methyl ethyl ketone, butyl carbitol, cyclohexanone, triethylene glycol monobutyl ether, 1,2-hexanediol, propylene glycol monomethyl ether, isopropanol, methanol, water, isobornyl acrylate, 1,6-hexanediacrylate, and polyethylene glycol diacrylate, is preferably a material that exhibits strong surface activity toward at least one type of solvent from among hexane, toluene, propylene glycol monomethyl ether, isobornyl acrylate, 1,6-hexanediol diacrylate, and polyethylene glycol diacrylate, is more preferably a material that exhibits strong surface activity toward at least one type of solvent from among propylene glycol monomethyl ether, isobornyl acrylate, 1,6-hexanediol diacrylate, and polyethylene glycol diacrylate, and is particularly preferably a material that exhibits strong surface activity toward at least one type of solvent from among isobornyl acrylate, 1,6-hexanediol diacrylate, and polyethylene glycol diacrylate.

Whether or not a certain compound is a material that exhibits strong surface activity toward a given solvent can be evaluated by the following procedure.

Procedure

A solvent is selected, and the surface tension (γ solvent (0) of said solvent is measured. A compound in question is added to the same solvent as that for which the γ solvent (0) has been determined, the concentration of said compound is increased by 0.01 wt % at a time, and when the change in surface tension for the change in concentration of said compound becomes 0.01 mN/m or below, the surface tension of the solution (γ solvent (saturated)) is measured. If the relationship between γ solvent (0) and γ solvent (saturated) satisfies $$\gamma\text{solvent}(0)-\gamma\text{solvent}(\text{saturated})>1\ (\text{mN/m}),$$

it can be determined that said compound is a material that exhibits strong surface activity toward said solvent.

In the present invention, specific examples of the surfactant used in the ink composition and the undercoat liquid include anionic surfactants such as a dialkylsulfosuccinate, an alkylnaphthalenesulfonate, and a fatty acid salt, nonionic surfactants such as a polyoxyethylene alkyl ether, a polyoxyethylene alkyl allyl ether, acetylene glycol, or a polyoxyethylene/polyoxypropylene block copolymer, cationic surfactants such as an alkylamine salt or a quaternary ammonium salt, and fluorine-based surfactants. In addition, examples of the surfactant include those described in JP-A-62-173463 and JP-A-62-183457.

An organofluoro compound may be used as the surfactant. The organofluoro compound is preferably hydrophobic. Examples of the organofluoro compound include fluorine-based surfactants, oil-like fluorine-based compounds (e.g. fluorine oil), solid fluorine compound resins (e.g. tetrafluoroethylene resin), and those described in JP-B-57-9053 (paragraphs 8 to 17) and JP-A-62-135826.

Specific examples thereof include, as a fluorine-based additive (surfactant/surface modifying agent), Megafac F-114, F-410, F-493, F-494, F-443, F-444, F-445, F-446, F-470, F-471, F-474, F-475, F-477, F-478, F-479, F-480SF, F-482, F-483, F-484, F-486, F-487, F-172D, F-178K, F-178RM, ESM-1, MCF-350SF, R-08, F-472SF, R-30, BL-20, R-61, and R-90 (manufactured by Dainippon Ink and Chemicals, Incorporated).

Furthermore, a silicon-based surfactant such as polyether-modified polydimethylsiloxane or a polyether-modified hydroxy group-containing polydimethylsiloxane may be used. Examples thereof include BYK-306, BYK-307, BYK-308, BYK-310, BYK-330, BYK-333, BYK-341, and BYK-344 (manufactured by BYK-Chemie). These surfactants have a high ability to lower surface tension, can improve wettability toward a recording medium, and can prevent repellence.

In the present invention, although the content of the surfactant in the ink composition and the undercoat liquid is appropriately selected according to an intended application, in general it is preferably 0.0001 to 1 wt % relative to the weight of the total ink composition or undercoat liquid. It is preferable that the surface tension of the undercoat liquid is lower than the surface tension of at least one ink composition, and the amount of surfactant added can be adjusted within the above-mentioned range as necessary.

Sensitizer

As a sensitizer in the ink composition of the present invention, it is preferable to use a sensitizing dye. Preferred examples of the sensitizing dye include those that belong to compounds below and have an adsorption wavelength in the region of 350 nm to 450 nm.

Polynuclear aromatic compounds (e.g. pyrene, perylene, triphenylene), xanthenes (e.g. fluorescein, eosin, erythrosine, rhodamine B, rose bengal), cyanines (e.g. thiacarbocyanine, oxacarbocyanine), merocyanines (e.g. merocyanine, carbomerocyanine), thiazines (e.g. thionine, methylene blue, toluidine blue), acridines (e.g. acridine orange, chloroflavin, acriflavine), anthraquinones (e.g. anthraquinone), squaryliums (e.g. squarylium), and coumarins (e.g. 7-diethylamino-4-methylcoumarin).

Preferred examples of the sensitizing dye include compounds represented by Formulae (IX) to (XIII) below.

(IX)

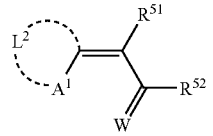

(X)

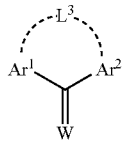

(XI)

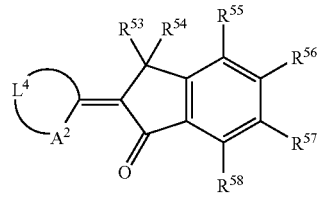

(XII)

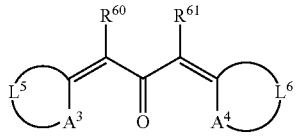

(XIII)

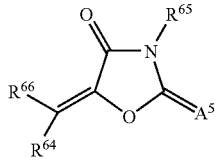

In Formula (IX), $A^1$ denotes a sulfur atom or $NR^{50}$, $R^{50}$ denotes an alkyl group or an aryl group, $L^2$ denotes a non-metallic atomic group forming a basic nucleus of a dye in cooperation with a neighboring $A^1$ and the neighboring carbon atom, $R^{51}$ and $R^{52}$ independently denote a hydrogen atom or a monovalent non-metallic atomic group, and $R^{51}$ and $R^{52}$ may be bonded together to form an acidic nucleus of a dye. W denotes an oxygen atom or a sulfur atom.

In Formula (X), $Ar^1$ and $Ar^2$ independently denote an aryl group and are connected to each other via a bond of $-L^3-$. Here, $L^3$ denotes —O— or —S—. W has the same meaning as that shown in Formula (IX).

In Formula (XI), $A_2$ denotes a sulfur atom or $NR^{59}$, $L^4$ denotes a non-metallic atomic group forming a basic nucleus of a dye in cooperation with the neighboring $A_2$ and carbon atom, $R^{53}$, $R^{54}$, $R^{55}$, $R^{56}$, $R^{57}$, and $R^{58}$ independently denote a monovalent non-metallic atomic group, and $R^{59}$ denotes an alkyl group or an aryl group.

In Formula (XII), $A^3$ and $A^4$ independently denote —S—, —$NR^{62}$—, or —$NR^{53}$—, $R^{62}$ and $R^{63}$ independently denote a substituted or unsubstituted alkyl group, or a substituted or unsubstituted aryl group, $L^5$ and $L^6$ independently denote a non-metallic atomic group forming a basic nucleus of a dye in cooperation with the neighboring $A^3$ and $A^4$ and neighboring carbon atom, and $R^{50}$ and $R^{61}$ independently denote a hydrogen atom or a monovalent non-metallic atomic group, or are bonded to each other to form an aliphatic or aromatic ring.

In Formula (XIII), $R^{66}$ denotes an aromatic ring or a hetero ring, which may have a substituent, and $A^5$ denotes an oxygen atom, a sulfur atom, or —$NR^{67}$—. $R^{64}$, $R^{65}$, and $R^{67}$ independently denote a hydrogen atom or a monovalent non-metallic atomic group, and $R^{67}$ and $R^{64}$, and $R^{65}$ and $R^{67}$ may be bonded to each other to form an aliphatic or aromatic ring.

Specific examples of the compounds represented by Formulae (IX) to (XIII) include (A-1) to (A-20) listed below.

(A-1)

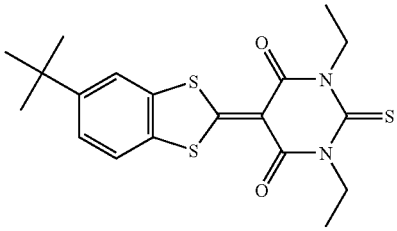

(A-2)

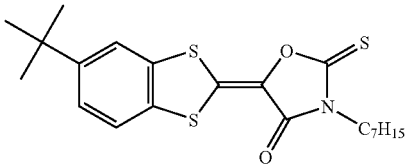

(A-3)

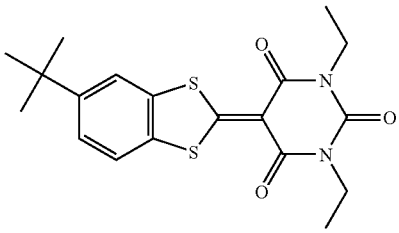

(A-4)

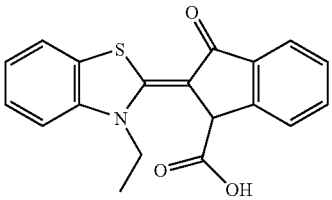

(A-5)

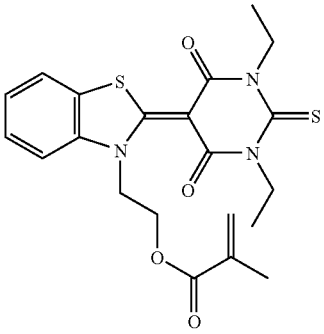

-continued (A-6)

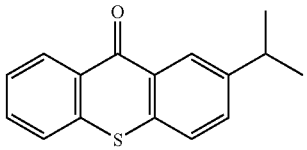

(A-7)

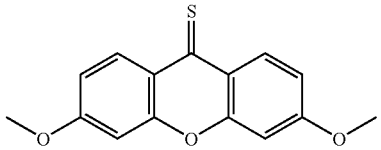

(A-8)

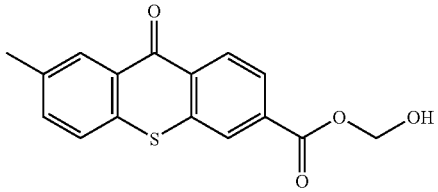

(A-9)

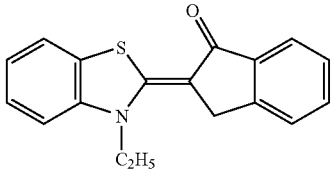

(A-10)

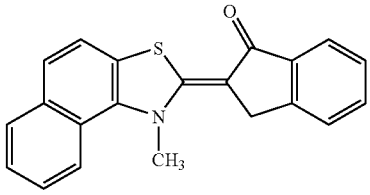

(A-11)

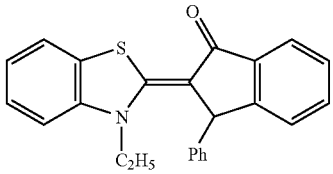

(A-12)

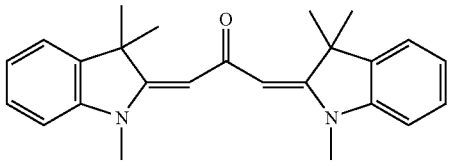

(A-13)

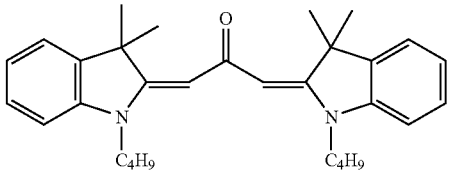

(A-14)

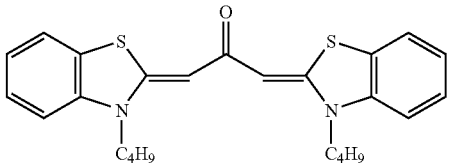

-continued (A-15)

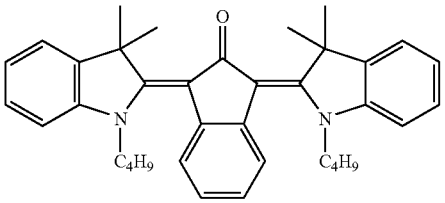

(A-16)

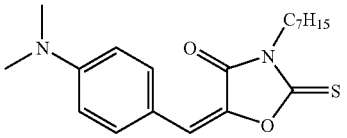

(A-17)

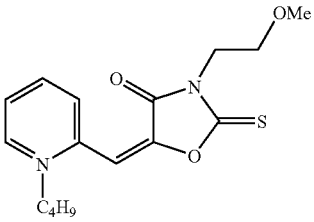

(A-18)

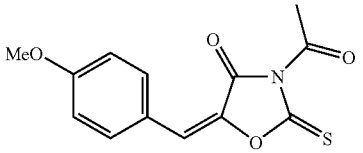

(A-19)

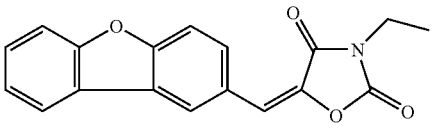

(A-20)

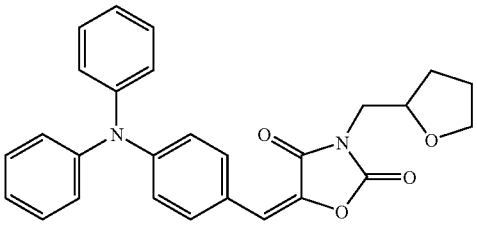

Other Components

The ink composition and the undercoat liquid used in the present invention may comprise, in addition to the above-mentioned components, a co-sensitizer, a storage stabilizer, a conductive salt, a solvent, a polymerization inhibitor, and other additives according to an intended application.

Co-Sensitizer

A known compound having a function of further improving sensitivity, suppressing inhibition of polymerization by oxygen, etc. may be added as a co-sensitizer. Examples of the co-sensitizer include amines such as compounds described in M. R. Sander et al., 'Journal of Polymer Society' Vol. 10, p. 3173 (1972), JP-B-44-20189, JP-A-51-82102, JP-A-52-134692, JP-A-59-138205, JP-A-60-84305, JP-A-62-18537, JP-A-64-33104, and Research Disclosure 33825, and specific examples thereof include triethanolamine, ethyl p-dimethylaminobenzoate, p-formyldimethylaniline, and p-methylthiodimethylaniline.

Other examples of the cosensitizer include thiols and sulfides such as thiol compounds described in JP-A-53-702, JP-B-55-500806, and JP-A-5-142772, and disulfide compounds of JP-A-56-75643, and specific examples thereof include 2-mercaptobenzothiazole, 2-mercaptobenzoxazole, 2-mercaptobenzimidazole, 2-mercapto-4(3H)-quinazoline, and β-mercaptonaphthalene.

Yet other examples of the cosensitizer include amino acid compounds (e.g. N-phenylglycine, etc.), organometallic compounds described in JP-B-48-42965 (e.g. tributyltin acetate, etc.), hydrogen-donating compounds described in JP-B-55-34414, sulfur compounds described in JP-A-6-308727 (e.g. trithiane, etc.), phosphorus compounds described in JP-A-6-250387 (diethylphosphite, etc.), and Si—H, Ge—H compounds described in JP-A-8-54735.

Storage Stabilizer

The ink composition and the undercoat liquid (preferably the ink composition) used in the present invention may comprise a storage stabilizer for the purpose of suppressing undesirable polymerization during storage. The storage stabilizer is preferably used together with the polymerizing or crosslinking material, and is preferably one that is soluble in the liquid droplets or liquid that contain it, or another component present at the same time.

Examples of the storage stabilizer include a quaternary ammonium salt, a hydroxylamine, a cyclic amide, a nitrile, a substituted urea, a heterocyclic compound, an organic acid, hydroquinone, a hydroquinone monoether, an organic phosphine, and a copper compound, and specific examples thereof include benzyltrimethylammonium chloride, diethylhydroxylamine, benzothiazole, 4-amino-2,2,6,6-tetramethylpiperidine, citric acid, hydroquinone monomethyl ether, hydroquinone monobutyl ether, and copper naphthenate.

The amount of storage stabilizer added is preferably adjusted as appropriate according to the activity of the polymerization initiator, the polymerizability of the polymerizing or crosslinking material, or the type of storage stabilizer, and from the viewpoint of a balance between storage stability and curability, the amount is preferably 0.005 to 1 wt % on the basis of the solids content of the ink composition and undercoat liquid, more preferably 0.01 to 0.5 wt %, and yet more preferably 0.01 to 0.2 wt %.

Conductive Salt

The conductive salt is a solid compound that improves conductivity. In the present invention, since there is a possibility of precipitation during storage, it is preferable that there is substantially no use of the conductive salt, but when solubility is good due to the solubility of the conductive salt being increased or a liquid component having high solubilizing properties being used, an appropriate amount thereof may be added. Examples of the conductive salt include potassium thiocyanate, lithium nitrate, ammonium thiocyanate, and dimethylamine hydrochloride.

Solvent

In the present invention, a known solvent may be used as necessary. The solvent may be used for the purpose of adjusting the polarity or viscosity of a liquid (ink composition and undercoat liquid), improving the surface tension, solubility and dispersibility of a colorant, adjusting the conductivity, and adjusting the printing performance.

Since from the viewpoint of rapid drying and a high quality image with uniform line width being recorded it is preferable that the solvent is a water-insoluble liquid and does not contain an aqueous solvent, it is desirable to employ a high boiling point organic solvent.

The high boiling point organic solvent in the present invention preferably has excellent compatibility with constituent materials, in particular a monomer.

Specific examples thereof include tripropylene glycol monomethyl ether, dipropylene glycol monomethyl ether, propylene glycol monomethyl ether, ethylene glycol monobutyl ether, diethylene glycol monobutyl ether, triethylene glycol monobutyl ether, ethylene glycol monobenzyl ether, and diethylene glycol monobenzyl ether.

As known solvents, there are organic solvents having a low boiling point of no greater than 100° C., but since there is a possibility of affecting the curability, and since the low boiling point organic solvent might cause environmental pollution, it is desirable for one not to be used. If one is used, one with high safety is preferably used; high safety means a solvent with a high standard control concentration (index based on workplace assessment), one of at least 100 ppm being preferable, and one of at least 200 ppm being more preferable. Examples thereof include alcohols, ketones, esters, ethers, and hydrocarbons, and specific examples thereof include methanol, 2-butanol, acetone, methyl ethyl ketone, ethyl acetate, and tetrahydrofuran.

With regard to the solvent, one type may be used on its own, or a plurality thereof may be used in combination, and when water and/or a low boiling point organic solvent are used, the amounts thereof used are preferably 0 to 20 wt % in each liquid, and more preferably 0 to 10 wt %, but it is preferable if substantially none is contained. When the ink composition and the undercoat liquid related to the present invention substantially do not contain water this is preferable in terms of stability over time so that the ink composition and/or the undercoat liquid do not become cloudy due to non-uniformity, deposition of dye, etc. over time, and in terms of drying properties when a nonpermeable or slowly-permeable recording medium is used. 'Substantially not containing' means that the presence of inevitable impurities is allowed.

Polymerization Inhibitor

A polymerization inhibitor may be added from the viewpoint of enhancing storage properties. In the present invention, since the ink composition is preferably discharged after being heated to a range of 40° C. to 80° C. so as to reduce the viscosity, it is preferable to add a polymerization inhibitor in order to prevent head clogging due to thermal polymerization. The polymerization inhibitor is preferably added at 200 to 20,000 ppm relative to the total amount of the ink composition. Examples of the polymerization inhibitor include hydroquinone, benzoquinone, p-methoxyphenol, TEMPO, TEMPOL, Al cupferron, and FIRSTCURE ST-1 (ALBEMARLE).

Other Additives

Furthermore, known additives such as a polymer, a surface tension adjusting agent, a UV absorber, an antioxidant, a discoloration preventing agent, and a pH adjusting agent may be added.

With regard to the surface tension adjusting agent, the UV absorber, the antioxidant, the discoloration preventing agent, and the pH adjusting agent, known compounds may be appropriately selected and used, and specific examples include additives described in JP-A-2001-181549.

Other than the above additives, a pair of compounds that form an aggregate or increase viscosity when mixed and reacted may be respectively added to the ink composition and the undercoat liquid related to the present invention. The pair of compounds have the property of forming an aggregate rapidly or increasing the viscosity of a liquid rapidly, and this enables coalescence of adjacent liquid droplets to be suppressed more effectively.

Examples of the reaction of the pair of compounds include an acid/base reaction, a hydrogen bonding reaction between carboxylic acid/amide group-containing compounds, a crosslinking reaction represented by a boronic acid/diol reaction, and a cation/anion electrostatic interaction.

Physical Properties of Ink Composition and Undercoat Liquid

With regard to the physical properties of the ink composition (liquid droplets) discharged above a recording medium by an inkjet recording method, although it depends on the equipment, in general the viscosity at 25° C. is preferably in the range of 5 to 100 mPa·s, and more preferably 10 to 80 mPa·s. The viscosity (25° C.) of the undercoat liquid before semi-curing is preferably in the range of 20 to 3,000 mPa·s, and more preferably 40 to 2,000 mPa·s.

In the present invention, from the viewpoint of forming dots with a desired size on a recording medium, it is preferable for the undercoat liquid to comprise a surfactant, and satisfy all of Conditions (A), (B), and (C) below.

(A) The surface tension of the undercoat liquid is less than the surface tension of any of the ink compositions.

(B) At least one type among surfactants contained in the undercoat liquid satisfies the relationship $\gamma s\ (0)-\gamma s\ (\text{saturated})>0$ (mN/m).

(C) The surface tension of the undercoat liquid satisfies the relationship $\gamma s<(\gamma s\ (0)+\gamma s\ (\text{saturated})^{max})/2$.

Here, $\gamma s$ is a value of the surface tension of the undercoat liquid. $\gamma s\ (0)$ is a value of the surface tension of a liquid obtained by removing all of the surfactants in the undercoat liquid composition. $\gamma s$ (saturated) is a value of the surface tension of a liquid obtained by adding one type of surfactant among the surfactants contained in the undercoat liquid to said 'liquid obtained by removing all of the surfactants', and increasing the concentration of said one type of surfactant so that the surface tension is saturated. $\gamma s\ (\text{saturated})^{max}$ is a maximum value among the $\gamma s$ (saturated) values obtained for all of the surfactants contained in the undercoat liquid and satisfying condition (B) above.

Condition (A)

In the present invention, in order to form an ink dot with a desired size above a recording medium as described above, it is preferable that the surface tension $\gamma s$ of the undercoat liquid is less than the surface tension $\gamma k$ of any of the ink compositions.

Furthermore, from the viewpoint of preventing effectively spreading of an ink dot during the time from landing to exposure, it is preferable that $\gamma s<\gamma k-3$ (mN/m), and it is particularly preferable that $\gamma s<\gamma k-5$ (mN/m).

Moreover, when a full color image is printed, from the viewpoint of improving the sharpness of the image, it is preferable that the surface tension $\gamma s$ of the undercoat liquid is less than the surface tension of at least the ink composition that comprises a colorant having high visibility, and it is more preferable that it is less than the surface tension of all of the ink compositions. As a colorant having high visibility, colorants exhibiting magenta, black, and cyan colors can be cited.

Even when the surface tension $\gamma k$ of the ink composition and the surface tension $\gamma s$ of the undercoat liquid satisfy the above-mentioned relationship, if the two values are less than 15 mN/m, it will become difficult to form a liquid droplet during inkjet firing and misdischarge might occur. On the other hand, if the values exceed 50 mN/m, there is a possibility that the wettability toward an inkjet head will become poor and the problem of misdischarge might occur. Therefore, from the viewpoint of correct discharge suitability, the surface tension γk of the ink composition and the surface tension γs of the undercoat liquid are preferably at least 15 mN/m but no greater than 50 mN/m, more preferably at least 18 mN/m but no greater than 40 mN/m, and particularly preferably at least 20 mN/m but no greater than 38 mN/m.

The surface tension referred to above is a value obtained by measuring at a liquid temperature of 25° C. and 60% RH by the Wilhelmy method using a standard surface tensiometer (e.g. a CBVP-Z surface tensiometer manufactured by Kyowa Interface Science Co., Ltd.).

Condition (B) and Condition (C)

In the present invention, in order to form an ink dot with a desired size above a recording medium, it is preferable for the undercoat liquid to comprise at least one or more types of surfactant. In this case, at least one type from the surfactants contained in the undercoat liquid preferably satisfies condition (B) below.

$$\gamma s(0)-\gamma s(\text{saturated})>0\ (\text{mN/m}) \qquad \text{Condition (B)}$$

Moreover, the surface tension of the undercoat liquid preferably satisfies the relationship of condition (C) below.

$$\gamma s<(\gamma s(0)+\gamma s(\text{saturated})^{max})/2 \qquad \text{Condition (C)}$$

As described above, γs is a value of the surface tension of the undercoat liquid. Furthermore, γs (0) is a value of the surface tension of a liquid obtained by removing all of the surfactants from the undercoat liquid composition. γs (saturated) is a value of the surface tension of a liquid obtained by adding one type of surfactant among the surfactants contained in the undercoat liquid to said 'liquid obtained by removing all of the surfactants', and increasing the concentration of said one type of surfactant so that the surface tension is saturated. γs (saturated)$^{max}$ is a maximum value among the γs (saturated) values obtained for all of the surfactants contained in the undercoat liquid and satisfying condition (B) above.

The γs (0) is obtained by measuring a value of the surface tension of a liquid obtained by removing all of the surfactants from the undercoat liquid composition. Furthermore, the γs (saturated) is obtained by measuring the surface tension of a liquid obtained by adding one type of surfactant among the surfactants contained in the undercoat liquid to said 'liquid obtained by removing all of the surfactants', and increasing the concentration of said one type of surfactant by 0.01 wt % at a time until the amount of change in the surface tension relative to the change in concentration of the surfactant becomes 0.01 mN/m or below.

The γs (0), γs (saturated), and γs (saturated)$^{max}$ are specifically explained below.

For example, when components constituting an undercoat liquid (Case 1) are a high boiling point solvent (diethyl phthalate, Wako Pure Chemical Industries, Ltd.), a polymerizable material (dipropylene glycol diacrylate, Akcros), a polymerization initiator (TPO, Initiator-1 described below), a fluorine-based surfactant (Megafac F475, Dainippon Ink and Chemicals, Incorporated), and a hydrocarbon-based surfactant (sodium di-2-ethylhexyl sulfosuccinate), γs (0), γs (saturated)$^1$ (when the fluorine-based surfactant is added), γs (saturated)$^2$ (when the hydrocarbon-based surfactant is added), γs (saturated), and γs (saturated)$^{max}$ are as follows.

Initiator-1

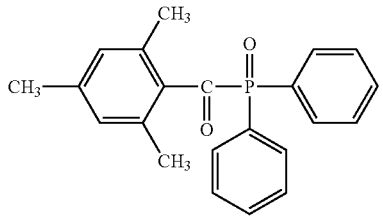

That is, γs (0) is a value of the surface tension of a liquid obtained by removing all of the surfactants from the undercoat liquid, and is 36.7 mN/m. When the fluorine-based surfactant is added to said liquid and the concentration is increased, a saturated value for the surface tension of said liquid is defined as γs (saturated)$^1$, and its value is 20.2 mN/m. Furthermore, when the hydrocarbon-based surfactant is similarly added to said liquid and the concentration is increased, a saturated value for the surface tension of said liquid is defined as γs (saturated)$^2$, and its value is 30.5 mN/m.

Since the undercoat liquid (Case 1) comprises two types of surfactants satisfying condition (B) above, γs (saturated) can take two values, that is, when the fluorine-based surfactant is added (γs (saturated)$^1$) and when the hydrocarbon-based surfactant is added (γs (saturated)$^2$). Here, since γs (saturated)$^{max}$ is the maximum value among As (saturated)$^1$ and γs (saturated)$^2$, it is the value of γs (saturated)$^2$.

The above can be summarized as follows.

γs (0)=36.7 mN/m

γs (saturated)$^1$=20.2 mN/m (when the fluorine-based surfactant is added)

γs (saturated)$^2$=30.5 mN/m (when the hydrocarbon-based surfactant is added)

γs (saturated)$^{max}$=30.5 mN/m

From the above results, the surface tension γs of the undercoat liquid preferably satisfies the relationship $$\gamma s<(\gamma s(0)+\gamma s(\text{saturated})^{max})/2=33.6\ \text{mN/m}.$$

With regard to condition (C) above, from the viewpoint of preventing effectively the ink composition droplets from spreading during the time from landing to exposure, the surface tension of the undercoat liquid preferably satisfies the relationship $$\gamma s<\gamma s(0)-3\times\{\gamma s(0)-\gamma s(\text{saturated})^{max}\}/4,$$

and particularly preferably satisfies the relationship $$\gamma s\leqq\gamma s(\text{saturated})^{max}.$$

With regard to the ink composition and the undercoat liquid, their compositions may be selected so as to obtain a desired surface tension, and it is preferable that these liquids (the ink composition and the undercoat liquid) comprise the above-mentioned surfactants. In order to form an ink dot having a desired size on a recording medium, it is preferable that the undercoat liquid comprises at least one type of surfactant.

Curing Sensitivity of Ink Composition and Undercoat Liquid

In the present invention, it is preferable that the curing sensitivity of the ink composition is the same as or higher than the curing sensitivity of the undercoat liquid. It is more preferable that the curing sensitivity of the ink composition is at least the same as the curing sensitivity of the undercoat liquid but no greater than 4 times the curing sensitivity of the undercoat liquid. It is yet more preferable that the curing sensitivity of the ink composition is at least the same as the curing sensitivity of the undercoat liquid but no greater than twice the curing sensitivity of the undercoat liquid.

The curing sensitivity referred to here means an amount of energy necessary for complete curing when the ink composition and/or the undercoat liquid are cured using a mercury lamp (super high pressure, high pressure, medium pressure, etc., and preferably a super high pressure mercury lamp), and the smaller the amount of energy, the higher the sensitivity. Therefore, the curing sensitivity being twice means that the amount of energy is ½. Furthermore, the curing sensitivity being the same means that the difference in curing sensitivity between two that are to be compared is no greater than twice, and preferably no greater than 1.5 times. Whether or not one is completely cured may be judged by placing a permeable medium such as plain paper against the surface of the ink composition or the undercoat liquid and checking if there is transfer thereof onto the permeable medium.

Recording Medium

In the inkjet recording method of the present invention, as a recording medium, any of a permeable recording medium, a nonpermeable recording medium, and a slowly-permeable recording medium may be used.

Among them, from the viewpoint of the effects of the present invention being exhibited more remarkably, a nonpermeable or slowly-permeable recording medium is preferable. The permeable recording medium referred to here means a recording medium for which when, for example, a 10 pL (picoliter) liquid droplet is dropped on the recording medium, the time taken for the whole liquid to permeate is no greater than 100 ms. Moreover, the nonpermeable recording medium referred to here means a recording medium through which a liquid droplet substantially does not permeate. 'Substantially does not permeate' means that, for example, the percentage permeation of the liquid droplet after 1 minute is no greater than 5%. Moreover, the slowly-permeable recording medium referred to here means a recording medium for which, when a 10 pL liquid droplet is dropped on the recording medium, the time taken for the entire liquid to permeate is 100 ms or longer.

Examples of the permeable recording medium include plain paper, porous paper, and other recording media that can absorb a liquid.

Examples of the nonpermeable and the slowly-permeable recording media include art paper, synthetic resin, rubber, resin-coated paper, glass, metal, ceramic, and wood. Furthermore, in the present invention, in order to impart a function, a composite recording medium in which a plurality of these materials are combined may be used.

The synthetic resin may be any synthetic resin, and examples thereof include polyesters such as polyethylene terephthalate and polybutadiene terephthalate, polyolefins such as polyvinyl chloride, polystyrene, polyethylene, polyurethane, and polypropylene, acrylic resin, polycarbonate, acrylonitrile-butadiene-styrene copolymer, diacetate, triacetate, polyimide, cellophane, and celluloid. The thickness and shape of a recording medium obtained using a synthetic resin are not particularly limited, and it may be in any of film, card, and block forms, and it may be transparent or opaque.

With regard to the configuration of the synthetic resin when used, a film used for the so-called soft packaging is preferably employed, and various types of non-absorbing plastics and films thereof may be used. Examples of the plastic film include PET film, OPS film, OPP film, PNy film, PVC film, PE film, TAC film, and PP film. As other plastics, polycarbonate, acrylic resin, ABS, polyacetal, PVA, rubber, etc. may be used.

Examples of the resin-coated paper include a transparent polyester film, an opaque polyester film, an opaque polyolefin resin film, and a paper support having opposite faces laminated with a polyolefin resin. A paper support having opposite faces laminated with a polyolefin resin is particularly preferable.

The metal is not particularly limited, and examples thereof include aluminum, iron, gold, silver, copper, nickel, titanium, chromium, molybdenum, silicon, lead, zinc, stainless steel, and a composite material thereof.

Furthermore, it is also possible to use a read-only optical disk such as a CD-ROM or a DVD-ROM, a write-once optical disk such as a CD-R or DVD-R, and a rewritable optical disk, and a label side thereof may be subjected to inkjet recording.

Curing Process for Undercoat Liquid

In the present invention, it is preferable to semi-cure an applied undercoat liquid during the time from after application of the undercoat liquid to before firing liquid droplets of at least one type of ink composition.

In the present invention, 'semi-curing' means partial curing (partially cured; partial curing) and refers to a state in which the undercoat liquid and/or the ink liquid (colored liquid) are partially cured but not completely cured. When the undercoat liquid applied on top of the recording medium (substrate) or the ink liquid discharged on top of the undercoat liquid is semi-cured, the degree of curing may be nonuniform. For example, it is preferable that curing of the undercoat liquid and/or the ink liquid progresses in the depth direction.

Examples of methods for semi-curing an undercoat liquid and/or ink liquid include known viscosity increasing methods such as (1) a method employing the so-called aggregation phenomenon by applying a basic compound to an acidic polymer or by applying an acidic compound or a metal compound to a basic polymer, (2) a method in which the undercoat liquid and/or ink liquid are prepared in advance so as to have a high viscosity, a low boiling point organic solvent is added thereto so as to make the viscosity low, and the low boiling point organic solvent is evaporated so as to restore the original high viscosity, (3) a method in which the undercoat liquid and/or ink liquid prepared so as to have a high viscosity is heated, and cooled to restore the original high viscosity, and (4) a method in which actinic radiation or heat is applied to the undercoat liquid and/or ink liquid so as to initiate a semi-curing reaction.

Among them, method (4), in which actinic radiation or heat is applied to the undercoat liquid and/or ink liquid so as to initiate a semi-curing reaction, is preferable.

The method in which actinic radiation or heat is applied so as to cause a semi-curing reaction is a method in which a polymerization reaction of a polymerizable compound on the surface of the undercoat liquid and/or ink liquid applied to a recording medium is incompletely carried out.

When a radically polymerizable undercoat liquid or ink liquid is polymerized in an atmosphere containing a large amount of oxygen, such as an atmosphere of air or air partially displaced by an inert gas, radical polymerization tends to be inhibited on the surface of droplets of the ink liquid (hereinafter, also called ink liquid droplets) or the undercoat liquid layer applied on top of the recording medium, due to the radical polymerization inhibition effect of oxygen. As a result, semi-curing is nonuniform, curing advances further in the interior of the undercoat liquid layer or the ink liquid droplets, and curing of the surface tends to be delayed. The undercoat liquid layer referred to here is the layer of undercoat liquid applied on top of the substrate.

When a cationically polymerizable undercoat liquid or ink liquid is polymerized in an atmosphere containing moisture, due to the cationic polymerization inhibition effect of moisture, curing advances further in the interior of the undercoat liquid layer or the ink liquid droplets applied on top of the recording medium, and curing of the surface tends to be delayed.

In the present invention, when a radically photopolymerizable undercoat liquid or ink liquid is used in the presence of oxygen, which inhibits radical polymerization, thus carrying out partial photocuring, curing of the undercoat liquid and/or the ink liquid advances further in the interior than in the exterior.

In particular, the polymerization reaction is easily inhibited on the surface of the undercoat liquid compared with the interior thereof due to the influence of oxygen in the air. It is therefore possible to semi-cure the undercoat liquid by controlling the conditions under which actinic radiation or heat is applied.

The amount of energy necessary for semi-curing the undercoat liquid and/or the ink liquid depends on the type and content of a polymerization initiator, but it is preferably on the order of 1 to 500 mJ/cm$^2$ when energy is provided by actinic radiation. When energy is provided by heating, heating is preferably carried out for 0.1 to 1 sec. under conditions that give a surface temperature of the recording medium in the range of 40° C. to 80° C.

Due to the actinic radiation or heat provided by actinic light or heating, etc., generation of an active species as a result of decomposition of a polymerization initiator is promoted, and as a result of an increase in the active species or an increase in temperature a curing reaction by polymerization or crosslinking, by means of the active species, of a polymerizable or crosslinking material is promoted.

Furthermore, increasing the viscosity (viscosity increase) is also suitably carried out by irradiation with actinic light or heating.

By firing droplets of an ink liquid onto a semi-cured undercoat liquid, or firing droplets of a different ink liquid (in particular, a ink liquid having a different color) onto the semi-cured ink liquid, a desirable technical effect can be given to the quality of the printed material obtained. Furthermore, the mode of action thereof can be ascertained by examination of a cross section of the printed material.

An area (high density area) when about 12 pL (picoliter; the same applies below) droplets of a ink liquid are fired at a high density onto an approximately 5 μm thick undercoat liquid in a semi-cured state provided on a substrate is explained as one example.

FIG. 1 is a cross-sectional schematic diagram showing one embodiment of a printed material obtained by firing droplets of a ink liquid onto a semi-cured undercoat liquid layer. The undercoat liquid is semi-cured, and curing has advanced further on the substrate side than in the surface layer. FIG. 1 shows an undercoat layer 14 in which a ink liquid is applied to a semi-cured undercoat liquid layer.

In this case, it is observed that a cross section of an obtained image 10 has the following three characteristics.

(1) Part of an ink liquid cured material 12 is exposed on the surface, (2) Part of the ink liquid cured material 12 has sunk into the undercoat layer 14, and (3) the undercoat layer 14 is present between the lower side of the ink liquid cured material 12 and the substrate 16.

That is, a printed material obtained by applying an ink liquid on top of a semi-cured undercoat liquid layer has the cross section shown schematically in FIG. 1. When the above-mentioned conditions (1), (2), and (3) are satisfied, it can be said that an ink liquid is applied to a semi-cured undercoat liquid. In this case, droplets of the ink liquid fired at high density are joined together to form a colored coating, thus giving a uniform and high density. The undercoat layer referred to here means a layer obtained by curing an undercoat liquid layer.

Figure 2:
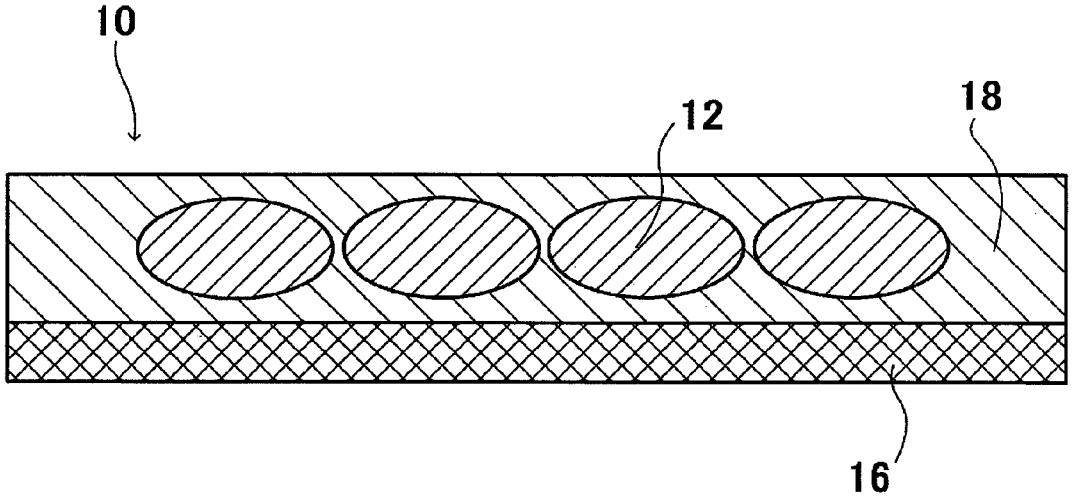
FIG. 2 is a cross-sectional schematic diagram showing one embodiment of a printed material obtained by firing droplets of a colored liquid onto an uncured undercoat liquid layer.
Figure 3:
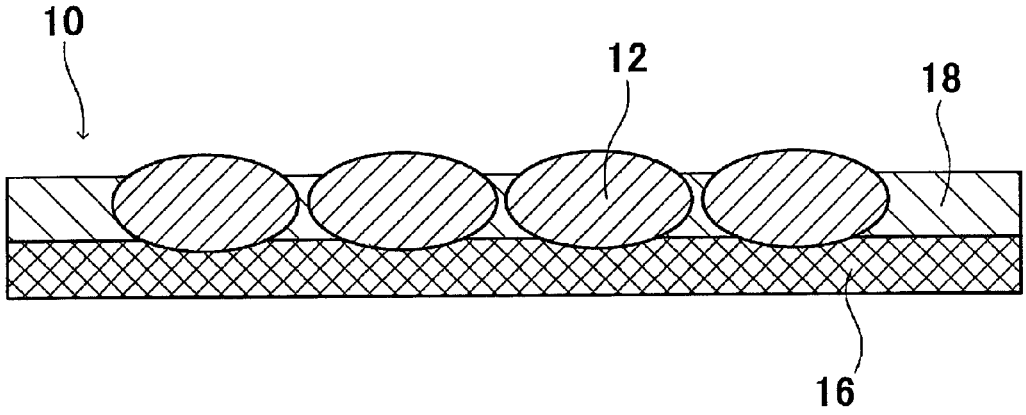
FIG. 3 is a cross-sectional schematic diagram showing another embodiment of the printed material obtained by firing droplets of a colored liquid onto an uncured undercoat liquid layer.

FIG. 2 and FIG. 3 are cross-sectional schematic diagrams showing one embodiment of a printed material obtained by firing droplets of an ink liquid onto an uncured undercoat liquid layer. FIG. 2 and FIG. 3 show an undercoat layer 18 in which the ink liquid is applied to the uncured undercoat liquid layer.

When a droplet of an ink liquid is fired onto an uncured undercoat liquid layer, the whole of the ink liquid sinks into the undercoat liquid layer and/or no undercoat liquid is present beneath the ink liquid. Specifically, in FIG. 2, in a cross-sectional slice of an obtained image 10, an ink liquid cured material 12 has completely sunk into the undercoat layer 18, and no part of the ink liquid cured material 12 is exposed on the surface. Furthermore, as shown in FIG. 3, in a cross-sectional slice of an obtained image 10, no undercoat layer 18 is present beneath the ink liquid cured material 12.

In this case, even when the ink liquid is applied at high density, since droplets are isolated from each other, this causes a decrease in color density.

Figure 4:
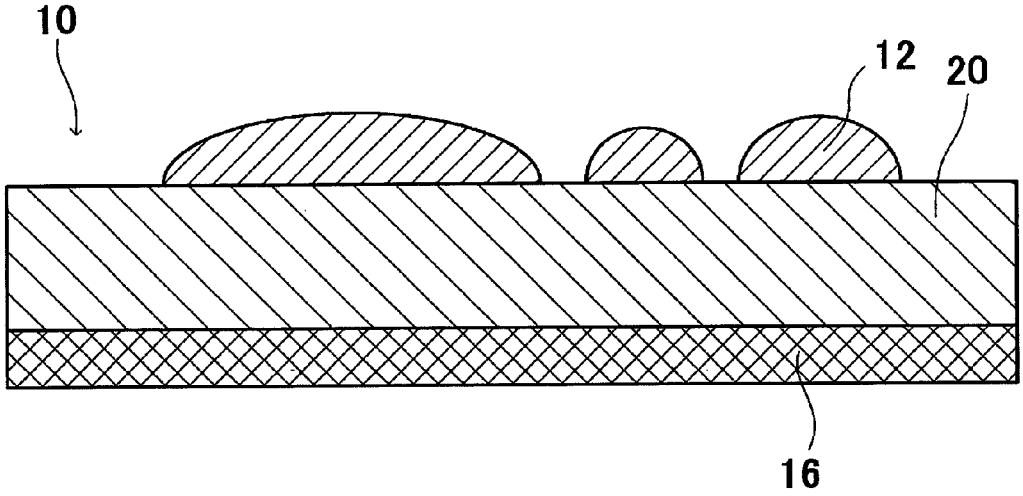
FIG. 4 is a cross-sectional schematic diagram showing one embodiment of a printed material obtained by firing droplets of a colored liquid onto a completely cured undercoat liquid layer.

FIG. 4 is a cross-sectional schematic diagram showing one embodiment of a printed material obtained by firing droplets of an ink liquid onto a completely cured undercoat liquid layer. FIG. 4 shows an undercoat layer 20 in which the ink liquid is applied to the completely cured undercoat liquid layer.

When a droplet of an ink liquid is fired onto a completely cured undercoat liquid layer, the ink liquid does not sink into the undercoat liquid layer. Specifically, as shown in FIG. 4, the ink liquid cured material 12 has not sunk into the undercoat layer 20.

In such a state, fired droplet interference might be caused, and a uniform ink liquid coating layer cannot be formed, thus degrading color reproduction.

From the viewpoint of forming a uniform ink liquid layer (colored coating) without ink liquid droplets being isolated from each other when the droplets are applied at high density and from the viewpoint of suppressing the occurrence of fired droplet interference, the amount of undercoat liquid transferred per unit area is preferably sufficiently smaller than the maximum amount of ink liquid droplets applied per unit area. That is, when the amount (weight) of undercoat liquid layer transferred per unit area is M (undercoat liquid) and the maximum weight of the ink liquid applied per unit area is m (ink liquid), M (undercoat liquid) and m (ink liquid) preferably satisfy the following relationship.

$$[m(\text{ink liquid})/30] \leqq [M(\text{undercoat liquid})] \leqq [m(\text{ink liquid})]$$

It is more preferable that [m (ink liquid)/20]≦[M (undercoat liquid)]≦[m (ink liquid)/3], and yet more preferable that [m (ink liquid)/10]≦[M (undercoat liquid)]≦[m (ink liquid)/5]. The maximum weight of the ink liquid applied per unit area here is the maximum weight per color.

It is preferable that [m (ink liquid)/30]≦[M (undercoat liquid)] since the occurrence of fired droplet interference can be suppressed and, moreover, dot size reproducibility is excellent. Furthermore, it is preferable that M (undercoat liquid)≦m (ink liquid) since a uniform ink liquid layer can be formed and a high density image can be obtained.

The amount of undercoat liquid layer transferred per unit area is determined by the transfer test described below. After the semi-curing step is completed (e.g. after irradiating with actinic radiation) but before firing droplets of an ink liquid, a permeable medium such as plain paper is pressed against the semi-cured undercoat liquid layer, and the amount of undercoat liquid transferred to the permeable medium is defined by measurement of the weight.

For example, when the maximum amount of ink liquid discharged is 12 pL per pixel (dot) at a fired droplet density of 600×600 dpi, the maximum weight m (ink liquid) of the ink liquid applied per unit area is 0.74 mg/cm$^2$ (here, it is assumed that the density of the ink liquid is about 1.1 g/cm$^3$). The amount of undercoat liquid layer transferred is therefore preferably at least 0.025 mg/cm$^2$ but no greater than 0.74 mg/cm$^2$ per unit area, more preferably at least 0.037 mg/cm$^2$ but no greater than 0.25 mg/cm$^2$, and yet more preferably at least 0.074 mg/cm$^2$ but no greater than 0.148 mg/cm$^2$.

In the present invention, dpi means the number of dots per 2.54 cm.

When a secondary color is formed from an ink liquid A and an ink liquid B, it is preferable that ink liquid B is applied on top of semi-cured ink liquid A.

Figure 5:
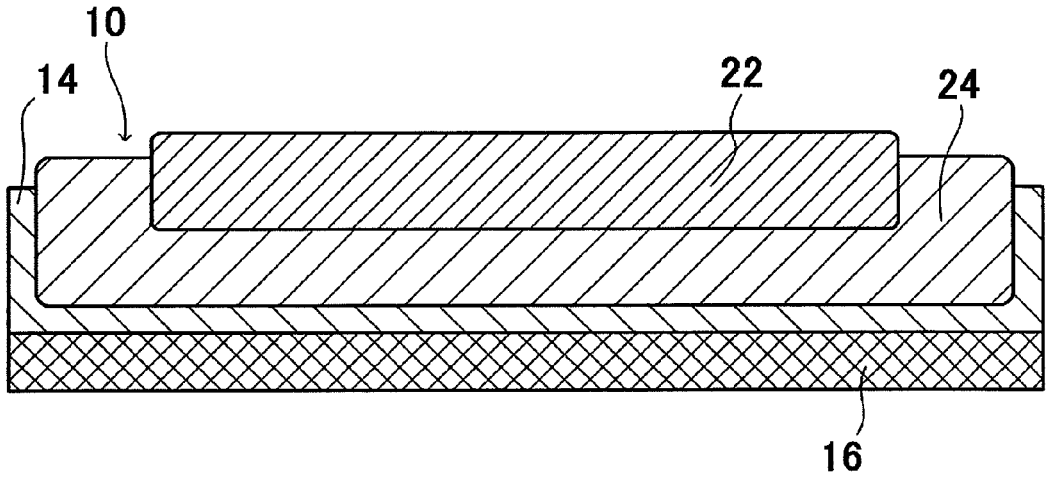
FIG. 5 is a cross-sectional schematic diagram showing one embodiment of a printed material obtained by firing droplets of colored liquid B onto semi-cured colored liquid A.

FIG. 5 is a cross-sectional schematic diagram showing one embodiment of a printed material obtained by firing droplets of ink liquid B onto semi-cured ink liquid A. FIG. 5 shows an ink liquid A cured material 24 and an ink liquid B cured material 22 obtained by applying ink liquid B onto semi-cured ink liquid A.

When a droplet of ink liquid B is fired onto semi-cured ink liquid A, part of ink liquid B sinks into ink liquid A, and ink liquid A is present beneath ink liquid B. That is, in a printed material obtained by applying ink liquid B on top of semi-cured ink liquid A, as shown in FIG. 5, part of the ink liquid B cured material 22 is exposed on the surface, and part of the ink liquid B cured material 22 has sunk into the ink liquid A cured material 24. Furthermore, the ink liquid A cured material 24 is present beneath the ink liquid B cured material 22. A cured coating of ink liquid A (ink coating A, the ink liquid A cured material 24 in FIG. 5) and a cured coating of ink liquid B (ink coating B, the ink liquid B cured material 22 in FIG. 5) are in a layered state, thus enabling good color reproduction to be obtained.

Figure 6:
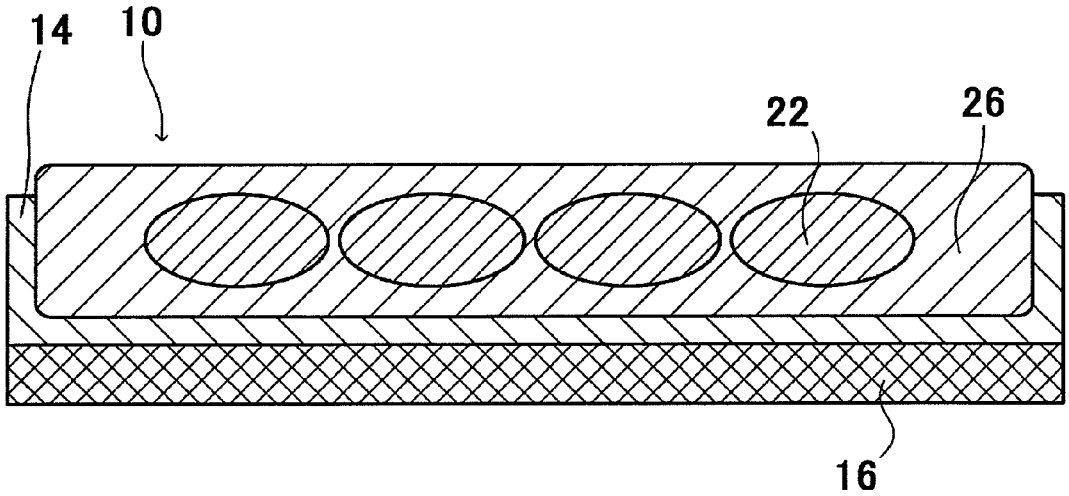
FIG. 6 is a cross-sectional schematic diagram showing one embodiment of a printed material obtained by firing droplets of colored liquid B onto uncured colored liquid A.
Figure 7:
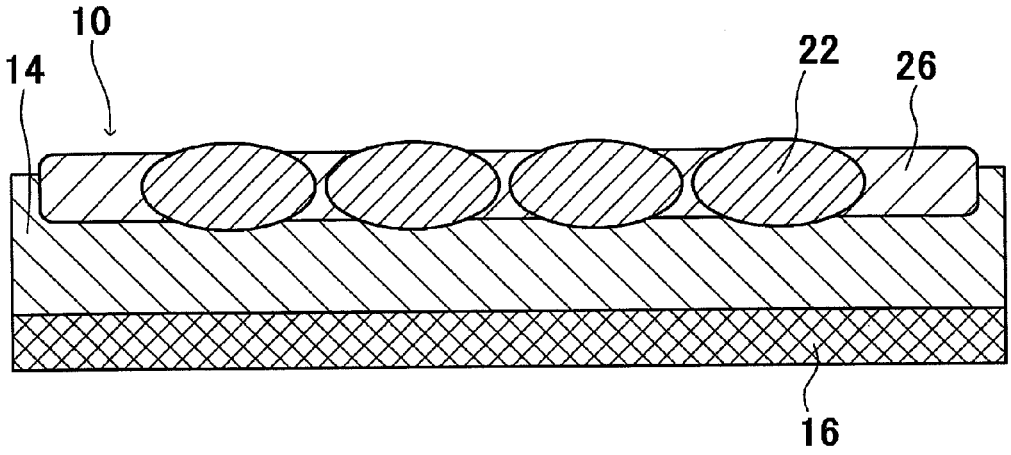
FIG. 7 is a cross-sectional schematic diagram showing another embodiment of the printed material obtained by firing droplets of colored liquid B onto uncured colored liquid A.

FIG. 6 and FIG. 7 are cross-sectional schematic diagrams showing one embodiment of a printed material obtained by firing droplets of ink liquid B onto uncured ink liquid A. FIG. 6 shows a ink liquid A cured material 26 and a ink liquid B cured material 22 obtained by applying ink liquid B onto uncured ink liquid A.

When a droplet of ink liquid B is fired onto uncured ink liquid A, the whole of ink liquid B sinks into ink liquid A and/or no ink liquid A is present beneath ink liquid B. That is, when a cross-sectional view of the image thus obtained is examined, as shown in FIG. 6 the whole of the ink liquid B cured material 22 has sunk into the ink liquid A cured material 26 and/or as shown in FIG. 7 no ink liquid A cured material 26 is present beneath the ink liquid B cured material 22. In this case, even when ink liquid B is applied at high density, droplets are isolated from each other, thus causing a degradation in secondary color saturation.

Figure 8:
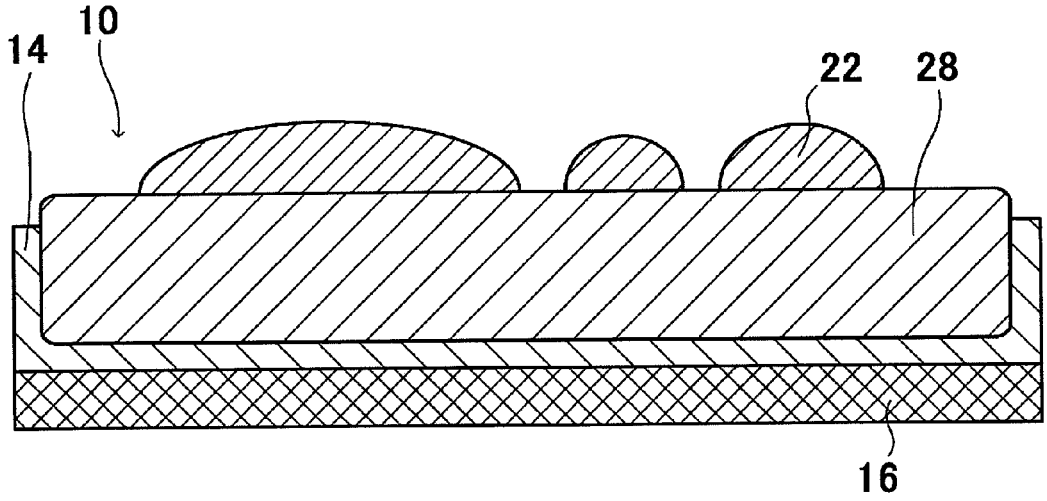
FIG. 8 is a cross-sectional schematic diagram showing one embodiment of a printed material obtained by firing droplets of colored liquid B onto completely cured colored liquid A.

FIG. 8 is a cross-sectional schematic diagram showing one embodiment of a printed material obtained by firing droplets of ink liquid B onto completely cured ink liquid A. FIG. 8 shows an ink liquid A cured material 28 and an ink liquid B cured material 22 obtained by applying ink liquid B onto completely cured ink liquid A. When a droplet of ink liquid B is fired onto completely cured ink liquid A, ink liquid B does not sink into ink liquid A. As shown in FIG. 8, in a cross-sectional view of an image that is obtained, the ink liquid B cured material 22 has not sunk into the ink liquid A cured material 28. Such a state causes the occurrence of fired droplet interference, a uniform ink liquid coating layer cannot be formed, and color reproducibility is degraded.

From the viewpoint of forming a uniform ink liquid B layer without ink liquid B droplets being isolated from each other when the droplets are applied at high density and from the viewpoint of suppressing the occurrence of fired droplet interference, the amount of ink liquid A transferred per unit area is preferably sufficiently smaller than the maximum amount of ink liquid B droplets applied per unit area. That is, when the amount (weight) of ink liquid A layer transferred per unit area is M (ink liquid A) and the maximum weight of ink liquid B discharged per unit area is m (ink liquid B), M (ink liquid A) and m (ink liquid B) preferably satisfy the following relationship.

$$[m(\text{ink liquid } B)/30] \leqq [M(\text{ink liquid } A)] \leqq [m(\text{ink liquid } B)]$$

It is more preferable that [m (ink liquid B)/20]≦[M (ink liquid A)]≦[m (ink liquid B)/3], and yet more preferable that [m (ink liquid B)/10]≦[M (ink liquid A)]≦[m (ink liquid B)/5].

It is preferable that [m (ink liquid B)/30]≦[M (ink liquid A)] since the occurrence of fired droplet interference can be suppressed and, moreover, dot size reproducibility is excellent. Furthermore, it is preferable that M (ink liquid A)≦m (ink liquid B) since a uniform ink liquid layer can be formed and a high density image can be obtained.

The amount (weight) of ink liquid A transferred per unit area is determined by the transfer test described below. After the semi-curing step is completed (e.g. after irradiating with actinic radiation) but before firing droplets of ink liquid B, a permeable medium such as plain paper is pressed against the semi-cured ink liquid A layer, and the amount of ink liquid A transferred to the permeable medium is defined by measurement of the weight.

For example, when the maximum amount of ink liquid B discharged is 12 pL per pixel at a fired droplet density of 600×600 dpi, the maximum weight m (ink liquid) of the ink liquid B discharged per unit area is 0.74 mg/cm$^2$ (here, it is assumed that the density of ink liquid B is about 1.1 g/cm$^3$). The amount of ink liquid A transferred is therefore preferably at least 0.025 mg/cm$^2$ but no greater than 0.74 mg/cm$^2$ per unit area, more preferably at least 0.037 mg/cm$^2$ but no greater than 0.25 mg/cm$^2$, and yet more preferably at least 0.074 mg/cm$^2$ but no greater than 0.148 mg/cm$^2$.

When a curing reaction is based on an ethylenically unsaturated compound, the degree of unpolymerization may, as described later, be measured quantitatively by the reaction ratio of an ethylenically unsaturated group.

When a semi-cured state of the undercoat liquid and/or ink liquid is realized by a polymerization reaction of a polymerizable compound for which polymerization is initiated by irradiation with actinic radiation or heating, from the viewpoint of improvement of scratch resistance of a printed material, it is preferable for the degree of unpolymerization (A (after polymerization)/A (before polymerization)) to be at least 0.2 but no greater than 0.9, more preferably at least 0.3 but no greater than 0.9, and particularly preferably at least 0.5 but no greater than 0.9.

Here, A (after polymerization) is an infrared absorption peak due to a polymerizable group after the polymerization reaction, and A (before polymerization) is an infrared absorption peak due to the polymerizable group before the polymerization reaction. For example, when the polymerizable compound contained in the undercoat liquid and/or ink liquid is an acrylate monomer or a methacrylate monomer, an absorption peak due to the polymerizable group (acrylate group, methacrylate group) is observed at around 810 $cm^{-1}$, and the degree of unpolymerization is preferably defined by the absorbance of the peak.

Moreover, as means for measuring an infrared absorption spectrum, a commercial infrared spectrophotometer may be used; either a transmission type or a reflectance type may be used, and it is preferably selected as appropriate depending on the form of a sample. For example, an FTS-6000 infrared spectrophotometer manufactured by Bio-Rad Laboratories, Inc. may be used for measurement.

Application of Undercoat Liquid and Ink Composition

In the inkjet recording method of the present invention, it is possible to apply the undercoat liquid to a recording medium using coating equipment, an inkjet nozzle, etc. Furthermore, the ink composition is fired using an inkjet nozzle, etc. and applied onto the undercoat liquid. It is preferable to apply the ink composition onto the semi-cured undercoat liquid.

(i) Coating Using Coating Equipment

In the present invention, a mode in which image recording is carried out by coating a recording medium with the undercoat liquid using coating equipment and subsequently firing ink liquid droplets via an inkjet nozzle is preferable. The inkjet nozzle is described later.

The coating equipment is not particularly limited and may be appropriately selected from known coating equipment according to the intended purpose, etc., and examples thereof include an air doctor coater, a blade coater, a rod coater, a knife coater, a squeegee coater, an immersion coater, a reverse roll coater, a transfer roll coater, a gravure coater, a kiss roll coater, a cast coater, a spray coater, a curtain coater, and an extrusion coater. Details may be referred to in 'Kotingu Kogaku (Coating Engineering)' by Yuji Harasaki.

(ii) Discharging Via Inkjet Nozzle

In the present invention, a mode in which image recording is carried out by discharging the undercoat liquid via an inkjet nozzle and subsequently firing ink liquid droplets via an inkjet nozzle is also preferably used.

With regard to conditions for applying the undercoat liquid via the inkjet nozzle, a head having a larger liquid droplet discharge rate at a lower nozzle density than a head for discharging an ink liquid is arranged as a full line head unit in the width direction of a recording medium, and it is desirable to discharge the undercoat liquid thereby.

Since such a head having a large liquid droplet discharge rate generally has a high discharge power, it can easily be applied to a highly viscous undercoat liquid, and it is also advantageous for suppressing nozzle clogging. Furthermore, when a head having a large liquid droplet discharge rate is used, the droplet firing resolution of undercoat liquid in the recording medium transport direction can be decreased, and there is the advantage that an inexpensive head having a low drive frequency may be used.

In any of the above-mentioned modes, a liquid other than the undercoat liquid and the ink liquid droplets may be applied. Application of the other liquid to the recording medium may be carried out by any method such as coating by coating equipment or discharging via an inkjet nozzle, and the timing of application is not particularly limited. When the other liquid comprises a colorant, a method in which discharging is carried out via an inkjet nozzle is preferable, and it is preferably applied after the undercoat liquid is applied.

A method for discharging via an inkjet nozzle (inkjet recording method) is now explained.

In the present invention, examples thereof include known methods such as an electrostatic attraction method in which an ink liquid is discharged by utilizing electrostatic attraction, a drop-on-demand method (pressure pulse method) in which oscillatory pressure of a piezo element is utilized, an acoustic inkjet method in which an electric signal is changed into an acoustic beam and applied to an ink liquid and the ink liquid is discharged utilizing radiation pressure, and a thermal inkjet method in which an ink liquid is heated so as to form a gas bubble, and the pressure thus generated is utilized.

The inkjet recording method also includes a method in which an ink liquid called a photo ink, which has a low concentration, is discharged a large number of times in small volume, a method in which image quality is improved using a plurality of ink liquids having substantially the same hue but different concentrations, and a method in which a colorless transparent ink liquid is used.

In the present invention, droplets of the ink liquid that are discharged on top of a coating of the semi-cured undercoat liquid and/or ink liquid are preferably fired at a droplet size of at least 0.1 pL but no greater than 100 pL (preferably via an inkjet nozzle). When the droplet size is in the above-mentioned range, it is effective in terms of being able to draw a high sharpness image at high density. It is more preferably at least 0.5 pL but no greater than 50 pL.

Furthermore, with regard to the amount of undercoat liquid applied (ratio by weight per unit area), it is preferably at least 0.05 but no greater than 5 when the maximum amount of ink liquid applied (per color) droplet of the ink liquid is 1, is more preferably at least 0.07 but no greater than 4, and is yet more preferably at least 0.1 but no greater than 3.

The thickness of an undercoat liquid layer formed by applying the undercoat liquid onto a recording medium (substrate) and the thickness of an undercoat layer formed by curing same are preferably at least 1 μm but no greater than 20 μm, more preferably at least 2 μm but no greater than 10 μm, and yet more preferably at least 3 μm but no greater than 8 μm.

It is preferable for the thickness of the undercoat liquid layer and the undercoat layer to be in the above-mentioned range since flexibility and adhesion of a cured image can be maintained well.

The droplet firing interval after applying an undercoat liquid until a droplet of an ink liquid is fired is preferably at least 5 μsec but no greater than 10 sec. When the droplet firing interval is in the above-mentioned range, it is effective in terms of the effects of the present invention being clearly exhibited. The droplet firing interval for ink composition liquid droplets is more preferably at least 10 μsec but no greater than 5 sec, and particularly preferably at least 20 μsec but no greater than 5 sec.

Image Recording Principle and Recording Equipment

Figure 9:
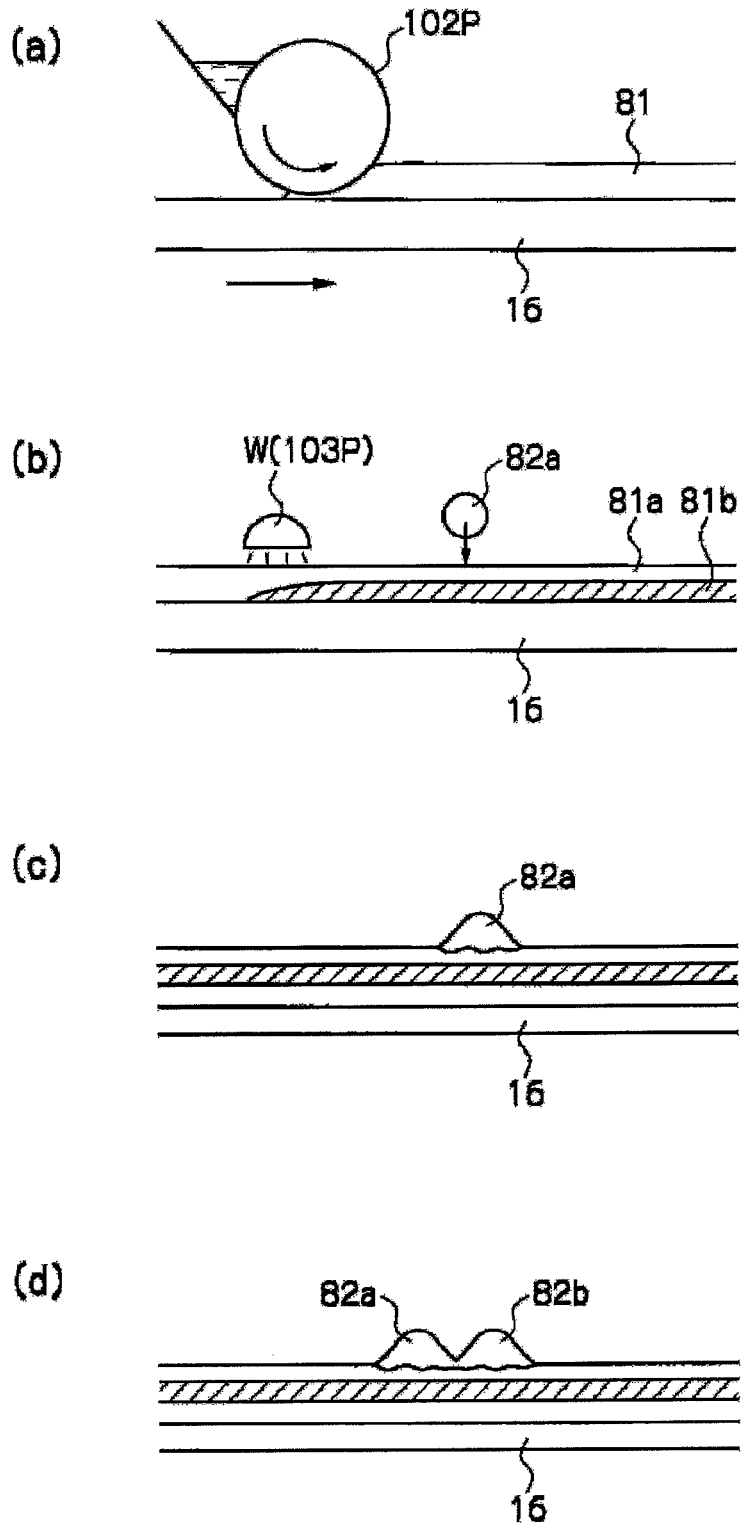
FIG. 9 is a process drawing for explaining the principle of image formation.

With regard to the principle of the present invention for forming an image on a recording medium while avoiding fired droplet interference, one case is now explained by reference to FIG. 9.

As shown in FIG. 9A, an undercoat liquid is applied to a recording medium 16, and an undercoat liquid layer 81 is formed on the surface of the recording medium 16. With regard to the mode of applying the undercoat liquid, a coating mode is shown in the figure, but any mode such as droplet firing (also called 'discharging') via an inkjet head or spray coating may be employed.

The thickness of the applied undercoat liquid layer is an average thickness obtained by dividing the volume of the applied undercoat liquid by the area of a section to which the undercoat liquid is applied. When the undercoat liquid is applied by firing, the thickness can be determined from the volume fired and the area of a section to which the undercoat liquid is applied. It is desirable for the thickness of a liquid coating of the undercoat liquid to be uniform and free from local differences in thickness. From this viewpoint, it is preferable for the undercoat liquid to have physical properties that allow it to easily spread on a recording medium in a range that enables it to be discharged stably via an inkjet head, that is, the undercoat liquid has a low static surface tension.

As shown in FIG. 9B, after the undercoat liquid is semi-cured by irradiation with actinic radiation or the application of heat (heating) by means of a light source W (103P) (uncured undercoat liquid 81*a*, cured undercoat liquid 81*b*), an ink liquid droplet 82*a* is fired. As shown in FIG. 9C, this droplet firing allows the ink liquid droplet 82*a* to land on the undercoat liquid coating 81. Since the undercoat liquid layer is in a semi-cured state at this time, it is compatible with the ink liquid droplet 82*a*.

Furthermore, as shown in FIG. 9D, a subsequent ink liquid droplet 82*b* is fired at the vicinity of the position where the previously fired first liquid droplet 82*a* has landed, within a region where the undercoat liquid layer on the recording medium 16 is present. Since the undercoat liquid layer is in a semi-cured state at this time, it is compatible with the ink liquid droplet 82*b*. A force to coalesce the ink liquid droplet 82*a* and the ink liquid droplet 82*b* acts thereon, but fired droplet interference is suppressed due to good adhesion between the ink liquid droplets and the undercoat layer surface and due to resistance to coalescence by the interior of the undercoat layer in a semi-cured state when coalescence of the ink liquid droplets is being attempted.

Conventionally, in order to avoid fired droplet interference, a material that causes a chemical reaction that results in coaggregation or insolubilization of a colorant contained in an ink liquid is added to an undercoat liquid, but in the present invention it is possible to avoid fired droplet interference without adding such a material to the undercoat liquid.

Furthermore, as shown in FIG. 9D, while fired droplet interference is avoided and the shapes of the ink liquid droplets 82*a* and 82*b* are retained (in the case of the present invention, between a few hundred msec to 5 sec), that is, before the dot shapes are lost, the ink liquid droplets 82*a* and 82*b* are cured or semi-cured to a degree such that the shape is not lost, and the colorant in the ink liquid droplets 82*a* and 82*b* is fixed to the recording medium 16. At least the ink liquid comprises an actinic radiation-curable polymerizable compound, and cures as a result of a polymerization reaction when irradiated with actinic radiation such as UV rays. It is also possible for the undercoat liquid to comprise a polymerizable compound, and since the entire liquid discharged cures, this is preferable for enhancing the adhesion.

The overall constitution of an inline label printer, which is one example of an image recording system equipped with an inkjet recording device suitably used in the present invention, is now explained by reference to drawings.

Figure 10:
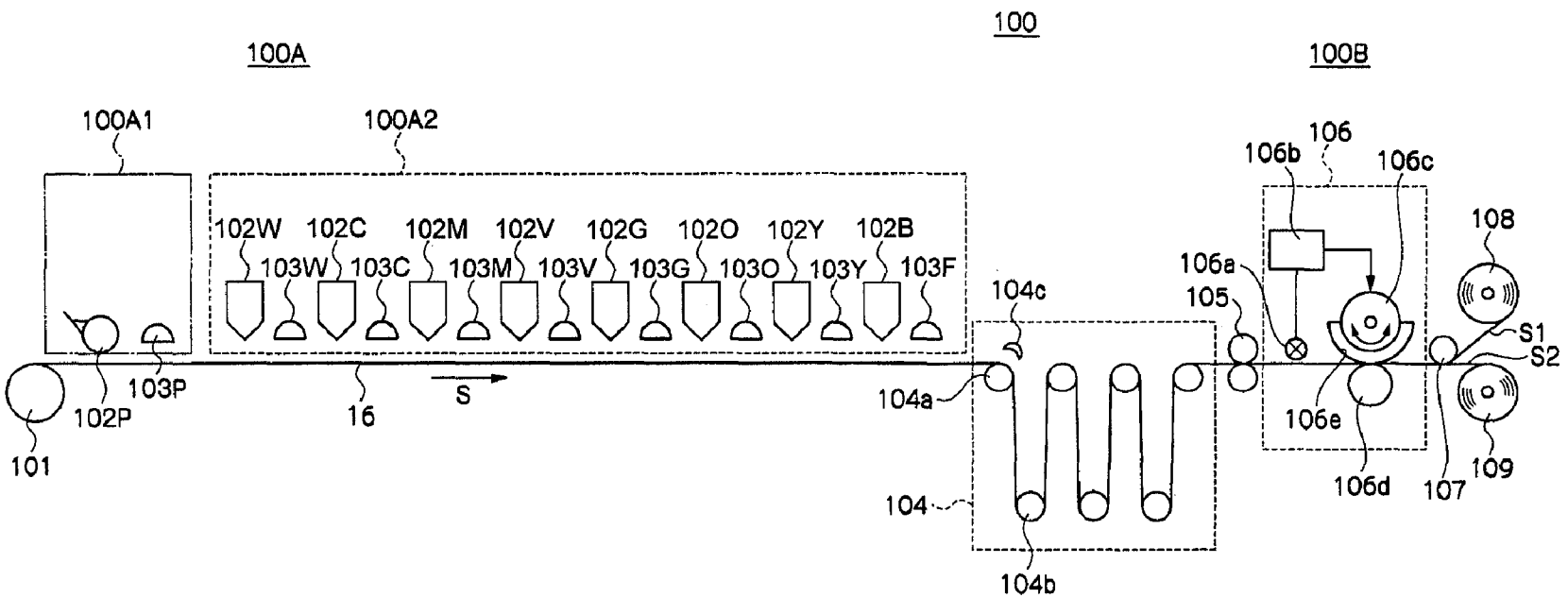
FIG. 10 is a schematic sectional view showing the overall constitution of an image recording system for recording an image by the inkjet recording method of the present invention.

FIG. 10 is an overall schematic diagram showing one example of an inline label printer (image recording system) 100. This image recording system 100 comprises an inkjet recording section 100A, a post-treatment section 100B for subjecting a recording medium that has been drawn on to a post-treatment, and a buffer 104 as a buffering section between the inkjet recording section 100A and the post-treatment section 100B.

The inkjet recording system is applied in the inkjet recording section 100A. The inkjet recording section 100A is constituted from an undercoat liquid layer-forming section 100A1 for forming a semi-cured undercoat liquid layer above a recording medium 16, and a drawing section 100A2 for forming a desired image on the recording medium 16 by applying eight types of colorant-containing ink compositions onto a predetermined position of the recording medium 16.

A good image can be formed when a recording medium that is not particularly permeable (e.g. OPP (Oriented Polypropylene Film), CPP (Cast Polypropylene Film), PE (polyethylene), PET (Polyethylene terephthalate), or PP (Polypropylene), soft wrapping material having low permeability, laminated paper, coated paper, art paper, etc.) is used as the recording medium.

In FIG. 10, the inkjet recording section 100A comprises the drawing section 100A2, in which an undercoat liquid is applied by means of a roll coater 102P and an ink composition is applied to the recording medium 16 by inkjet droplet firing.

Moreover, the image recording system 100 comprises a light-shielded liquid storage/charging section (not illustrated) for storing the undercoat liquid and the ink composition supplied to the undercoat liquid layer-forming section 100A1 and the drawing section 100A2, a paper feed section 101 for supplying the recording medium 16, an image detection section 104*c* for reading in an image formed as a result of firing droplets of the ink composition in the drawing section 100A2 (in a state in which ink composition droplets have landed), and a label wind-up section 109 for winding up the recorded recording medium.

In FIG. 10, as one example of the paper feed section 101, one in which roll paper (continuous paper) is fed is shown, but one in which cut paper, which has been cut in advance, is fed may be used.

The inkjet recording section 100A is further explained. The inkjet recording section 100A comprises the drawing section 100A2, which comprises ink composition droplet firing heads 102W, 102C, 102M, 102V, 102G, 102O, 102Y, and 102B for firing droplets of ink compositions onto the recording medium 16 via a single pass, pinning light sources 103W, 103C, 103M, 103V, 103G, 103O, and 103Y, and a final curing light source 103F, and the undercoat liquid layer-forming section 100A1, which comprises a roll coater 102P and a semi-curing UV light source 103P. Here, W, C, M, V, G, O, Y, and B denote white, cyan, magenta, violet, green, orange, yellow, and black colors respectively.

In detail, it uses a so-called full-line head in which a line head having a length corresponding to the whole width of the recordable width of the recording medium 16 is arranged in a direction perpendicular to the medium transport direction (shown by arrow S in FIG. 10). In the figure, the pinning light sources (semi-curing light sources) 103W, 103C, 103M, 103V, 103G, 103O, and 103Y for curing dots from firing droplets of each of the color ink compositions so that at least the shape of the dots is not lost are disposed downstream of 102W, 102C, 102M, 102V, 102G, 102O, and 102Y respectively. If neither yellow nor black are fired, 103Y can be omitted.

With regard to the roll coater 102P and each of the droplet firing heads 102W, 102C, 102M, 102V, 102G, 102O, 102Y, and 102B, the coater and a plurality of nozzles (liquid discharge orifices) are arranged over a length that exceeds at least one side of a maximum-sized recording medium 16 as a target of the inkjet recording section 100A.

Furthermore, along the medium transport direction S, from the upstream side (left-hand side in FIG. 10), droplet firing heads 102W, 102C, 102M, 102V, 102G, 102O, 102Y, and 102B corresponding to a white color ink composition (W), a cyan color ink composition (C), a magenta color ink composition (M), a violet color ink composition (V), a green color ink composition (G), an orange color ink composition (O), a yellow color ink composition (Y), and a black color ink composition (B) are arranged in this order, and thus enable a color image to be formed on the recording medium 16.

Specifically, the recording medium 16 is first coated with the undercoat liquid by means of the roll coater (102P), and the undercoat liquid is semi-cured by the semi-curing UV light source 103P. Subsequently, droplets of an ink composition are fired at the recording medium 16 via the cyan ink composition droplet firing head 102C, and the cyan ink composition above the recording medium is semi-cured by the pinning light source 103C disposed downstream of the head 102C such that the surface is not cured but at least the shape thereof is not lost. Subsequently, the same procedure as for the cyan ink composition is repeated for the heads 102M, 102V, 102G, 102O, and 102Y, droplet firing is finally carried out by means of the black ink composition droplet firing head 102B, and curing is then completed by means of the final curing light source 103F, which has the ability to completely cure the undercoat liquid and all of the ink compositions.

Semi-curing the undercoat liquid and the ink composition in air by means of the pinning light sources after the application thereof enables fired droplet interference to be avoided.

In accordance with the drawing section 100A2 comprising the full-line droplet firing head, an image can be recorded over the whole surface of the recording medium 16 by moving the recording medium 16 relative to the drawing section 100A2 in the medium transport direction only once. This enables high speed printing to be carried out and the productivity to be improved compared with a shuttle head in which, while transporting a recording medium, the droplet firing head is made to reciprocate in a direction perpendicular to the medium transport direction.

In the present embodiment, a constitution with the eight colors WCMVGOYB is illustrated, but the number of colors and the combinations thereof for the ink compositions are not limited to the example shown in the present embodiment, and a pale ink composition, a dark ink composition, a transparent ink composition, etc. may be added as necessary. For example, a constitution in which a droplet firing head for discharging a light ink composition such as light cyan or light magenta is added, a constitution in which drawing of a background is carried out with a white ink composition, or a constitution in which surface gloss is adjusted by a transparent ink composition, etc. is possible.

Furthermore, it is also possible to use a red, blue, etc. ink composition.

103P, 103W, 103C, 103M, 103V, 103G, 103O, and 103Y, which are UV light sources, apply UV rays toward the recording medium 16 in order to semi-cure the undercoat liquid or the ink composition, which comprise a polymerizable compound. As a UV-emitting light source, a known light source such as a medium pressure mercury lamp, a high pressure mercury lamp, a super high pressure mercury lamp, a metal halide lamp, a xenon lamp, a carbon arc lamp, a UV fluorescent lamp, a UV LED, or a UV LD may be used, and from the viewpoint of practicality it is preferable to use a high pressure mercury lamp, a super high pressure mercury lamp, or a metal halide lamp. Furthermore, as a UV light source, one having a light intensity peak at a wavelength in the range of 200 nm to 400 nm is preferable, and one having an irradiation light intensity in the range of 1 to 500 mW/cm$^2$ at the wavelength of the light intensity peak is preferable. The UV light source preferably has a constitution in which a cold mirror is used as a reflector and an IR-cut glass is used as a cover glass, thus preventing any increase in temperature of the recording medium due to the application of heat rays.

Irradiation by means of the final curing light source 103F is preferably carried out under an atmosphere having a lower oxygen concentration than that of air; the oxygen concentration is preferably 0.1 to 10 vol %, more preferably 0.1 to 8 vol %, and particularly preferably 0.1 to 5 vol %. It is preferable for it to be in the above-mentioned range since a printed material having excellent curability, image quality, and productivity can be obtained.

Although it is not shown in FIG. 10, it is possible to provide a gas supply/suction mechanism, which is gas supply means for supplying/discharging a mixed gas, in the area irradiated by actinic radiation of the final curing light source 103F. Flushing the area irradiated by the final curing light source 103F with an inert gas (nitrogen, etc.) suppresses the inhibition of polymerization by oxygen, thus enabling good curing and fixation of the ink composition to be carried out.

In order to flush the area irradiated by the final curing light source 103F with an inert gas, a housing for covering the final curing light source 103F and a transport belt may be provided. Within this housing, a gas supply nozzle having its aperture facing the top of the recording medium at the actinic irradiation position of the final curing light source 103F and a gas collection nozzle having its aperture facing the recording medium may be provided.

Figure 11:
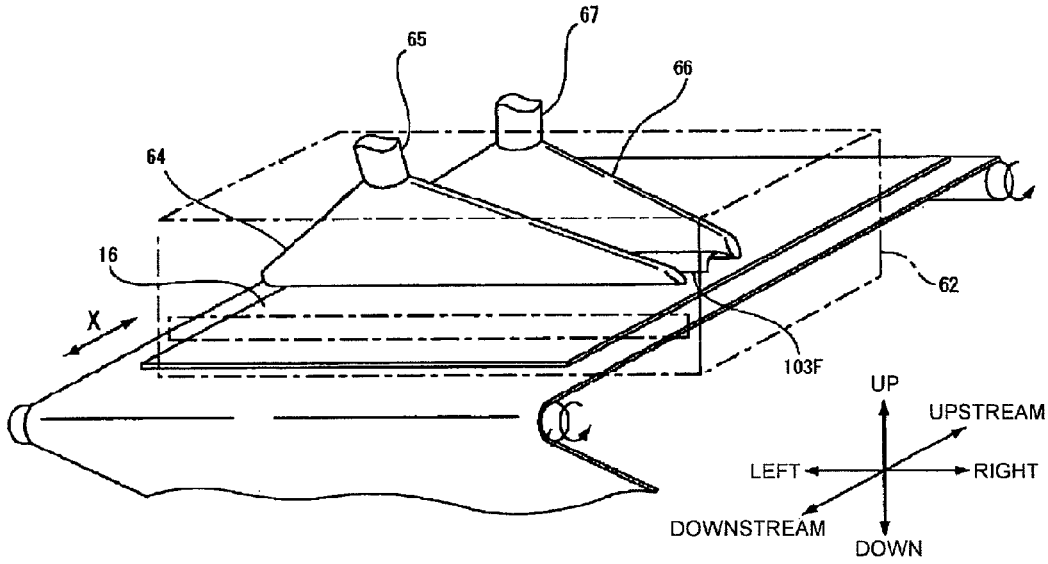
FIG. 11 is an external perspective view of a housing covering a final curing light source and a transport belt.

The present embodiment is explained in detail by reference to FIG. 11. FIG. 11 is an external perspective view showing a housing 62 covering the final curing light source 103F and the transport belt shown in FIG. 10.

As shown in FIG. 11, a gas supply nozzle 64, which is disposed downstream of the final curing light source 103F, is formed at the extremity of a gas supply pipe 65 so as to widen at the tip along the width direction of the recording medium, and opens toward the irradiation position of the final curing light source 103F.

The gas supply pipe 65 communicates with a gas storage tank and a feed pump, which are not illustrated. The gas storage tank stores a gas that is heavier than oxygen such as carbon dioxide, neon, argon, or xenon and a gas that is lighter than oxygen such as helium or nitrogen, can supply one or more types of gas as necessary, and may supply a mixed gas of a gas that is heavier than oxygen and a gas that is lighter than oxygen. The mixed gas is supplied from the gas supply nozzle 64 by the feed pump toward the center of the vicinity of the irradiation position of the final curing light source 103F above the recording medium. The proportion of the gas that is heavier than oxygen in the mixed gas is preferably 30% to 90%, and more preferably 40% to 80%.

When image formation is started by the drawing section 100A2, gas is supplied toward the center of the vicinity of the irradiation position of the final curing light source 103F above the recording medium. This enables oxygen present above the recording medium to be displaced. Since the gas is a mixed gas of a gas that is heavier than oxygen and a gas that is lighter than oxygen, oxygen does not rise or fall within the housing 62 upon supply of the mixed gas, and can be displaced efficiently. Upon supply of the gas, oxygen is excluded smoothly from above the recording medium at least in the vicinity of the irradiation position of the final curing light source 103F, thus suppressing inhibition of curing of the ink composition by oxygen in the air.

A gas collection nozzle 66 is formed at the extremity of a gas collection pipe 67 so as to widen at the tip along the width direction of the recording medium, and opens toward an image formation face of the recording medium.

The gas collection pipe 67 is communicatingly connected to a gas collection tank (not illustrated) via a suction pump. By operating this suction pump the mixed gas and the air within the housing 62 are suctioned off via the gas collection nozzle 66 and collected in the gas collection tank.

In accordance with such a constitution, normal air remains in the atmosphere around the tip of the ink composition droplet firing head outside the housing, thus suppressing ink composition discharge failure due to the ink composition sticking when the effect of inhibiting curing of the ink composition at the tip of the ink discharge nozzle is lost.

When the mixed gas is collected by the gas collection pipe 67, it is preferable to form an atmosphere of the mixed gas before starting image formation, and in this case operation of the gas collection pipe 67 is preferably started after the interior of the housing 62 is filled to some extent with the mixed gas.

When it is necessary to start up the recording device of the present embodiment quickly, the gas supply pipe 65 and the gas collection pipe 67 are operated at the same time, and reducing the amount of suction enables an atmosphere of the mixed gas to be formed within the housing 62.

In either case, when the mixed gas within the housing 62 becomes stable, supply and suction are at the same level, thus suppressing leakage of the mixed gas outside the housing 62.

Suctioning off the gas within the housing 62 via the gas collection nozzle 66 enables dust within the housing 62 to be suctioned off at the same time, and it is possible to keep the interior of the housing 62 clean. Although an active gas such as oxygen within the housing 62 is contained in the gas thus collected, it can be reused by removing such an active gas. Although it is preferable to collect the gas, if it is not harmful to the environment it may be released to the air.

Although not shown in FIG. 10 and FIG. 11, the constitution may be such that, while the gas supply nozzle 64 and the gas collection nozzle 66 are in operation, an oxygen-containing gas such as air is supplied toward the ink composition discharge nozzle tip from an oxygen-containing gas supply nozzle disposed on a side face upstream of the head unit disposed outside the housing 62. In accordance with this constitution, it is possible to supply oxygen to the atmosphere of the ink composition discharge nozzle tip of the head unit, and inhibition of curing of the ink composition acts only at the ink composition discharge nozzle tip edge, thus suppressing the occurrence of discharge failure.

Although not shown in FIG. 10, an electron beam irradiation device may be used as means for curing an ink composition comprising a polymerizable compound.

In the explanation above, examples of a UV light source and an electron beam irradiation device are illustrated as means for curing a polymerizable compound, but such means is not limited to the examples shown here, and radiation such as $\alpha$ rays, $\gamma$ rays, or X rays may be used.

The image detection section 104*c* of FIG. 10 comprises an image sensor (line sensor, etc.) for picking up an image of the results of firing droplets in the drawing section 100A2, and functions as means for checking discharge abnormalities such as nozzle clogging from an image read by the image sensor.

The buffer 104 as a buffer section is present between the inkjet recording section 100A and the post-treatment section 100B. The recording medium that has been subjected to inkjet recording passes through the buffer 104, which comprises several upper rollers 104*a* and several lower rollers 104*b*, while going up and down several times therebetween. The buffer 104 is an adjustment section for absorbing a difference in operating speed (transport speed for the recording medium 16) between the upstream inkjet recording section 100A and the downstream post-treatment section 10B, which will be described later.

There is a varnish coater 105 downstream of the buffer 104. Thinly coating the surface of a label with a varnish by means of the varnish coater 105 allows the abrasion resistance of the label surface to be improved.

A label cutting section 106 downstream of the varnish coater 105 comprises a marking reader 106*a*, a die cutter driver 106*b*, a die cutter 106*c* provided with a scroll having a blade (blade-quipped plate) 106*e*, and an opposing roller 106*d*.

Labels cut by the die cutter 106*c* of the label cutting section 106 are wound as a label product by the label wind-up section 109 downstream of a branching roller 107, and residue other than the above is peeled off and disposed of as waste in a residue removal section 108.

Structure of Droplet Firing Head

Figure 12A:
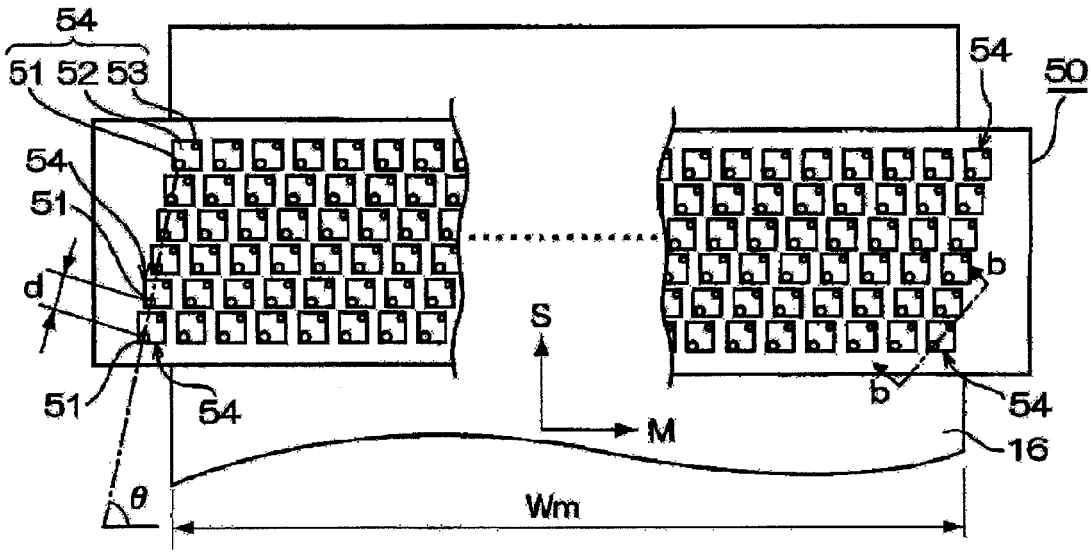
FIG. 12A is a plan view showing an example of the basic overall structure of a droplet firing head of FIG. 10.

FIG. 12A is a plan hidden line drawing showing one example of the basic overall structure of a droplet firing head 50, in which a representative droplet firing head among the droplet firing heads shown in FIG. 10 is denoted by reference numeral 50.

The droplet firing head 50 shown as one example in FIG. 12A is a so-called full-line head, and has a structure in which a large number of nozzles 51 (liquid discharge orifices) for discharging a liquid toward the recording medium 16 are arranged two-dimensionally throughout a length corresponding to a width Wm of the recording medium 16 in a direction (main scanning direction shown by arrow M in the figure) perpendicular to the transport direction (sub scanning direction shown by arrow S in the figure) of the recording medium 16.

In the droplet firing head 50, a plurality of pressure chamber units 54 comprising the nozzle 51, a pressure chamber 52 communicating with the nozzle 51, and a liquid supply opening 53 are arranged in two directions, that is, the main scanning direction M and a direction diagonal to the main scanning direction M by a predetermined acute angle $\theta$ (0 degrees $<\theta<$90 degrees). In FIG. 12A, for convenience of drawing, only some of the pressure chamber units 54 are illustrated.

Specifically, the nozzles 51 are arranged at a constant pitch d in the direction diagonal to the main scanning direction M by the predetermined angle $\theta$, and they can be treated as being equivalent to ones arranged on a straight line along the main scanning direction M at intervals of '$d\times\cos\theta$'.

Figure 12B:
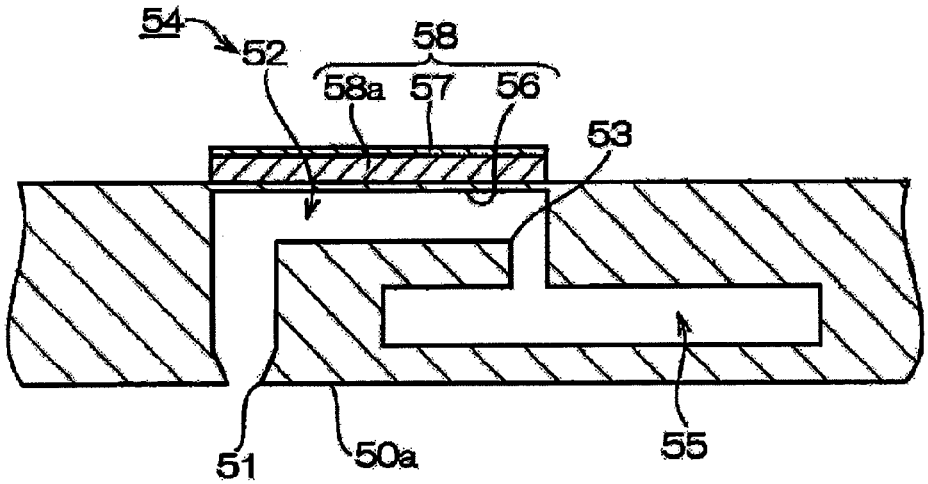
FIG. 12B is a sectional view along line b-b in FIG. 12A.

The pressure chamber unit 54 as one discharge element forming the droplet firing head 50 is shown in FIG. 12B, which is a sectional view along line b-b in FIG. 12A.

As shown in FIG. 12B, each pressure chamber 52 communicates with a common liquid chamber 55 via the liquid supply opening 53. The common liquid chamber 55 communicates with a tank as a liquid supply source (not illustrated), and a liquid supplied from the tank is distributed and supplied to each pressure chamber 52 via the common liquid chamber 55.

A piezoelectric body 58*a* is disposed on a diaphragm 56 forming a top face of the pressure chamber 52, and a discrete electrode 57 is disposed on the piezoelectric body 58*a*. The diaphragm 56 is grounded and functions as a common electrode. The diaphragm 56, the discrete electrode 57, and the piezoelectric body 58*a* form a piezoelectric actuator 58 as means for generating a liquid discharge force.

When a predetermined drive voltage is applied to the discrete electrode 57 of the piezoelectric actuator 58, the piezoelectric body 58*a* deforms, the volume of the pressure chamber 52 changes, and an accompanying change in pressure within the pressure chamber 52 allows a liquid to be discharged from the nozzle 51. After the liquid is discharged, the volume of the pressure chamber 52 returns to its original volume, and fresh liquid is supplied to the pressure chamber 52 from the common liquid chamber 55 via the liquid supply opening 53.

FIG. 12A shows a case in which a plurality of nozzles 51 are arranged two-dimensionally as a structure that enables a high resolution image to be formed on the recording medium 16 at high speed, but the droplet firing head of the present invention is not particularly limited to a structure in which a plurality of nozzles 51 are arranged two-dimensionally, and it may be a structure in which a plurality of nozzles 51 are arrange one-dimensionally. Furthermore, the pressure chamber unit 54 shown in FIG. 12B as a discharge element forming the droplet firing head is only one example, and it is not limited to this case. For example, instead of disposing the common liquid chamber 55 beneath the pressure chamber 52 (that is, toward a discharge face 50*a* side rather than the pressure chamber 52), the common liquid chamber 55 may be disposed above the pressure chamber 52 (that is, on the side opposite to the discharge face 50*a*). Furthermore, a liquid discharge force may be generated using a heating body instead of the piezoelectric body 58*a*.

In the inkjet recording system that can be used in the present invention, as means for applying an undercoat liquid onto a recording medium, means other than coating, such as discharging an undercoat liquid from a nozzle, may be used.

Equipment used for the coating is not particularly limited, and known coating equipment may selected appropriately according to an intended application. Examples thereof include an air doctor coater, a blade coater, a rod coater, an knife coater, a squeegee coater, a dip coater, a reverse roll coater, a transfer roll coater, a gravure coater, a kiss roll coater, a cast coater, a spray coater, a curtain coater, and an extrusion coater.

Liquid Supply System

Figure 13:
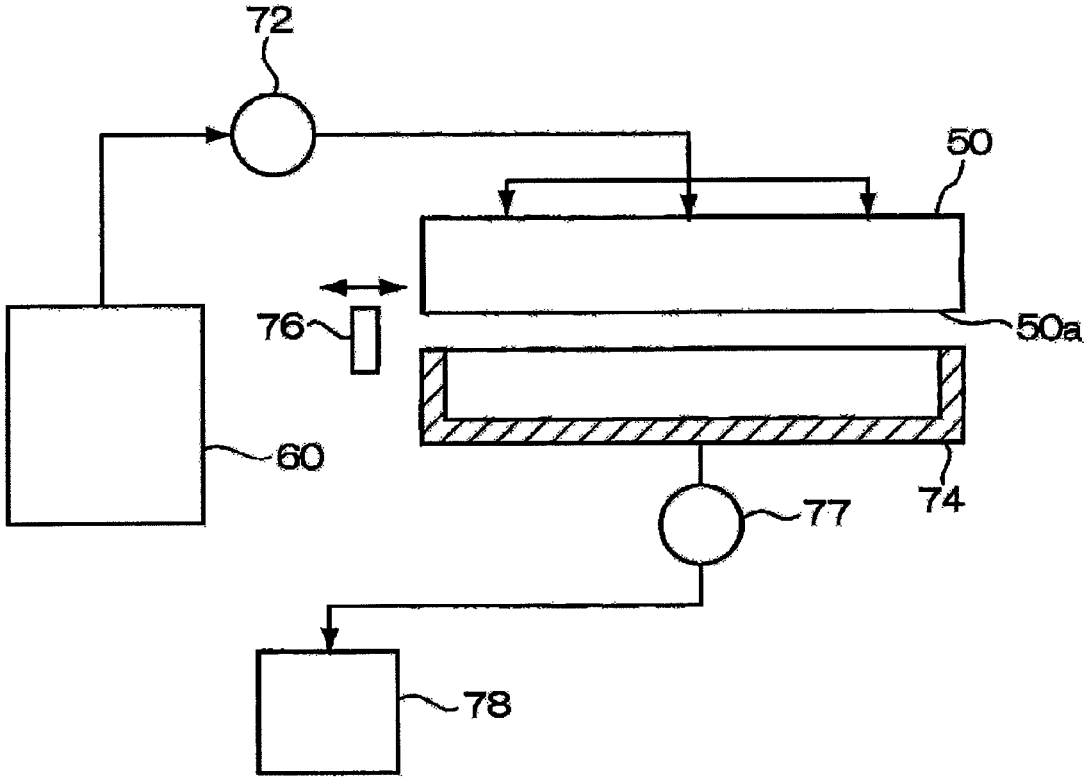
FIG. 13 is a schematic drawing showing an example of the constitution of a liquid supply system constituting the image recording system.

FIG. 13 is a schematic view showing the constitution of a liquid supply system in the image recording system 100.

A liquid tank 60 is a base tank for supplying a liquid to the droplet firing head 50. A liquid supply pump 72 for feeding the liquid from the liquid tank 60 to the droplet firing head 50 is provided partway along a pipe providing communication between the liquid tank 60 and the droplet firing head 50. The liquid tank 60, the droplet firing head 50, and the pipe providing communication therebetween as well as an ink therewithin are preferably temperature-controlled by temperature detection means and a heater. The ink temperature is preferably adjusted to 40° C. to 80° C. in this case.

Moreover, the image recording system 100 is provided with a cap 74 as means for preventing drying of a meniscus of the nozzle 51 or preventing an increase in viscosity of the vicinity of the meniscus during a long term discharge suspension period, and a cleaning blade 76 as means for cleaning the discharge face 50*a*. A maintenance unit comprising the cap 74 and the cleaning blade 76 can be moved relative to the droplet firing head 50 by a movement mechanism (not illustrated), and is moved as necessary from a predetermined retracted position to a maintenance position beneath the droplet firing head 50.

The cap 74 is raised/lowered relative to the droplet firing head 50 by a raise/lower mechanism (not illustrated). The raise/lower mechanism raises the cap 74 to a predetermined raised position, and by making it come into contact with the droplet firing head 50 at least a nozzle region of the discharge face 50*a* is covered by the cap 74.

Preferably, the inside of the cap 74 is divided into a plurality of areas corresponding to the nozzle lines by dividing walls, and each area thus divided can be selectively suctioned by means of a selector, etc.

The cleaning blade 76 is formed from a resilient member such as rubber, and can be made to slide on the discharge face 50*a* of the droplet firing head 50 by a cleaning blade movement mechanism (not illustrated). When a liquid droplet or foreign matter adheres to the discharge face 50*a*, sliding the cleaning blade 76 on the discharge face 50*a* allows the discharge face 50*a* to be wiped off and cleaned.

In a state in which the discharge face 50*a* of the droplet firing head 50 is covered by the cap 74, a suction pump 77 suctions off liquid from the nozzle 51 of the droplet firing head 50 and feeds the liquid thus suctioned to a collection tank 78.

Such a suction operation is carried out not only when the liquid tank 60 is loaded on the image recording system 100 and the droplet firing head 50 is charged with a liquid from the liquid tank 60 (when initially charging) but also when a liquid whose viscosity has increased after long term suspension is removed (resumption after long term suspension).

With regard to discharge from the nozzle 51, there is firstly normal discharge in which it is carried out toward a recording medium such as a paper in order to form an image on the recording medium, and secondly there is purging in which it is carried out toward the cap 74 using the cap 74 as a liquid receptor.

When the nozzle 51 of the droplet firing head 50 or the interior of the pressure chamber 52 is contaminated with bubbles or when the viscosity within the nozzle 51 increases beyond a certain level, since liquid cannot be discharged from the nozzle 51 by purging, an operation in which the liquid contaminated by bubbles within the pressure chamber 52 of the droplet firing head 50 or the liquid whose viscosity has increased is suctioned off by the suction pump 77 while abutting the cap 74 against the discharge face 50*a* of the droplet firing head 50 is carried out.

It is preferable that the droplet firing head 50, the liquid tank 60, the liquid supply pump 72, the cap 74, the cleaning blade 76, the suction pump 77, the collection tank 78, an ink passage connecting the above, and members and equipment with which ink is in direct contact have resistance to dissolution and resistance to swelling. It is also preferable that these members and equipment have light shielding properties.

Control System

Figure 14:
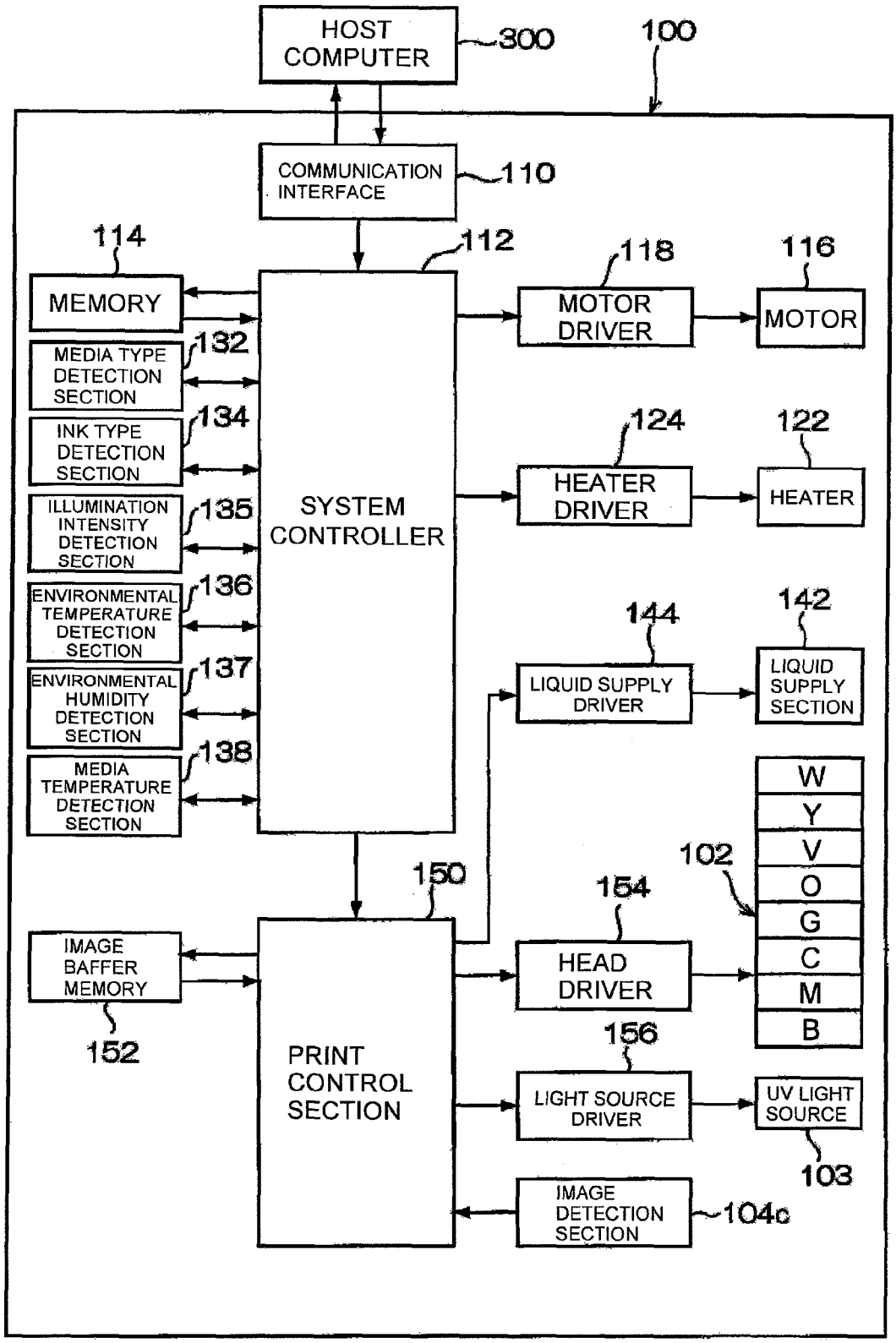
FIG. 14 is the block diagram showing an example of the constitution of a control system constituting the image recording system.

FIG. 14 is a main section block diagram showing the system constitution of the image recording system 100.

In FIG. 14, the image recording system 100 comprises primarily a drawing section 102, an image detection section 104*c*, a UV light source 103, a communication interface 110, a system controller 112, a memory 114, an image buffer memory 152, a transport motor 116, a motor driver 118, a heater 122, a heater driver 124, a media type detection section 132, an ink type detection section 134, an illumination intensity detection section 135, an environmental temperature detection section 136, an environmental humidity detection section 137, a media temperature detection section 138, a liquid supply section 142, a liquid supply driver 144, a print control section 150, a head driver 154, and a light source driver 156.

The drawing section 102 representatively denotes the droplet firing heads 102W, 102C, 102M, 102V, 102G, 102O, 102Y, and 102B shown in FIG. 10, the UV light source 103 representatively denotes the curing light sources 103P, 103W, 103C, 103M, 103V, 103G, 103O, 103Y, and 103F shown in FIG. 10, and the image detection section 104*c* is the same as that described for FIG. 10, explanation thereof therefore being omitted here.

The communication interface 110 is image data input means that receives image data transmitted from a host computer 300. As the communication interface 110, a wired or wireless interface such as USB (Universal Serial Bus) or IEEE1394 may be employed. The image data inputted into the image recording system 100 via the communication interface 110 are first stored in a first memory 114 for storing image data.

The system controller 112 is formed from a central processing unit (CPU) and its peripheral circuits, etc., and is main control means for controlling the overall image recording system 100 in accordance with a predetermined program pre-stored in the first memory 114. That is, the system controller 112 controls sections such as the communication interface 110, the motor driver 118, the heater driver 124, the media type detection section 132, the ink type detection section 134, and the print control section 150.

The transport motor 116 provides power to a roller or a belt for transporting a recording medium. This transport motor 116 moves the recording medium relative to the droplet firing head 50 forming the drawing section 102. The motor driver 118 is a circuit for driving the transport motor 116 in accordance with instructions from the system controller 112.

The heater driver 124 is a circuit for driving the heater 122 (or a cooling element) (not illustrated), and maintains the temperature of the recording medium at a constant temperature. The heater driver 124 is a circuit for driving the heater 122 in accordance with instructions from the system controller 112.

The media type detection section 132 detects the type of recording medium. There are various detection modes for the type of recording medium. For example, there are a mode in which detection is carried out by providing a sensor in a paper feed section (not illustrated), a mode in which it is inputted by a user operation, a mode in which it is inputted from the host computer 300, and a mode in which detection is carried out automatically by analyzing image data (e.g. resolution or color) or additional data of the image data inputted from the host computer 300.

The ink type detection section 134 detects the type of ink. There are various modes for detecting the type of ink. For example, there are a mode in which detection is carried out by providing a sensor in a liquid storage/loading section (not illustrated), a mode in which it is inputted by a user operation, a mode in which it is inputted from the host computer 300, and a mode in which detection is carried out automatically by analyzing image data (e.g. resolution or color) or additional data of the image data inputted from the host computer 300.

The illumination intensity detection section 135 detects illumination intensity of UV rays emitted from the UV light source 103. As a mode for detecting illumination intensity, there is for example a mode in which detection is carried out by providing an illumination intensity sensor in the vicinity of the UV light source 103 in FIG. 10. The output of the UV light source is feedback-controlled based on an output from the illumination intensity sensor.

The environmental temperature detection section 136 detects the temperature of the outside air or of the interior of the image recording system. As an environmental temperature detection mode, there is for example a mode in which detection is carried out by providing a temperature sensor outside the system or inside the system.

The environmental humidity detection section 137 detects the humidity of the outside air or of the interior of the image recording system. As an environmental humidity detection mode, there is for example a mode in which detection is carried out by providing a humidity sensor outside the system or inside the system.

The media temperature detection section 138 detects the temperature of the recording medium when an image is formed. There are various modes for detecting the temperature of the medium. For example, there are a mode in which detection is carried out by providing a contact type temperature sensor and a mode in which a non-contact type temperature sensor is provided above the recording medium 16, and the temperature of the recording medium is kept constant by the heater 122.

The liquid supply section 142 comprises a pipe for making the ink flow from the liquid tank 60 of FIG. 13 to the drawing section 102, the liquid supply pump 72, etc.

The liquid supply driver 144 is a circuit for driving the liquid supply pump 72, etc. forming the liquid supply section 142 so that a liquid is supplied to the drawing section 102.

The print control section 150 produces data (droplet firing data) necessary for each droplet firing head 50 forming the drawing section 102 to discharge (fire droplets) toward the recording medium, based on image data inputted into the image recording system 100. That is, the print control section 150 functions as image processing means that carries out image processing such as various types of processing and correction in order to produce droplet firing data from the image data in the first memory 114 in accordance with control by the system controller 112, and supplies the droplet firing data thus produced to the head driver 154.

The print control section 150 is accompanied by a second memory 152, and droplet firing data, etc. are temporarily stored in the second memory 152 when the print control section 150 carries out image processing.

In FIG. 14, the second memory 152 is shown as a mode in which it accompanies the print control section 150, but its function may be carried out by the first memory 114. It is also possible to employ a mode in which the print control section 150 and the system controller 112 are integrated and formed from one processor.

The head driver 154 outputs a discharge drive signal to each droplet firing head 50 forming the drawing section 102 based on the droplet firing data given from the print control section 150 (in practice, droplet firing data stored in the second memory 152). A liquid (liquid droplets) is discharged from the droplet firing head 50 toward the recording medium by the discharge drive signal outputted from the head driver 154 being given to each droplet firing head 50 (specifically, the actuator 58 shown in FIG. 12B).

The light source driver 156 is a circuit that controls the voltage, time, and timing inputted into the UV light source 103 based on instructions from the print control section 150, an illumination intensity detected by the illumination intensity detection section 135, an environmental temperature detected by the environmental temperature detection section 136, an environmental humidity detected by the environmental humidity detection section 137, and a medium temperature detected by the media temperature detection section 138, and drives the UV light source 103.

In accordance with the present invention, there can be provided an inkjet recording method that (1) can ensure a color gamut equal to the PANTONE color gamut, (2) has excellent image fixation (rapid drying), and (3) is suitable as a single pass system recording method.

EXAMPLES

The present invention is explained below in further detail by reference to Examples, but the present invention is not limited thereto. Materials used in the present invention are as described below.

List of Materials Used

Violet pigment A: C.I. Pigment Violet 23 (HOSTAPERM VIOLET RL-NF; Clariant)

Orange pigment A: C.I. Pigment Orange 36 (KENALAKE ORANGE HPRLO; Albion Colors)

Green pigment A: C.I. Pigment Green 7 (HEUCO GREEN 600703K; Heubach GmbH)

Cyan pigment A: C.I. Pigment Blue 15:3 (IRGALITE BLUE GLO; Ciba Specialty Chemicals)

Magenta pigment A: CINQUASIA MAGENTA RT-355D; Ciba Specialty Chemicals)

Yellow pigment A: C.I. Pigment Yellow 155 (NOVOPERM YELLOW 4G; Clariant)

White pigment: titanium oxide (Tipaque CR60-2; Ishihara Sangyo Kaisha Ltd.)

Black pigment: carbon black (SPECIAL BLACK 250; Degussa)

Dispersant A: Solsperse 32000 (Noveon)

Dispersant B: BYK-168 (BYK-Chemie)

Polyfunctional monomer A: DPGDA (dipropylene glycol diacrylate; Daicel-Cytec Company Ltd.)

Polyfunctional monomer B: A-TMPT (trimethylolpropane triacrylate; Shin-Nakamura Chemical Co., Ltd.)

PEA (phenoxyethyl acrylate (monofunctional monomer); Dai-ichi Kogyo Seiyaku Co., Ltd.)

Surfactant A: BYK-307 (surfactant, BYK-Chemie)

Polymerization inhibitor A: FIRSTCURE ST-1 (Albemarle)

Initiator A: 2,2-dimethoxy-1,2-diphenylethane-1-one

Initiator B: 1-hydroxycyclohexyl phenyl ketone

Initiator C: benzophenone

Initiator D: 2,4,6-trimethylbenzoyldiphenylphosphine oxide (acylphosphine oxide)

Initiator E: 2,4,6-trimethylbenzoyidiphenylphosphate (acylphosphine oxide)

Initiator F: 1-[4-(2-hydroxyethoxy)phenyl]-2-hydroxy-2-methyl-2-propan-1-one

Sensitizer A: Speedcure ITX (mixture of 2-isopropylthioxanthone and 4-isopropylthioxanthone; Lambson)

Image Recording System

An inkjet printer (equipped with heads manufactured by Toshiba Tec Corporation having a droplet firing frequency of 6.2 KHz, a number of nozzles of 636, a nozzle density of 300 npi (nozzles/inch, the same applies below), and a drop size variable in 7 stages from 6 pL to 42 pL with two heads arranged to give 600 npi, six sets of these heads being arranged in a full line as a head set) was charged with colored liquids prepared above.

The heads were fixed to a machine body in the order white, cyan, magenta, violet, green, orange, yellow, and black from upstream in the transport direction of a recording medium, and a roll coater and a semi-curing light source for an undercoat liquid were installed further upstream of the white ink head. As the undercoat liquid here, the undercoat liquids (U1 to U5) were used.

The construction was such that the recording medium was able to move immediately beneath the head, a pinning light source (semi-curing light source) was installed in the advancing direction of the recording medium for each of the white, cyan, magenta, violet, green, orange, and yellow, heads charged with the colored liquids, and five metal halide lamps (light intensity 3,200 mW/cm$^2$) were installed downstream of the black ink head.

As the semi-curing light source and the pinning light source (semi-curing light source for ink composition), an LED light source was used. An NCCU033 manufactured by Nichia Corporation was employed as the LED. This LED outputs UV rays at 340 nm to 400 nm with a center wavelength of 365 nm from 1 chip, and by applying a current of about 500 mA, about 100 mW of light is emitted from the chip. A plurality of LEDs were arranged at intervals of 7 mm, and the current and the distance between the light source and a recording medium were adjusted so that the exposure intensity on the surface of the recording medium was about 100 mW/cm$^2$.

The irradiation energy of the metal halide lamps could be adjusted from 350 to 1,750 mJ/cm$^2$ by the number of metal halide lamps that were switched ON. Specifically, it was 350 mJ/cm$^2$ (1 lamp ON), 700 mJ/cm$^2$ (2 lamps ON), 1050 mJ/cm$^2$ (3 lamps ON), 1,400 mJ/cm$^2$ (4 lamps ON), and 1,750 mJ/cm$^2$ (5 lamps ON).

Transport of a recording medium was carried out by roll transport, and a 600 dpi×600 dpi image was formed on the recording medium. The recording medium used here was a plastic film (white polyethylene).

Preparation of Pigment Dispersions

Components shown in Table 1 were mixed, and stirred using a stirrer for 1 hour. After stirring, the mixtures were dispersed by means of a bead mill disperser, thus giving pigment dispersions A. Dispersion was carried out under conditions of 0.65 mm diameter zirconia beads packed at a packing ratio of 70%, a peripheral speed of 9 m/s, and a dispersion time of 2 to 4 hours.

TABLE 1

| | Cyan pigment A | Magenta pigment A | Yellow pigment A | Violet pigment A | Orange pigment A | Green pigment A | Black pigment A | White pigment A | Dispersant A | Dispersant B | Polymerizable compound |
|---|---|---|---|---|---|---|---|---|---|---|---|
| Cyan pigment dispersion A | 30 | — | — | — | — | — | — | — | — | 20 | 50 |
| Magenta pigment dispersion A | — | 30 | — | — | — | — | — | — | — | 20 | 50 |
| Yellow pigment dispersion A | — | — | 30 | — | — | — | — | — | — | 20 | 50 |
| Violet pigment dispersion A | — | — | — | 20 | — | — | — | — | 8 | — | 72 |
| Orange pigment dispersion A | — | — | — | — | 30 | — | — | — | 12 | — | 68 |
| Green pigment dispersion A | — | — | — | — | — | 30 | — | — | 8 | — | 72 |
| Black pigment dispersion A | — | — | — | — | — | — | 30 | — | 8 | — | 72 |
| White pigment dispersion A | — | — | — | — | — | — | — | 40 | 12 | — | 48 |

As the polymerizable compound, PEA (phenoxyethyl acrylate; Dai-ichi Kogyo Seiyaku Co., Ltd.) was used.

Example 1

Components shown in Table 2 (units: parts by weight) were stirred, mixed, and dissolved to give an undercoat liquid and inks of each color. The surface tension of the undercoat liquid and inks was measured at a liquid temperature of 25° C. by the Wilhelmy method using a surface tensiometer (e.g. a CBVP-Z surface tensiometer manufactured by Kyowa Interface Science Co., Ltd.). Values measured for the surface tension of the colored liquids were all in the range of 25 to 26 mN/m, and values measured for the surface tension of the undercoat liquid was in the range of 22 to 23 mN/m.

(2) After the undercoat liquid (U1) was applied, it was exposed to light using the semi-curing light source (light intensity 100 mW/cm$^2$), thus semi-curing the undercoat liquid (U1) applied.

(3) A white colored liquid (W1) was applied using the white head on top of the recording medium having the undercoat liquid applied thereto, thus forming a white image.

(4) Exposure to light was carried out using the pinning light source (light intensity 100 mW/cm$^2$), thus semi-curing the white colored liquid.

(5) A cyan colored liquid (C1) was applied on top of the recording medium using the cyan head, thus forming a cyan image.

TABLE 2

| Composition | | Composition (parts by weight) | M1 | C1 | Y1 | V1 | O1 | G1 | Bk1 | W1 | U1 |
|---|---|---|---|---|---|---|---|---|---|---|---|
| Pigment dispersion | | Magenta pigment dispersion A | 19.5 | — | — | — | — | — | — | — | — |
| | | Cyan pigment dispersion A | — | 7.2 | — | — | — | — | — | — | — |
| | | Yellow pigment dispersion A | — | — | 15.6 | — | — | — | — | — | — |
| | | Violet pigment dispersion A | — | — | — | 15 | — | — | — | — | — |
| | | Orange pigment dispersion A | — | — | — | — | 16 | — | — | — | — |
| | | Green pigment dispersion A | — | — | — | — | — | 15 | — | — | — |
| | | Black pigment dispersion A | — | — | — | — | — | — | 8.3 | — | — |
| | | White pigment dispersion A | — | — | — | — | — | — | — | 40 | — |
| Monomer | DPGDA | Polyfunctional monomer A | 67.3 | 79.2 | 71.2 | 73.8 | 72.4 | 73.8 | 78.5 | 46.8 | 91.9 |
| | A-TMPT | Polyfunctional monomer B | 1 | 1 | 1 | 1 | 1 | 1 | 1 | 1 | 1 |
| W agent | BYK-307 | Surfactant A | 0.1 | 0.1 | 0.1 | 0.1 | 0.1 | 0.1 | 0.1 | 0.1 | 1 |
| Inhibitor | ST-1 | Inhibitor A | 0.1 | 0.5 | 0.1 | 0.1 | 0.5 | 0.1 | 0.1 | 0.1 | 0.1 |
| Initiator | BP | Initiator C | 2 | 2 | 2 | 2 | 2 | 2 | 2 | 2 | 3 |
| | TPO | Initiator D | 6 | 6 | 6 | 6 | 6 | 6 | 6 | 6 | 3 |
| | Irg 184 | Initiator B | 2 | 2 | 2 | 2 | 2 | 2 | 2 | 2 | — |
| Sensitizer | ITX | Sensitizer A | 2 | 2 | 2 | — | — | — | 2 | 2 | — |
| | | Surface tension (mN/m) | 25.4 | 25.5 | 25.3 | 25.5 | 25.6 | 25.5 | 25.3 | 25.7 | 22.2 |

An image was formed on a plastic film A (white polyethylene) and a plastic film B (transparent polyethylene) using the above-mentioned image recording system in accordance with the procedure described below, thus giving a printed material.

The printing procedure involved (1) to (17) below.

(1) An undercoat liquid (U1) was uniformly applied at a thickness of 5 μm by the roll coater (coating speed 400 mm/s).

(6) Exposure to light was carried out using the pinning light source (light intensity 100 mW/cm$^2$), thus semi-curing the cyan colored liquid.

(7) A magenta colored liquid (M1) was applied on top of the recording medium using the magenta head, thus forming a magenta image.

(8) Exposure to light was carried out using the pinning light source (light intensity 100 mW/cm$^2$), thus semi-curing the magenta colored liquid.

(9) A violet colored liquid (V1) was applied on top of the recording medium using the violet head, thus forming a violet image.

(10) Exposure to light was carried out using the pinning light source (light intensity 100 mW/cm$^2$), thus semi-curing the violet colored liquid.

(11) A green colored liquid (G1) was applied on top of the recording medium using the green head, thus forming a green image.

(12) Exposure to light was carried out using the pinning light source (light intensity 100 mW/cm$^2$), thus semi-curing the green colored liquid.

(13) An orange colored liquid (O1) was applied on top of the recording medium using the orange head, thus forming an orange image.

(14) Exposure to light was carried out using the pinning light source (light intensity 100 mW/cm$^2$), thus semi-curing the orange colored liquid.

(15) A yellow colored liquid (Y1) was applied using the yellow head on top of the recording medium, thus forming a yellow image.

(16) A black colored liquid (B1) was applied on top of the recording medium using the black head, thus forming a black image.

(17) Exposure to light was carried out using the metal halide lamp (light intensity 3,200 mW/cm$^2$), thus completely curing the image. The exposure energy was adjusted from 350 to 1,750 mJ/cm$^2$ by the number of metal halide lamps switched ON.

The transport speed for the recording medium here was 400 mm/s, and the amount of colored liquid per dot was about 12 pL. When a tertiary color (e.g. cyan, magenta, and yellow) image was formed, (9) to (14) were omitted from the above-mentioned procedure. When a secondary color (e.g. cyan and magenta) image was formed, (9) to (16) were omitted from the above-mentioned procedure. When a primary color (e.g. cian) image was formed, (7) to (16) were omitted from the above-mentioned procedure.

Example 2

An image was formed using the same undercoat liquid and inkset the same way except that the procedure of the image formation was changed.

An image was formed on a plastic film A (white polyethylene) and a plastic film B (transparent polyethylene) using the above-mentioned image recording system in accordance with the procedure described below, thus giving a printed material.

The printing procedure involved (1) to (18) below.

(1) An undercoat liquid (U1) was uniformly applied at a thickness of 5 μm by the roll coater (coating speed 400 mm/s).

(2) After the undercoat liquid (U1) was applied, it was exposed to light using the semi-curing light source (light intensity 100 mW/cm$^2$), thus semi-curing the undercoat liquid (U1) applied.

(3) A white colored liquid (W1) was applied using the white head on top of the recording medium having the undercoat liquid applied thereto, thus forming a white image.

(4) Exposure to light was carried out using the pinning light source (light intensity 100 mW/cm$^2$), thus semi-curing the white colored liquid.

(5) A yellow colored liquid (Y1) was applied using the yellow head on top of the recording medium, thus forming a yellow image.

(6) Exposure to light was carried out using the pinning light source (light intensity 100 mW/cm$^2$), thus semi-curing the yellow colored liquid.

(7) A cyan colored liquid (C1) was applied on top of the recording medium using the cyan head, thus forming a cyan image.

(8) Exposure to light was carried out using the pinning light source (light intensity 100 mW/cm$^2$), thus semi-curing the cyan colored liquid.

(9) A magenta colored liquid (M1) was applied on top of the recording medium using the magenta head, thus forming a magenta image.

(10) Exposure to light was carried out using the pinning light source (light intensity 100 mW/cm$^2$), thus semi-curing the magenta colored liquid.

(11) A violet colored liquid (V1) was applied on top of the recording medium using the violet head, thus forming a violet image.

(12) Exposure to light was carried out using the pinning light source (light intensity 100 mW/cm$^2$), thus semi-curing the violet colored liquid.

(13) A green colored liquid (G1) was applied on top of the recording medium using the green head, thus forming a green image.

(14) Exposure to light was carried out using the pinning light source (light intensity 100 mW/cm$^2$), thus semi-curing the green colored liquid.

(15) An orange colored liquid (O1) was applied on top of the recording medium using the orange head, thus forming an orange image.

(16) Exposure to light was carried out using the pinning light source (light intensity 100 mW/cm$^2$), thus semi-curing the orange colored liquid.

(17) A black colored liquid (B1) was applied on top of the recording medium using the black head, thus forming a black image.

(18) Exposure to light was carried out using the metal halide lamp (light intensity 3,200 mW/cm$^2$), thus completely curing the image. The exposure energy was adjusted from 350 to 1,750 mJ/cm$^2$ by the number of metal halide lamps switched ON.

The transport speed for the recording medium here was 400 mm/s, and the amount of colored liquid per dot was about 12 pL.

Comparative Example 1

Inks were prepared using components shown in Table 3 by the same method as in Example 1.

The drawing procedure was the same as that of Example 1 except that an undercoat was not used.

TABLE 3

| Composition | | Composition (parts by weight) | M2 | C2 | Y2 | V2 | O2 | G2 | Bk2 | W2 |
|---|---|---|---|---|---|---|---|---|---|---|
| Pigment dispersion | | Magenta pigment dispersion A | 19.5 | — | — | — | — | — | — | — |
| | | Cyan pigment dispersion A | — | 7.2 | — | — | — | — | — | — |
| | | Yellow pigment dispersion A | — | — | 15.6 | — | — | — | — | — |
| | | Violet pigment dispersion A | — | — | — | 15 | — | — | — | — |
| | | Orange pigment dispersion A | — | — | — | — | 16 | — | — | — |
| | | Green pigment dispersion A | — | — | — | — | — | 15 | — | — |
| | | Black pigment dispersion A | — | — | — | — | — | — | 8.3 | — |
| | | White pigment dispersion A | — | — | — | — | — | — | — | 40 |
| Monomer | DPGDA | Polyfunctional monomer A | 67.3 | 79.2 | 71.2 | 73.8 | 72.4 | 73.8 | 78.5 | 46.8 |
| | A-TMPT | Polyfunctional monomer B | 1 | 1 | 1 | 1 | 1 | 1 | 1 | 1 |
| W agent | BYK-307 | Surfactant A | 0.1 | 0.1 | 0.1 | 0.1 | 0.1 | 0.1 | 0.1 | 0.1 |
| Inhibitor | ST-1 | Inhibitor A | 0.1 | 0.5 | 0.1 | 0.1 | 0.5 | 0.1 | 0.1 | 0.1 |
| Initiator | BP | Initiator C | 2 | 2 | 2 | 2 | 2 | 2 | 2 | 2 |
| | TPO | Initiator D | 6 | 6 | 6 | 6 | 6 | 6 | 6 | 6 |
| | Irg 184 | Initiator B | 2 | 2 | 2 | 2 | 2 | 2 | 2 | 2 |
| Sensitizer | ITX | Sensitizer A | 2 | 2 | 2 | — | — | — | 2 | 2 |
| | | Surface tension (mN/m) | 25.4 | 25.5 | 25.3 | 25.5 | 25.6 | 25.5 | 25.3 | 25.7 |

Comparative Example 2

Inks were prepared using components shown in Table 4 by the same method as in Example 1.

The drawing procedure was the same as that of Example 1 except that violet, orange, and green inks were not used.

TABLE 4

| Composition | | Composition (parts by weight) | M1 | C1 | Y1 | U1 |
|---|---|---|---|---|---|---|
| Pigment dispersion | | Magenta pigment dispersion A | 19.5 | — | — | — |
| | | Cyan pigment dispersion A | — | 7.2 | — | — |
| | | Yellow pigment dispersion A | — | — | 15.6 | — |
| Monomer | DPGDA | Polyfunctional monomer A | 67.3 | 79.2 | 71.2 | 91.9 |
| | A-TMPT | Polyfunctional monomer B | 1 | 1 | 1 | 1 |
| W agent | BYK-307 | Surfactant A | 0.1 | 0.1 | 0.1 | 1 |
| Inhibitor | ST-1 | Inhibitor A | 0.1 | 0.5 | 0.1 | 0.1 |
| Initiator | BP | Initiator C | 2 | 2 | 2 | 3 |
| | TPO | Initiator D | 6 | 6 | 6 | 3 |
| | Irg 184 | Initiator B | 2 | 2 | 2 | — |
| Sensitizer | ITX | Sensitizer A | 2 | 2 | 2 | — |
| | | Surface tension (mN/m) | 25.4 | 25.5 | 25.3 | 22.2 |

Checking Semi-Cured State

The maximum amount (weight) of colored liquid applied per unit area in the image drawing step in the Examples and Comparative Examples was in the range of 0.74 mg/cm$^2$ to 0.87 mg/cm$^2$ for each colored liquid.

When the amount of undercoat liquid transferred was measured by the transfer test by pulling out a sample after exposure to the semi-curing light source and exposure to the pinning light source, it was in the range of 0.10 mg/cm$^2$ to 0.12 mg/cm$^2$ for all of the steps.

Therefore, with respect to the amount (weight) transferred M (undercoat liquid) per unit area of the undercoat liquid layer and the maximum weight m (colored liquid) of the colored liquid discharged per unit area, the relationship $$\{m(\text{colored liquid})/10\}<\{M(\text{undercoat liquid})\}<m\{(\text{colored liquid})/5\}$$

was satisfied.

Moreover, in Example 1, the amount of cyan colored liquid transferred after exposure to the pinning light source in Step (4), the amount of magenta colored liquid transferred after exposure to the pinning light source in Step (6), the amount of magenta colored liquid transferred after exposure to the pinning light source in Step (8), the amount of violet colored liquid transferred after exposure to the pinning light source in Step (10), and the amount of green colored liquid transferred after exposure to the pinning light source in Step (12) were measured by the transfer test by pulling out a sample after each step. For all of the colored liquids, the amount transferred per unit area was in the range of 0.10 mg/cm$^2$ to 0.12 mg/cm$^2$.

Therefore, in combinations of colored liquids having different hues, with respect to the weight M (colored liquid A) per unit area of the uncured part of colored liquid A previously applied on top of the recording medium and the maximum weight m (colored liquid B) of subsequently applied colored liquid B per unit area, the relationship $$\{m(\text{colored liquid } B)/10\}<\{M(\text{colored liquid } A)\}<\{m(\text{colored liquid } B)/5\}$$

was satisfied.

The transfer test was carried out using, as a permeable medium, plain paper (C2 photocopy paper manufactured by Fuji Xerox Co., Ltd., product code V436). The plain paper was pressed with a uniform force (500 to 1,000 mN/cm$^2$) against the semi-cured undercoat liquid or semi-cured colored liquid on the recording medium that had been pulled out and allowed to stand for about 1 minute. Subsequently, the plain paper was gently peeled off, and the weight of the plain paper before and after the transfer test was measured and divided by the area of the image formed using the undercoat liquid and/or colored liquid, thus determining the amount (weight) transferred per unit area.

Tack-Free Sensitivity (Surface Curability)

The result of Test 1 (tack-free sensitivity) is given in Table 5. Here, tack-free sensitivity is defined as the exposure energy at which tackiness on the printed surface disappears. The presence or absence of tackiness of a printed surface was determined by pressing plain paper (Photocopy paper C2, manufactured by Fuji Xerox Co., Ltd.) thereagainst immediately after printing; when the undercoat liquid and/or the colored liquid transferred, tackiness was present, and when there was no transfer, tackiness was absent.

The exposure energy was changed between 350 mJ/cm$^2$ (1 lamp ON), 700 mJ/cm$^2$ (2 lamps ON), 1050 mJ/cm$^2$ (3 lamps ON), 1,400 mJ/cm$^2$ (4 lamps ON), and 1,750 mJ/cm$^2$ (5 lamps ON) (the results described in Table 5 being denoted by 1 for a tack-free sensitivity of 350 mJ/cm$^2$, 2 for 700 mJ/cm$^2$, 3 for 1050 mJ/cm$^2$, 4 for 1,400 mJ/cm$^2$, and 5 for 1,750 mJ/cm$^2$ respectively).

The lower the tack-free sensitivity, the more preferable from the viewpoint of surface curability, and it is particularly preferable for it to be 1,050 mJ/cm$^2$ or below (1, 2, or 3). The tack-free sensitivity was evaluated using printed material A. Here, printed material A denotes a solid printed material formed by discharging ink compositions of all colors as a test, and colored liquid droplets were applied at a pixel density of 600×600 dpi and 12 pL per pixel.

Fingernail Scratch Sensitivity (Curability)

The result of Test 2 (fingernail scratch sensitivity) is given in Table 5. Here, the fingernail scratch sensitivity was defined as the exposure energy at which peeling or tearing of a coating by scratching with a fingernail after printing was prevented. A printed material was scratched 5 times by means of a guitar pick or a fingernail, and when the coating did not peel or tear, it was determined that there was no peeling or tearing of the coating by fingernail scratching.

The exposure energy was changed between 350 mJ/cm$^2$ (1 lamp ON), 700 mJ/cm$^2$ (2 lamps ON), 1050 mJ/cm$^2$ (3 lamps ON), 1,400 mJ/cm$^2$ (4 lamps ON), and 1,750 mJ/cm$^2$ (5 lamps ON) (the results described in Table 5 being denoted by 1 for a fingernail scratch sensitivity of 350 mJ/cm$^2$, 2 for 700 mJ/cm$^2$, 3 for 1050 mJ/cm$^2$, 4 for 1,400 mJ/cm$^2$, and 5 for 1,750 mJ/cm$^2$ respectively).

The lower the fingernail scratch sensitivity, the more preferable from the viewpoint of surface curability, and it is particularly preferable for it to be 1,050 mJ/cm$^2$ or below (1, 2, or 3). The fingernail scratch sensitivity was evaluated using printed material A. Here, printed material A denotes a solid printed material formed by discharging ink compositions of all colors as a test, and colored liquid droplets were applied at a pixel density of 600×600 dpi and 12 pL per pixel.

Color Reproduction

Figure 15:
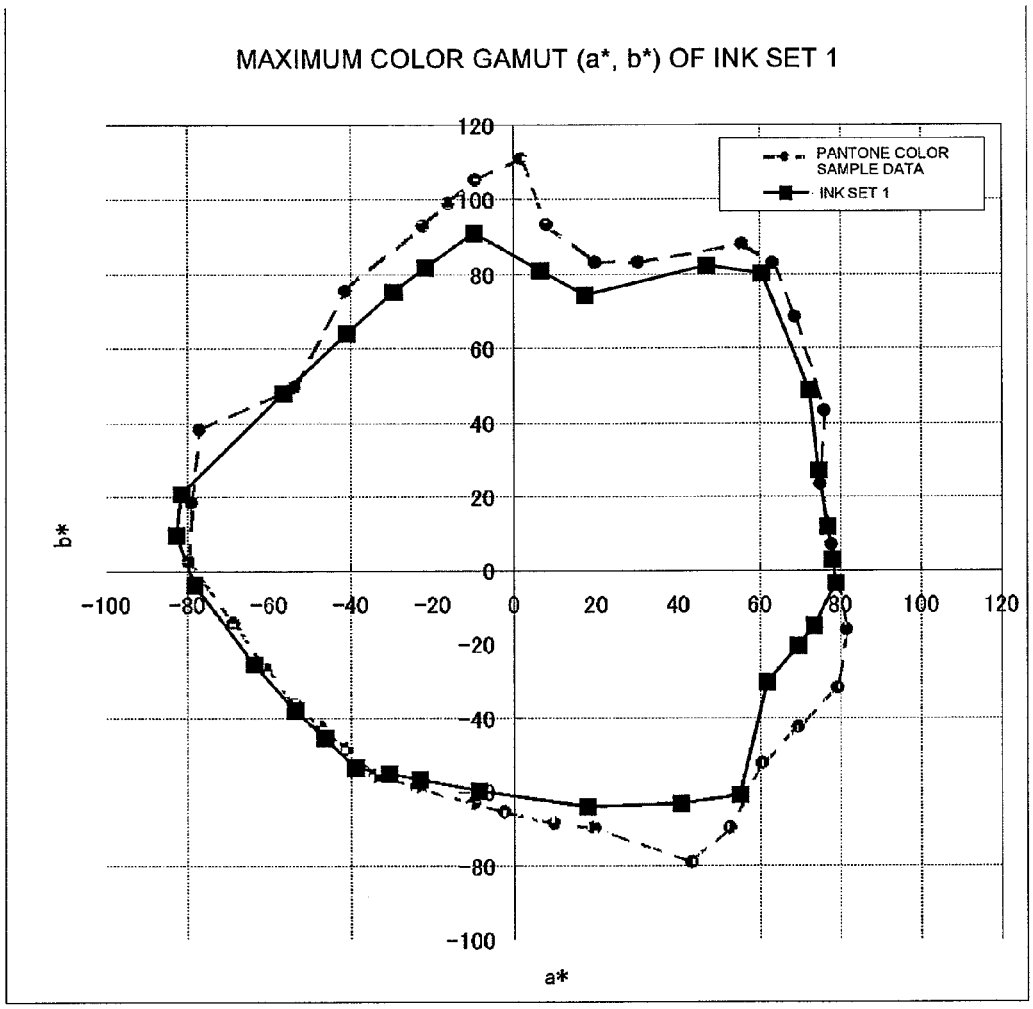
FIG. 15 is the result of evaluation of the color reproduction (maximum color gamut) of ink set 1.
Figure 16:
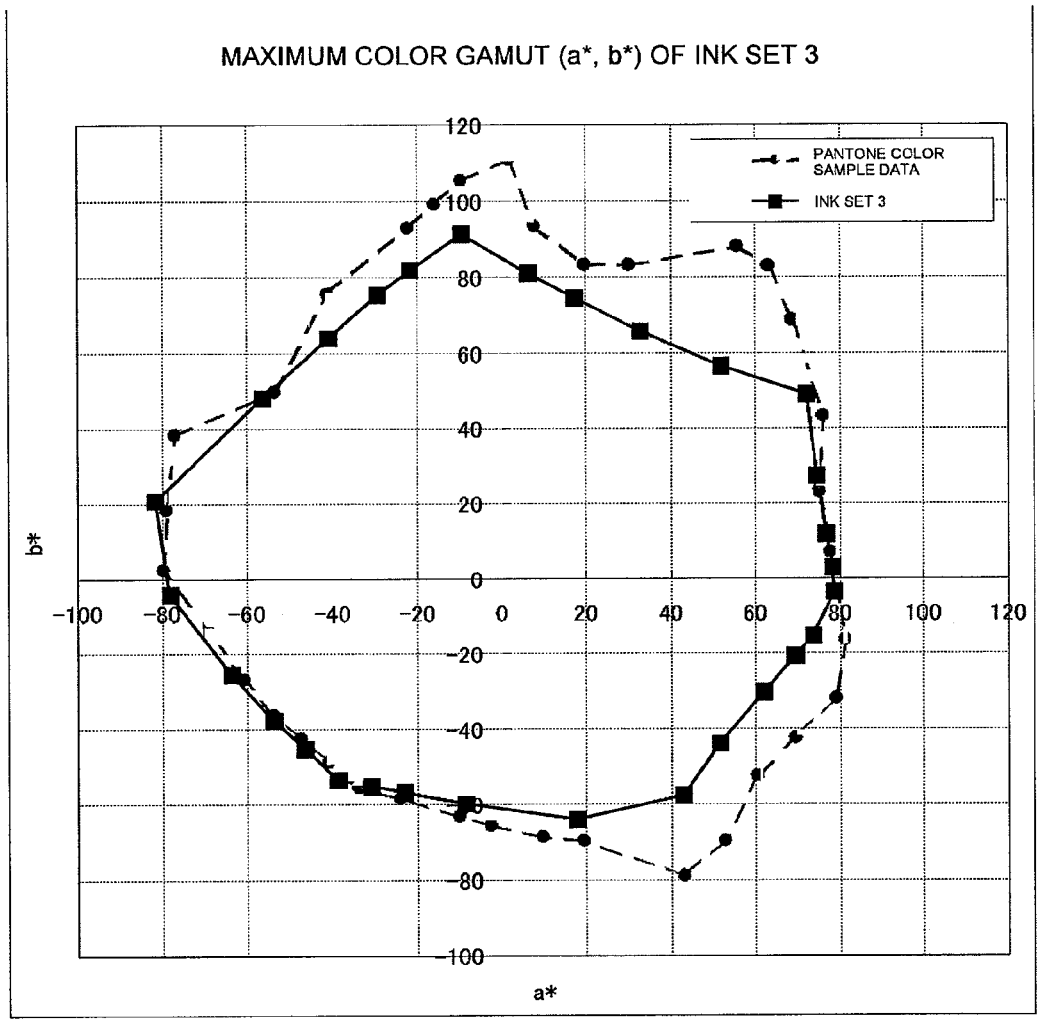
FIG. 16 is the result of evaluation of the color reproduction (maximum color gamut) of ink set 3.

The color reproduction (maximum color gamut) of each ink set was evaluated using the image recording system. The color gamut of ink set 1 and that of ink set 2 substantially coincided with each other. The results for ink set 1 and ink set 3 alone are shown in FIG. 15 and FIG. 16. FIG. 15 and FIG. 16 also show the results of PANTONE color sample data (PANTONE FORMULA GUIDE SOLID COATED) in addition to hue (a*, b*) data of printed materials.

Printed image data for cyan, magenta, and yellow process colors and printed image data for orange, violet, and green were prepared differently. Printed image data for process colors are equally distributed color patch data with a total of 950 colors. On the other hand, printed image data for special colors are patch data with 8 gray scale levels of all primary colors. The hue (a*, b*) and lightness (L) were measured using an SPM100-II (Gretag).

Image Quality

In accordance with the above-mentioned inkjet recording method, an image was recorded, and unevenness caused by dot displacement due to coalescence of liquid droplets was visually evaluated for the image surface after irradiation with UV rays. The unevenness was evaluated using the criteria below.

1: image had no unevenness.

2: image had unevenness in part.

3: image had unevenness over entire surface.

As shown in the test results above, it is suggested that, in accordance with the inkjet image recording method of the present invention, an image having good curability, color reproduction, and image quality can be formed.

With regard to the curability, by employing the color printing procedure recommended by the present invention it is possible to guarantee the penetration of actinic radiation to a lower layer, and good curability can be realized for a layered image. With regard to the color reproduction, in accordance with the ink set of the present invention, the color gamut has widened, and PANTONE color reproduction has improved. Furthermore, in accordance with the method involving a semi-cured undercoat of the present invention, the joining of adjacent image ink droplets is suppressed, thus enabling good image quality without image unevenness to be realized.

TABLE 5

| | | | Ex. 1 | Ex. 2 | Comp. Ex. 1 | Comp. Ex. 2 |
|---|---|---|---|---|---|---|
| | | | Ink set | | | |
| | | | 1 | 1 | 2 | 3 |
| Liquid charged | | Magenta head | M1 | M1 | M2 | M1 |
| | | Cyan head | C1 | C1 | C2 | C1 |
| | | Yellow head | Y1 | Y1 | Y2 | Y1 |
| | | Violet head | V1 | V1 | V2 | — |
| | | Orange head | O1 | O1 | O2 | — |
| | | Green head | G1 | G1 | G2 | — |
| | | White head | — | — | — | — |
| | | Black head | — | — | — | — |
| | | Undercoat liquid | U1 | U1 | — | U1 |
| Test 1 | Curability | Tack-free sensitivity | 2 | 2 | 3 | 2 |
| Test 2 | | Fingernail scratch sensitivity | 2 | 3 | 2 | 2 |
| Test 3 | | Color reproduction | FIG. 15 | — | — | FIG. 16 |
| Test 4 | | Image quality | 1 | 1 | 3 | 1 |

What is claimed is:

1. An inkjet recording method comprising:

(a) a step of applying an undercoat liquid onto a recording medium;

(b) a step of carrying out image formation by discharging colored liquids onto the undercoat liquid; and (c) a step of curing the colored liquids;

the colored liquids being a multiple color ink set comprising a plurality of ink compositions, and the colored liquids comprising an ink composition of at least one color selected from the group consisting of violet, blue, green, orange, and red, together with cyan color, magenta color, yellow color, black color, and white color ink compositions, wherein the step of carrying out image formation by discharging the colored liquid comprises, in sequence, a step of discharging a white color ink composition, a step of discharging a cyan color ink composition, a step of discharging a magenta color ink composition, a step of discharging an ink composition of at least one color selected from the group consisting of violet, blue, green, orange, and red, a step of discharging a yellow color ink composition, and a step of discharging a black color ink composition.

2. The inkjet recording method according to claim 1, wherein the method comprises a step of semi-curing the undercoat liquid after the step of applying the undercoat liquid and before the step of carrying out image formation.

3. The inkjet recording method according to claim 2, wherein the method further comprises, after discharging an ink composition of at least one color, a step of semi-curing the ink composition.

4. The inkjet recording method according to claim 1 wherein, when the surface tension of each of the colored liquids is $\gamma k$ and the surface tension of the undercoat liquid is $\gamma s$, $\gamma k > \gamma s$.

5. The inkjet recording method according to claim 1, wherein the colored liquids comprises an ink composition of at least one color selected from the group consisting of violet, green, and orange.

6. The inkjet recording method according to claim 1, wherein the colored liquids comprises a violet color ink composition, a green color ink composition, and an orange color ink composition.

7. The inkjet recording method according to claim 1, wherein the violet color ink composition comprises Pigment Violet 23.

8. The inkjet recording method according to claim 1, wherein the orange color ink composition comprises Pigment Orange 36.

9. The inkjet recording method according to claim 1, wherein the green color ink composition comprises Pigment Green 7.

10. The inkjet recording method according to claim 1, wherein the cyan color ink composition comprises Pigment Blue 15:3 and/or Pigment Blue 15:4.

11. The inkjet recording method according to claim 1, wherein the magenta color ink composition comprises Pigment Red 122 and/or Pigment Violet 19.

12. The inkjet recording method according to claim 1, wherein the yellow color ink composition comprises Pigment Yellow 155 and/or Pigment Yellow 180.

13. The inkjet recording method according to claim 1, wherein the white color ink composition comprises titanium oxide.

14. The inkjet recording method according to claim 1, wherein the method comprises, in sequence:

(a-1) a step of applying an undercoat liquid onto a recording medium;

(a-2) a step of semi-curing the undercoat liquid;

(b-1) a step of carrying out image formation by discharging a white color ink composition onto the undercoat liquid;

(c-1) a step of semi-curing the white color ink composition;

(b-2) a step of carrying out image formation by discharging a cyan color ink composition;

(c-2) a step of semi-curing the cyan color ink composition;

(b-3) a step of carrying out image formation by discharging a magenta color ink composition;

(c-3) a step of semi-curing the magenta color ink composition;

(b-4) a step of carrying out image formation by discharging an ink composition of at least one color selected from the group consisting of violet, blue, green, orange, and red;

(c-4) a step of semi-curing the ink composition of at least one color selected from the group consisting of violet, blue, green, orange, and red;

(b-5) a step of carrying out image formation by discharging a yellow color ink composition;

(c-5) a step of semi-curing the yellow color ink composition;

(b-6) a step of carrying out image formation by discharging a black color ink composition; and (c-6) a step of completely curing the undercoat liquid and all of the ink compositions.

15. The inkjet recording method according to claim 2, wherein the step of semi-curing the undercoat liquid is a step of curing the undercoat liquid advancing further in the interior than in the exterior.

16. The inkjet recording method according to claim 3, wherein semi-curing the ink composition is a step of curing the colored liquid advancing further in the interior than in the exterior.

* * * * *